US011542760B2

(12) United States Patent
Chambon et al.

(10) Patent No.: US 11,542,760 B2
(45) Date of Patent: Jan. 3, 2023

(54) RIG OPERATIONS CONTROLLER

(71) Applicant: Schlumberger Technology Corporation, Sugar Land, TX (US)

(72) Inventors: Sylvain Chambon, Katy, TX (US); Sai Venkatakrishnan Sankaranarayanan, Katy, TX (US)

( * ) Notice: Subject to any disclaimer, the term of this patent is extended or adjusted under 35 U.S.C. 154(b) by 0 days.

(21) Appl. No.: 17/247,195

(22) Filed: Dec. 3, 2020

(65) Prior Publication Data

US 2022/0178248 A1 Jun. 9, 2022

(51) Int. Cl.

| | |
|---|---|
| ***E21B 19/16*** | (2006.01) |
| ***E21B 47/09*** | (2012.01) |
| ***E21B 47/06*** | (2012.01) |
| ***E21B 19/08*** | (2006.01) |
| ***E21B 19/00*** | (2006.01) |
| ***E21B 19/10*** | (2006.01) |

(52) U.S. Cl.

CPC ..... *E21B 19/165* (2013.01); *E21B 19/00* (2013.01); *E21B 19/08* (2013.01); *E21B 19/10* (2013.01); *E21B 47/06* (2013.01); *E21B 47/09* (2013.01); *E21B 2200/22* (2020.05)

(58) Field of Classification Search

CPC ..... E21B 19/165; E21B 19/00; E21B 19/08; E21B 19/10; E21B 2200/22; E21B 47/06; E21B 47/09; E21B 19/16

See application file for complete search history.

(56) References Cited

U.S. PATENT DOCUMENTS 4,545,017 A * 10/1985 Richardson ..... G01P 3/68 702/9
4,549,431 A 10/1985 Soeiinah
5,107,705 A 4/1992 Wraight et al.
(Continued)

FOREIGN PATENT DOCUMENTS

CN 110674841 A 1/2020
EP 0422706 A2 4/1991
(Continued)

OTHER PUBLICATIONS 2.3 Clustering—scikit-learn 0.23.2 documentation accessed at https://scikit-learn.org/stable/modules/clustering.html#k-means on Dec. 3, 2020, 22 pages.
(Continued)

*Primary Examiner* — Brad Harcourt
(74) *Attorney, Agent, or Firm* — Alec J. McGinn

(57) ABSTRACT

A method can include, during drilling operations at a wellsite, receiving operational data, where the data include hookload data, surface rotation data and block position data; training a controller using the hookload data, the surface rotation data and the block position data for determination of one or more transition thresholds, where the transitions thresholds include an in-slips to out-of-slips transition threshold and an out-of-slips to in-slips transition threshold; during the drilling operations, receiving additional operational data that include additional hookload data; and storing at least a portion of the additional operational data in association with slips state as determined based at least in part on a comparison of at least a portion of the additional hookload data and at least one of the determined transition thresholds.

19 Claims, 34 Drawing Sheets

(56) References Cited

U.S. PATENT DOCUMENTS

| | | | | |
|---|---|---|---|---|
| 6,174,001 | B1 | 1/2001 | Enderle | |
| 2004/0040746 | A1 | 3/2004 | Niedermayr et al. | |
| 2004/0124012 | A1 | 7/2004 | Dunlop et al. | |
| 2005/0087367 | A1 | 4/2005 | Hutchinson | |
| 2016/0290073 | A1* | 10/2016 | Zheng | E21B 44/00 |
| 2018/0003024 | A1* | 1/2018 | Khare | G05B 23/0208 |
| 2018/0238162 | A1* | 8/2018 | Jeffryes | E21B 44/02 |
| 2019/0024493 | A1* | 1/2019 | Johnson | G06N 20/10 |
| 2019/0264516 | A1 | 8/2019 | Gutarov et al. | |
| 2019/0338635 | A1* | 11/2019 | Orban | E21B 7/04 |

FOREIGN PATENT DOCUMENTS

| | | | |
|---|---|---|---|
| EP | 3504400 | B1 | 6/2020 |
| GB | 2496523 | A | 5/2013 |
| WO | 2019005908 | A1 | 1/2019 |
| WO | 2020191360 | A1 | 9/2020 |

OTHER PUBLICATIONS

International Search Report and Written Opinion for the equivalent International patent application PCT/IB2016/001165 dated Mar. 17, 2017.

International Preliminary Report on Patentability for the equivalent International patent application PCT/IB2016/001165 dated Jan. 3, 2019.

2.3 Clustering—scikit-learn 0.23.2 documentation accessed at https://scikit-learn.org/stable/modules/clustering.html#k-means on Nov. 19, 2020, 31 pages.

Zhao et al., "Automatic Slip Status and Stand Detection in Real-Time Drilling," Offshore Technology Conference, Houston, Texas, USA, May 6-9, 2019, OTC-29372-MS, 14 pages.

Lasseter, T., Karakas, M., and Schweitzer, "Interpreting an RFT-Measured Pulse Test with a Three-Dimensional Simulator," J., SPE 14878, Mar. 1988.

Bunn, G.F., and Yaxley, L.M., "Design, Implementation, and Interpretation of a Three-Dimensional Well Test in the Cormorant Field, North Sea," SPE 15858, Oct. 1986.

Saeedi, J., and Standen, E., "Layer Pulse Testing Using a Wireline Formation Tester," SPE 16803, Sep. 1987.

Bunn, G.F., Wittman, M.J., Morgan, W.D., and Curnutt, R.C., "Distributed Pressure Measurements Allow Early Quantification of Reservoir Dynamics in the Jene Field," SPE 17682, Mar. 1991.

Yaxley, L.M. , and Blaymires, J. M., "A Field Example of Interference Testing Across a Partially Communicating Fault," SPE 19306, 1989.

Kaneda, R., Saeedi, J., and Ayestaran, L.C., "Interpretation of a Pulse Test in a Layered Reservoir," SPE 21337, Dec. 1991.

Examination report for the equivalent GB patent application No. 2496523 dated Feb. 11, 2013.

International Search Report and Written Opinion of International patent application PCT/US2021/072647 dated Mar. 25, 2022, 12 pages.

* cited by examiner

RIG OPERATIONS CONTROLLER

BACKGROUND

A resource field can be an accumulation, pool or group of pools of one or more resources (e.g., oil, gas, oil and gas) in a subsurface environment. A resource field can include at least one reservoir. A reservoir may be shaped in a manner that can trap hydrocarbons and may be covered by an impermeable or sealing rock. A bore can be drilled into an environment where the bore may be utilized to form a well that can be utilized in producing hydrocarbons from a reservoir.

A rig can be a system of components that can be operated to form a bore in an environment, to transport equipment into and out of a bore in an environment, etc. As an example, a rig can include a system that can be used to drill a bore and to acquire information about an environment, about drilling, etc. A resource field may be an onshore field, an offshore field or an on- and offshore field. A rig can include components for performing operations onshore and/or offshore. A rig may be, for example, vessel-based, offshore platform-based, onshore, etc.

Field planning can occur over one or more phases, which can include an exploration phase that aims to identify and assess an environment (e.g., a prospect, a play, etc.), which may include drilling of one or more bores (e.g., one or more exploratory wells, etc.). Other phases can include appraisal, development and production phases.

SUMMARY

A method can include, during drilling operations at a wellsite, receiving operational data, where the data include hookload data, surface rotation data and block position data; training a controller using the hookload data, the surface rotation data and the block position data for determination of one or more transition thresholds, where the transitions thresholds include an in-slips to out-of-slips transition threshold and an out-of-slips to in-slips transition threshold; during the drilling operations, receiving additional operational data that include additional hookload data; and storing at least a portion of the additional operational data in association with slips state as determined based at least in part on a comparison of at least a portion of the additional hookload data and at least one of the determined transition thresholds. A system can include a processor; memory operatively coupled to the processor; processor-executable instructions stored in the memory and executable by the processor to instruct the system to: during drilling operations at a wellsite, receive operational data, where the data include hookload data, surface rotation data and block position data; train a controller using the hookload data, the surface rotation data and the block position data for determination of one or more transition thresholds, where the transitions thresholds include an in-slips to out-of-slips transition threshold and an out-of-slips to in-slips transition threshold; during the drilling operations, receive additional operational data that include additional hookload data; and store at least a portion of the additional operational data in association with slips state as determined based at least in part on a comparison of at least a portion of the additional hookload data and at least one of the determined transition thresholds. One or more computer-readable storage media can include processor-executable instructions to instruct a computing system to: during drilling operations at a wellsite, receive operational data, where the data include hookload data, surface rotation data and block position data; train a controller using the hookload data, the surface rotation data and the block position data for determination of one or more transition thresholds, where the transitions thresholds include an in-slips to out-of-slips transition threshold and an out-of-slips to in-slips transition threshold; during the drilling operations, receive additional operational data that include additional hookload data; and store at least a portion of the additional operational data in association with slips state as determined based at least in part on a comparison of at least a portion of the additional hookload data and at least one of the determined transition thresholds. Various other apparatuses, systems, methods, etc., are also disclosed.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Features and advantages of the described implementations can be more readily understood by reference to the following description taken in conjunction with the accompanying drawings.

DETAILED DESCRIPTION

The following description includes the best mode presently contemplated for practicing the described implementations. This description is not to be taken in a limiting sense, but rather is made merely for the purpose of describing the general principles of the implementations. The scope of the described implementations should be ascertained with reference to the issued claims.

Figure 1:
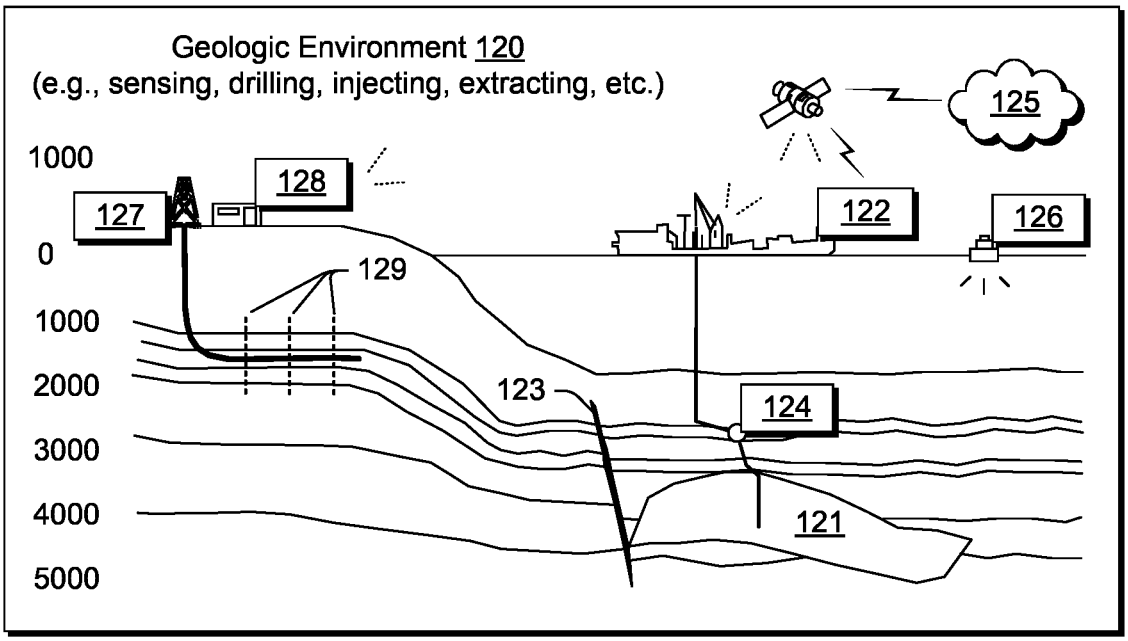
FIG. 1 illustrates examples of equipment in a geologic environment.
Figure 1:
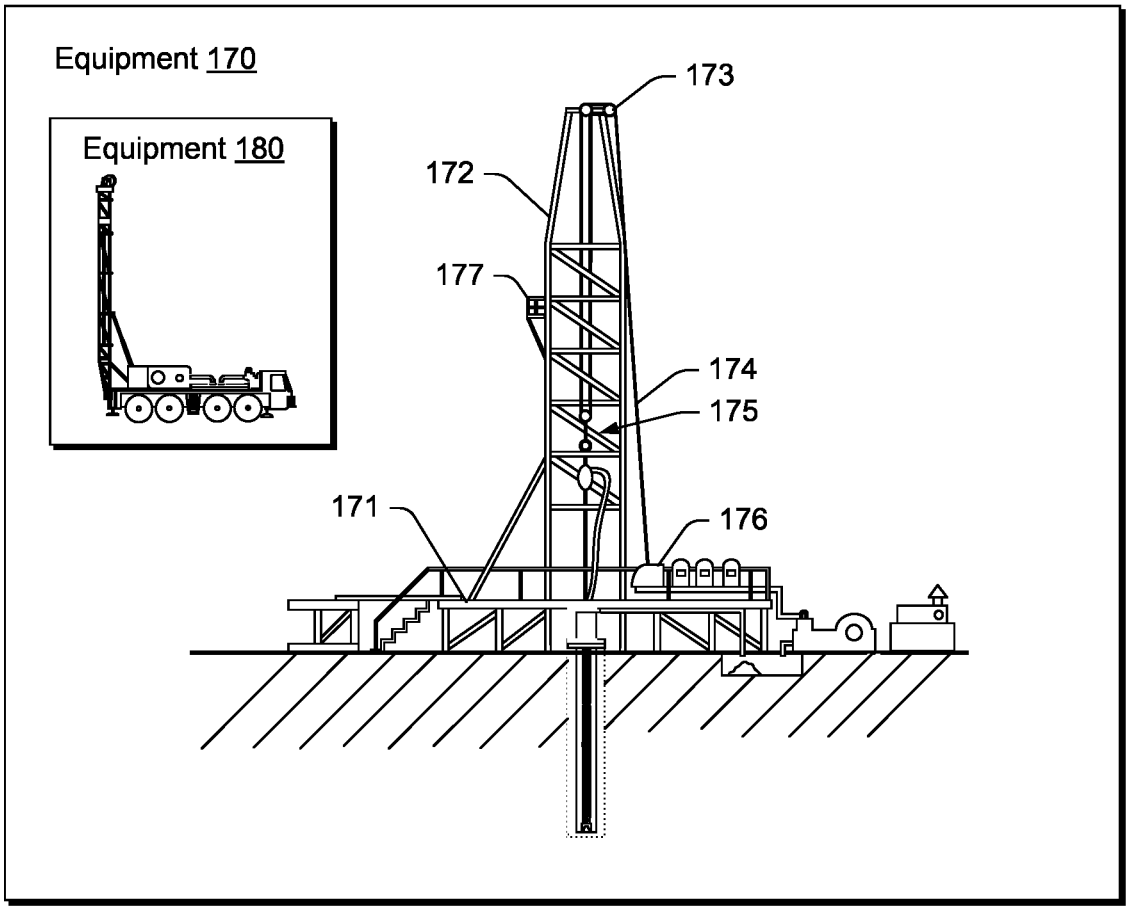

FIG. 1 shows an example of a geologic environment 120. In FIG. 1, the geologic environment 120 may be a sedimentary basin that includes layers (e.g., stratification) that include a reservoir 121 and that may be, for example, intersected by a fault 123 (e.g., or faults). As an example, the geologic environment 120 may be outfitted with any of a variety of sensors, detectors, actuators, etc. For example, equipment 122 may include communication circuitry to receive and to transmit information with respect to one or more networks 125. Such information may include information associated with downhole equipment 124, which may be equipment to acquire information, to assist with resource recovery, etc. Other equipment 126 may be located remote from a well site and include sensing, detecting, emitting or other circuitry. Such equipment may include storage and communication circuitry to store and to communicate data, instructions, etc. As an example, one or more pieces of equipment may provide for measurement, collection, communication, storage, analysis, etc. of data (e.g., for one or more produced resources, etc.). As an example, one or more satellites may be provided for purposes of communications, data acquisition, etc. For example, FIG. 1 shows a satellite in communication with the network 125 that may be configured for communications, noting that the satellite may additionally or alternatively include circuitry for imagery (e.g., spatial, spectral, temporal, radiometric, etc.).

FIG. 1 also shows the geologic environment 120 as optionally including equipment 127 and 128 associated with a well that includes a substantially horizontal portion that may intersect with one or more fractures 129. For example, consider a well in a shale formation that may include natural fractures, artificial fractures (e.g., hydraulic fractures) or a combination of natural and artificial fractures. As an example, a well may be drilled for a reservoir that is laterally extensive. In such an example, lateral variations in properties, stresses, etc. may exist where an assessment of such variations may assist with planning, operations, etc. to develop the reservoir (e.g., via fracturing, injecting, extracting, etc.). As an example, the equipment 127 and/or 128 may include components, a system, systems, etc. for fracturing, seismic sensing, analysis of seismic data, assessment of one or more fractures, injection, production, etc. As an example, the equipment 127 and/or 128 may provide for measurement, collection, communication, storage, analysis, etc. of data such as, for example, production data (e.g., for one or more produced resources). As an example, one or more satellites may be provided for purposes of communications, data acquisition, etc.

FIG. 1 also shows an example of equipment 170 and an example of equipment 180. Such equipment, which may be systems of components, may be suitable for use in the geologic environment 120. While the equipment 170 and 180 are illustrated as land-based, various components may be suitable for use in an offshore system.

The equipment 170 includes a platform 171, a derrick 172, a crown block 173, a line 174, a traveling block assembly 175, drawworks 176 and a landing 177 (e.g., a monkeyboard). As an example, the line 174 may be controlled at least in part via the drawworks 176 such that the traveling block assembly 175 travels in a vertical direction with respect to the platform 171. For example, by drawing the line 174 in, the drawworks 176 may cause the line 174 to run through the crown block 173 and lift the traveling block assembly 175 skyward away from the platform 171; whereas, by allowing the line 174 out, the drawworks 176 may cause the line 174 to run through the crown block 173 and lower the traveling block assembly 175 toward the platform 171. Where the traveling block assembly 175 carries pipe (e.g., casing, etc.), tracking of movement of the traveling block 175 may provide an indication as to how much pipe has been deployed.

A derrick can be a structure used to support a crown block and a traveling block operatively coupled to the crown block at least in part via line. A derrick may be pyramidal in shape and offer a suitable strength-to-weight ratio. A derrick may be movable as a unit or in a piece by piece manner (e.g., to be assembled and disassembled).

As an example, drawworks may include a spool, brakes, a power source and assorted auxiliary devices. Drawworks may controllably reel out and reel in line. Line may be reeled over a crown block and coupled to a traveling block to gain mechanical advantage in a "block and tackle" or "pulley" fashion. Reeling out and in of line can cause a traveling block (e.g., and whatever may be hanging underneath it), to be lowered into or raised out of a bore. Reeling out of line may be powered by gravity and reeling in by a motor, an engine, etc. (e.g., an electric motor, a diesel engine, etc.).

As an example, a crown block can include a set of pulleys (e.g., sheaves) that can be located at or near a top of a derrick or a mast, over which line is threaded. A traveling block can include a set of sheaves that can be moved up and down in a derrick or a mast via line threaded in the set of sheaves of the traveling block and in the set of sheaves of a crown block. A crown block, a traveling block and a line can form a pulley system of a derrick or a mast, which may enable handling of heavy loads (e.g., drillstring, pipe, casing, liners, etc.) to be lifted out of or lowered into a bore. As an example, line may be about a centimeter to about five centimeters in diameter as, for example, steel cable. Through use of a set of sheaves, such line may carry loads heavier than the line could support as a single strand.

As an example, a derrickman may be a rig crew member that works on a platform attached to a derrick or a mast. A derrick can include a landing on which a derrickman may stand. As an example, such a landing may be about 10 meters or more above a rig floor. In an operation referred to as trip out of the hole (TOH), a derrickman may wear a safety harness that enables leaning out from the work landing (e.g., monkeyboard) to reach pipe in located at or near the center of a derrick or a mast and to throw a line around the pipe and pull it back into its storage location (e.g., fingerboards), for example, until it a time at which it may be desirable to run the pipe back into the bore. As an example, a rig may include automated pipe-handling equipment such that the derrickman controls the machinery rather than physically handling the pipe.

As an example, a trip may refer to the act of pulling equipment from a bore and/or placing equipment in a bore. As an example, equipment may include a drillstring that can be pulled out of a hole and/or placed or replaced in a hole. As an example, a pipe trip may be performed where a drill bit has dulled or has otherwise ceased to drill efficiently and is to be replaced.

Figure 2:
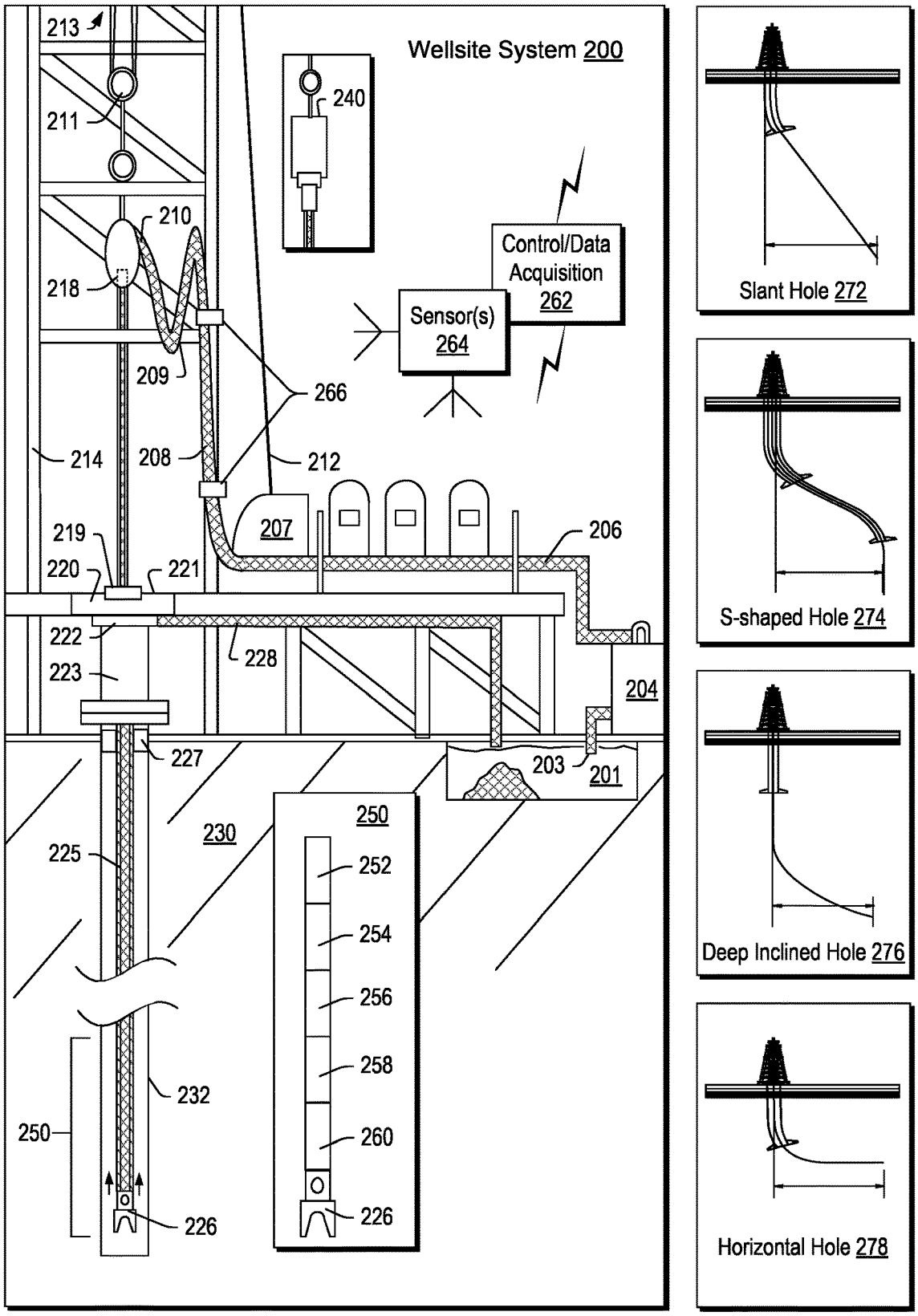
FIG. 2 illustrates examples of equipment and examples of hole types.

FIG. 2 shows an example of a wellsite system 200 (e.g., at a wellsite that may be onshore or offshore). As shown, the wellsite system 200 can include a mud tank 201 for holding mud and other material (e.g., where mud can be a drilling fluid), a suction line 203 that serves as an inlet to a mud pump 204 for pumping mud from the mud tank 201 such that mud flows to a vibrating hose 206, a drawworks 207 for winching drill line or drill lines 212, a standpipe 208 that receives mud from the vibrating hose 206, a kelly hose 209 that receives mud from the standpipe 208, a gooseneck or goosenecks 210, a traveling block 211, a crown block 213 for carrying the traveling block 211 via the drill line or drill lines 212 (see, e.g., the crown block 173 of FIG. 1), a derrick 214 (see, e.g., the derrick 172 of FIG. 1), a kelly 218 or a top drive 240, a kelly drive bushing 219, a rotary table 220, a drill floor 221, a bell nipple 222, one or more blowout preventors (BOPs) 223, a drillstring 225, a drill bit 226, a casing head 227 and a flow pipe 228 that carries mud and other material to, for example, the mud tank 201.

In the example system of FIG. 2, a borehole 232 is formed in subsurface formations 230 by rotary drilling; noting that various example embodiments may also use directional drilling.

As shown in the example of FIG. 2, the drillstring 225 is suspended within the borehole 232 and has a drillstring assembly 250 that includes the drill bit 226 at its lower end. As an example, the drillstring assembly 250 may be a bottom hole assembly (BHA).

The wellsite system 200 can provide for operation of the drillstring 225 and other operations. As shown, the wellsite system 200 includes the platform 211 and the derrick 214 positioned over the borehole 232. As mentioned, the wellsite system 200 can include the rotary table 220 where the drillstring 225 pass through an opening in the rotary table 220.

As shown in the example of FIG. 2, the wellsite system 200 can include the kelly 218 and associated components, etc., or a top drive 240 and associated components. As to a kelly example, the kelly 218 may be a square or hexagonal metal/alloy bar with a hole drilled therein that serves as a mud flow path. The kelly 218 can be used to transmit rotary motion from the rotary table 220 via the kelly drive bushing 219 to the drillstring 225, while allowing the drillstring 225 to be lowered or raised during rotation. The kelly 218 can pass through the kelly drive bushing 219, which can be driven by the rotary table 220. As an example, the rotary table 220 can include a master bushing that operatively couples to the kelly drive bushing 219 such that rotation of the rotary table 220 can turn the kelly drive bushing 219 and hence the kelly 218. The kelly drive bushing 219 can include an inside profile matching an outside profile (e.g., square, hexagonal, etc.) of the kelly 218; however, with slightly larger dimensions so that the kelly 218 can freely move up and down inside the kelly drive bushing 219.

As to a top drive example, the top drive 240 can provide functions performed by a kelly and a rotary table. The top drive 240 can turn the drillstring 225. As an example, the top drive 240 can include one or more motors (e.g., electric and/or hydraulic) connected with appropriate gearing to a short section of pipe called a quill, that in turn may be screwed into a saver sub or the drillstring 225 itself. The top drive 240 can be suspended from the traveling block 211, so the rotary mechanism is free to travel up and down the derrick 214. As an example, a top drive 240 may allow for drilling to be performed with more joint stands than a kelly/rotary table approach.

In the example of FIG. 2, the mud tank 201 can hold mud, which can be one or more types of drilling fluids. As an example, a wellbore may be drilled to produce fluid, inject fluid or both (e.g., hydrocarbons, minerals, water, etc.).

In the example of FIG. 2, the drillstring 225 (e.g., including one or more downhole tools) may be composed of a series of pipes threadably connected together to form a long tube with the drill bit 226 at the lower end thereof. As the drillstring 225 is advanced into a wellbore for drilling, at some point in time prior to or coincident with drilling, the mud may be pumped by the pump 204 from the mud tank 201 (e.g., or other source) via the lines 206, 208 and 209 to a port of the kelly 218 or, for example, to a port of the top drive 240. The mud can then flow via a passage (e.g., or passages) in the drillstring 225 and out of ports located on the drill bit 226 (see, e.g., a directional arrow). As the mud exits the drillstring 225 via ports in the drill bit 226, it can then circulate upwardly through an annular region between an outer surface(s) of the drillstring 225 and surrounding wall(s) (e.g., open borehole, casing, etc.), as indicated by directional arrows. In such a manner, the mud lubricates the drill bit 226 and carries heat energy (e.g., frictional or other energy) and formation cuttings to the surface where the mud (e.g., and cuttings) may be returned to the mud tank 201, for example, for recirculation (e.g., with processing to remove cuttings, etc.).

The mud pumped by the pump 204 into the drillstring 225 may, after exiting the drillstring 225, form a mudcake that lines the wellbore which, among other functions, may reduce friction between the drillstring 225 and surrounding wall(s) (e.g., borehole, casing, etc.). A reduction in friction may facilitate advancing or retracting the drillstring 225. During a drilling operation, the entire drill string 225 may be pulled from a wellbore and optionally replaced, for example, with a new or sharpened drill bit, a smaller diameter drill string, etc. As mentioned, the act of pulling a drill string out of a hole or replacing it in a hole is referred to as tripping. A trip may be referred to as an upward trip or an outward trip or as a downward trip or an inward trip depending on trip direction.

As an example, consider a downward trip where upon arrival of the drill bit 226 of the drill string 225 at a bottom of a wellbore, pumping of the mud commences to lubricate the drill bit 226 for purposes of drilling to enlarge the wellbore. As mentioned, the mud can be pumped by the pump 204 into a passage of the drillstring 225 and, upon filling of the passage, the mud may be used as a transmission medium to transmit energy, for example, energy that may encode information as in mud-pulse telemetry.

As an example, mud-pulse telemetry equipment may include a downhole device configured to effect changes in pressure in the mud to create an acoustic wave or waves upon which information may modulated. In such an example, information from downhole equipment (e.g., one or more modules of the drillstring 225) may be transmitted uphole to an uphole device, which may relay such information to other equipment for processing, control, etc.

As an example, telemetry equipment may operate via transmission of energy via the drillstring 225 itself. For example, consider a signal generator that imparts coded energy signals to the drillstring 225 and repeaters that may receive such energy and repeat it to further transmit the coded energy signals (e.g., information, etc.).

As an example, the drillstring 225 may be fitted with telemetry equipment 252 that includes a rotatable drive shaft, a turbine impeller mechanically coupled to the drive shaft such that the mud can cause the turbine impeller to rotate, a modulator rotor mechanically coupled to the drive shaft such that rotation of the turbine impeller causes said modulator rotor to rotate, a modulator stator mounted adjacent to or proximate to the modulator rotor such that rotation of the modulator rotor relative to the modulator stator creates pressure pulses in the mud, and a controllable brake for selectively braking rotation of the modulator rotor to modulate pressure pulses. In such example, an alternator may be coupled to the aforementioned drive shaft where the alternator includes at least one stator winding electrically coupled to a control circuit to selectively short the at least one stator winding to electromagnetically brake the alternator and thereby selectively brake rotation of the modulator rotor to modulate the pressure pulses in the mud.

In the example of FIG. 2, an uphole control and/or data acquisition system 262 may include circuitry to sense pressure pulses generated by telemetry equipment 252 and, for example, communicate sensed pressure pulses or information derived therefrom for process, control, etc.

The assembly 250 of the illustrated example includes a logging-while-drilling (LWD) module 254, a measuring-while-drilling (MWD) module 256, an optional module 258, a roto-steerable system and motor 260, and the drill bit 226. Such components or modules may be referred to as tools where a drillstring can include a plurality of tools.

The LWD module 254 may be housed in a suitable type of drill collar and can contain one or a plurality of selected types of logging tools. It will also be understood that more than one LWD and/or MWD module can be employed, for example, as represented at by the module 256 of the drillstring assembly 250. Where the position of an LWD module is mentioned, as an example, it may refer to a module at the position of the LWD module 254, the module 256, etc. An LWD module can include capabilities for measuring, processing, and storing information, as well as for communicating with the surface equipment. In the illustrated example, the LWD module 254 may include a seismic measuring device.

The MWD module 256 may be housed in a suitable type of drill collar and can contain one or more devices for measuring characteristics of the drillstring 225 and the drill bit 226. As an example, the MWD tool 254 may include equipment for generating electrical power, for example, to power various components of the drillstring 225. As an example, the MWD tool 254 may include the telemetry equipment 252, for example, where the turbine impeller can generate power by flow of the mud; it being understood that other power and/or battery systems may be employed for purposes of powering various components. As an example, the MWD module 256 may include one or more of the following types of measuring devices: a weight-on-bit measuring device, a torque measuring device, a vibration measuring device, a shock measuring device, a stick slip measuring device, a direction measuring device, and an inclination measuring device.

FIG. 2 also shows some examples of types of holes that may be drilled. For example, consider a slant hole 272, an S-shaped hole 274, a deep inclined hole 276 and a horizontal hole 278.

As an example, a drilling operation can include directional drilling where, for example, at least a portion of a well includes a curved axis. For example, consider a radius that defines curvature where an inclination with regard to the vertical may vary until reaching an angle between about 30 degrees and about 60 degrees or, for example, an angle to about 90 degrees or possibly greater than about 90 degrees.

As an example, a directional well can include several shapes where each of the shapes may aim to meet particular operational demands. As an example, a drilling process may be performed on the basis of information as and when it is relayed to a drilling engineer. As an example, inclination and/or direction may be modified based on information received during a drilling process.

As an example, deviation of a bore may be accomplished in part by use of a downhole motor and/or a turbine. As to a motor, for example, a drillstring can include a positive displacement motor (PDM).

As an example, a system may be a steerable system and include equipment to perform a method such as geosteering. As an example, a steerable system can include a PDM or a turbine on a lower part of a drillstring which, just above a drill bit, a bent sub can be mounted. As an example, above a PDM, MWD equipment that provides real-time or near real-time data of interest (e.g., inclination, direction, pressure, temperature, real weight on the drill bit, torque stress, etc.) and/or LWD equipment may be installed. As to the latter, LWD equipment can make it possible to send to the surface various types of data of interest, including for example, geological data (e.g., gamma ray log, resistivity, density and sonic logs, etc.).

The coupling of sensors providing information on the course of a well trajectory, in real-time or near real-time, with, for example, one or more logs characterizing the formations from a geological viewpoint, can allow for implementing a geosteering method. Such a method can include navigating a subsurface environment, for example, to follow a desired route to reach a desired target or targets.

As an example, a drillstring can include an azimuthal density neutron (ADN) tool for measuring density and porosity; a MWD tool for measuring inclination, azimuth and shocks; a compensated dual resistivity (CDR) tool for measuring resistivity and gamma ray related phenomena; one or more variable gauge stabilizers; one or more bend joints; and a geosteering tool, which may include a motor and optionally equipment for measuring and/or responding to one or more of inclination, resistivity and gamma ray related phenomena.

As an example, geosteering can include intentional directional control of a wellbore based on results of downhole geological logging measurements in a manner that aims to keep a directional wellbore within a desired region, zone (e.g., a pay zone), etc. As an example, geosteering may include directing a wellbore to keep the wellbore in a particular section of a reservoir, for example, to minimize gas and/or water breakthrough and, for example, to maximize economic production from a well that includes the wellbore.

Referring again to FIG. 2, the wellsite system 200 can include one or more sensors 264 that are operatively coupled to the control and/or data acquisition system 262. As an example, a sensor or sensors may be at surface locations. As an example, a sensor or sensors may be at downhole locations. As an example, a sensor or sensors may be at one or more remote locations that are not within a distance of the order of about one hundred meters from the wellsite system 200. As an example, a sensor or sensor may be at an offset wellsite where the wellsite system 200 and the offset wellsite are in a common field (e.g., oil and/or gas field).

As an example, one or more of the sensors 264 can be provided for tracking pipe, tracking movement of at least a portion of a drillstring, etc.

As an example, the system 200 can include one or more sensors 266 that can sense and/or transmit signals to a fluid conduit such as a drilling fluid conduit (e.g., a drilling mud conduit). For example, in the system 200, the one or more sensors 266 can be operatively coupled to portions of the standpipe 208 through which mud flows. As an example, a downhole tool can generate pulses that can travel through the mud and be sensed by one or more of the one or more sensors 266. In such an example, the downhole tool can include associated circuitry such as, for example, encoding circuitry that can encode signals, for example, to reduce demands as to transmission. As an example, circuitry at the surface may include decoding circuitry to decode encoded information transmitted at least in part via mud-pulse telemetry. As an example, circuitry at the surface may include encoder circuitry and/or decoder circuitry and circuitry downhole may include encoder circuitry and/or decoder circuitry. As an example, the system 200 can include a transmitter that can generate signals that can be transmitted downhole via mud (e.g., drilling fluid) as a transmission medium.

As an example, one or more portions of a drillstring may become stuck. The term stuck can refer to one or more of varying degrees of inability to move or remove a drillstring from a bore. As an example, in a stuck condition, it might be possible to rotate pipe or lower it back into a bore or, for example, in a stuck condition, there may be an inability to move the drillstring axially in the bore, though some amount of rotation may be possible. As an example, in a stuck condition, there may be an inability to move at least a portion of the drillstring axially and rotationally.

As to the term "stuck pipe", this can refer to a portion of a drillstring that cannot be rotated or moved axially. As an example, a condition referred to as "differential sticking" can be a condition whereby the drillstring cannot be moved (e.g., rotated or reciprocated) along the axis of the bore. Differential sticking may occur when high-contact forces caused by low reservoir pressures, high wellbore pressures, or both, are exerted over a sufficiently large area of the drillstring. Differential sticking can have time and financial cost.

As an example, a sticking force can be a product of the differential pressure between the wellbore and the reservoir and the area that the differential pressure is acting upon. This means that a relatively low differential pressure (delta p) applied over a large working area can be just as effective in sticking pipe as can a high differential pressure applied over a small area.

As an example, a condition referred to as "mechanical sticking" can be a condition where limiting or prevention of motion of the drillstring by a mechanism other than differential pressure sticking occurs. Mechanical sticking can be caused, for example, by one or more of junk in the hole, wellbore geometry anomalies, cement, keyseats or a buildup of cuttings in the annulus.

Figure 3:
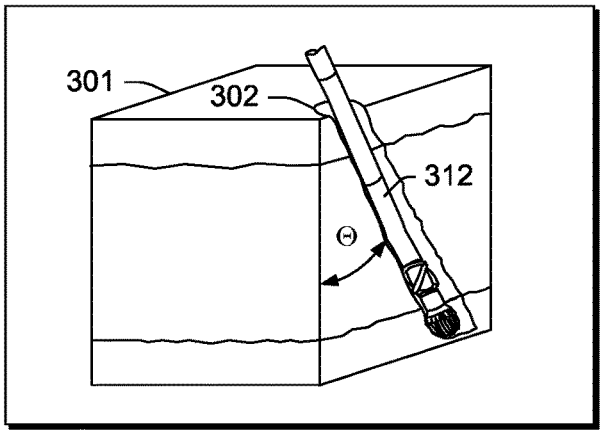
FIG. 3 illustrates examples of equipment with respect to a geologic environment.
Figure 3:
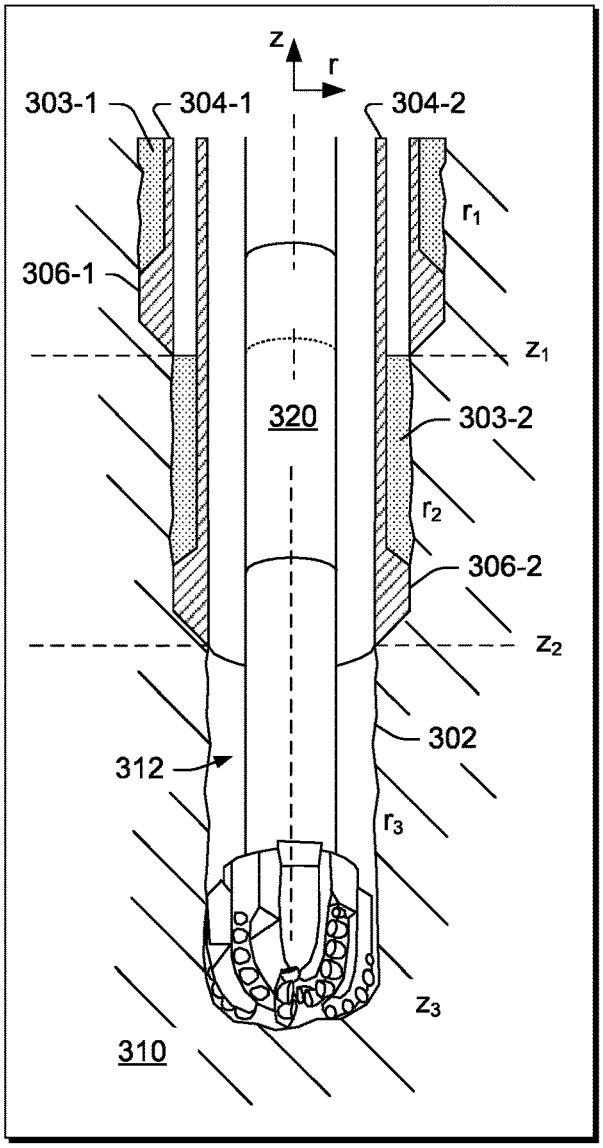

FIG. 3 illustrates an example of a system 310 that includes a drill string 312 with one or more tools (or module(s)) 320. In the example of FIG. 3, the system 310 is illustrated with respect to a wellbore 302 (e.g., a borehole) in a portion of a subterranean formation 301 (e.g., a sedimentary basin). The wellbore 302 may be defined in part by an angle (Θ); noting that while the wellbore 302 is shown as being deviated, it may be vertical (e.g., or include one or more vertical sections along with one or more deviated sections, which may be, for example, lateral, horizontal, etc.).

As shown in an enlarged view with respect to an r, z coordinate system (e.g., a cylindrical coordinate system), a portion of the wellbore 302 includes casings 304-1 and 304-2 having casing shoes 306-1 and 306-2. As shown, cement annuli 303-1 and 303-2 are disposed between the wellbore 302 and the casings 304-1 and 304-2. Cement such as the cement annuli 303-1 and 303-2 can support and protect casings such as the casings 304-1 and 304-2 and when cement is disposed throughout various portions of a wellbore such as the wellbore 302, cement can help achieve zonal isolation.

In the example of FIG. 3, the wellbore 302 has been drilled in sections or segments beginning with a large diameter section (see, e.g., $r_1$) followed by an intermediate diameter section (see, e.g., $r_2$) and a smaller diameter section (see, e.g., $r_3$). As an example, a large diameter section may be a surface casing section, which may be three or more feet in diameter (e.g., about one meter or more) and extend down several hundred feet (e.g., about 50 m or more) to several thousand feet (e.g., about 500 m or more). A surface casing section may aim to prevent washout of loose unconsolidated formations. As to an intermediate casing section, it may aim to isolate and protect high pressure zones, guard against lost circulation zones, etc. As an example, intermediate casing may be set at about X thousand feet and extend lower with one or more intermediate casing portions of decreasing diameter (e.g., in a range from about thirteen to about five inches in diameter or from about 33 cm to about 13 cm in diameter). A so-called production casing section may extend below an intermediate casing section and, upon completion, be the longest running section within a wellbore (e.g., a production casing section may be thousands of feet in length). As an example, production casing may be located in a target zone where the casing is perforated for flow of fluid into a lumen of the casing.

Figure 4:
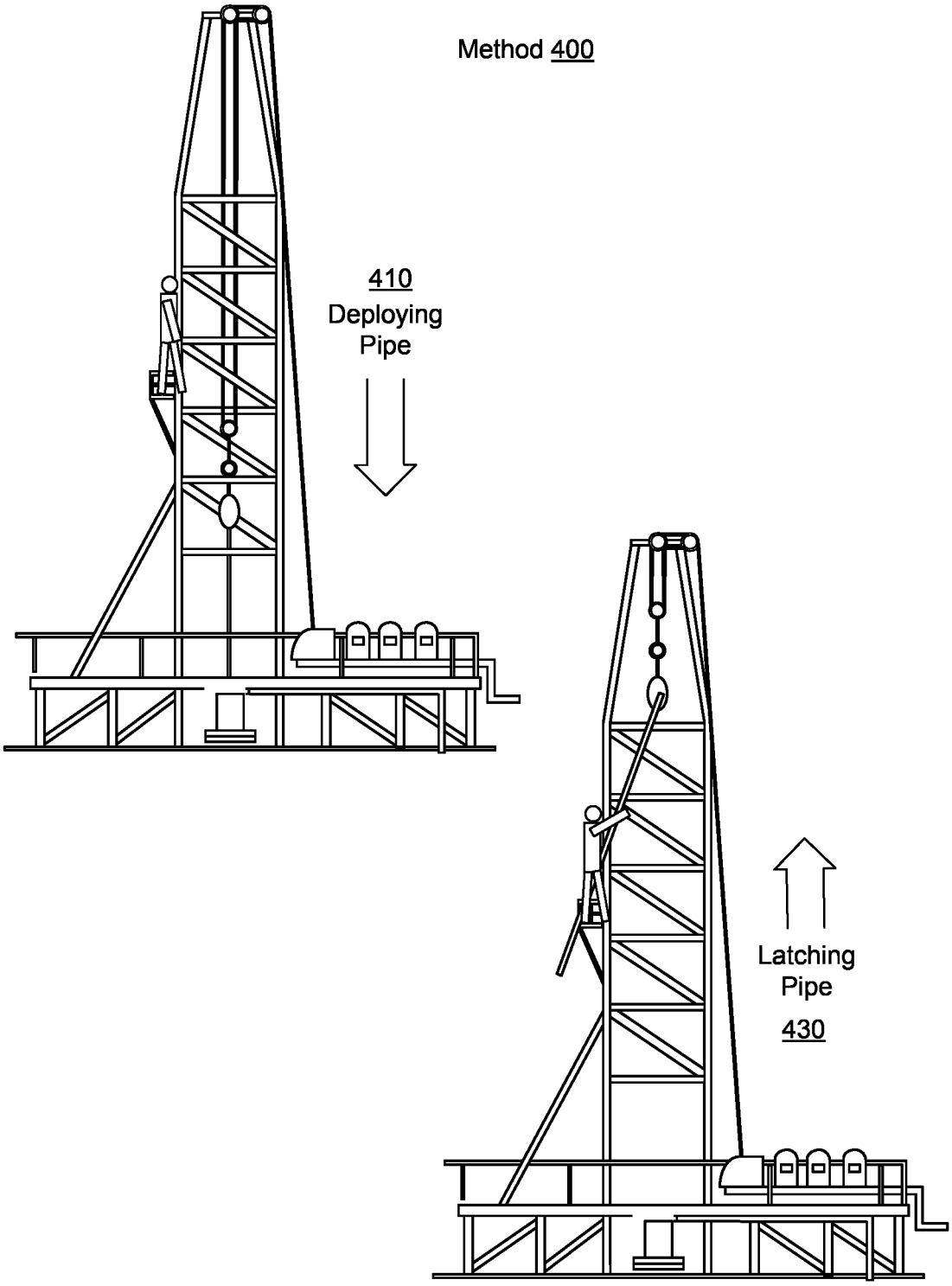
FIG. 4 illustrates an example of a method.

FIG. 4 shows an example of a method 400 that includes deploying pipe 410 and latching pipe 430. As shown, deploying pipe 410 involves moving a traveling block downward while latching pipe 430 involves moving a traveling block upward. As to when pipe latching occurs, it may occur while the traveling block is moving upwards.

Figure 5:
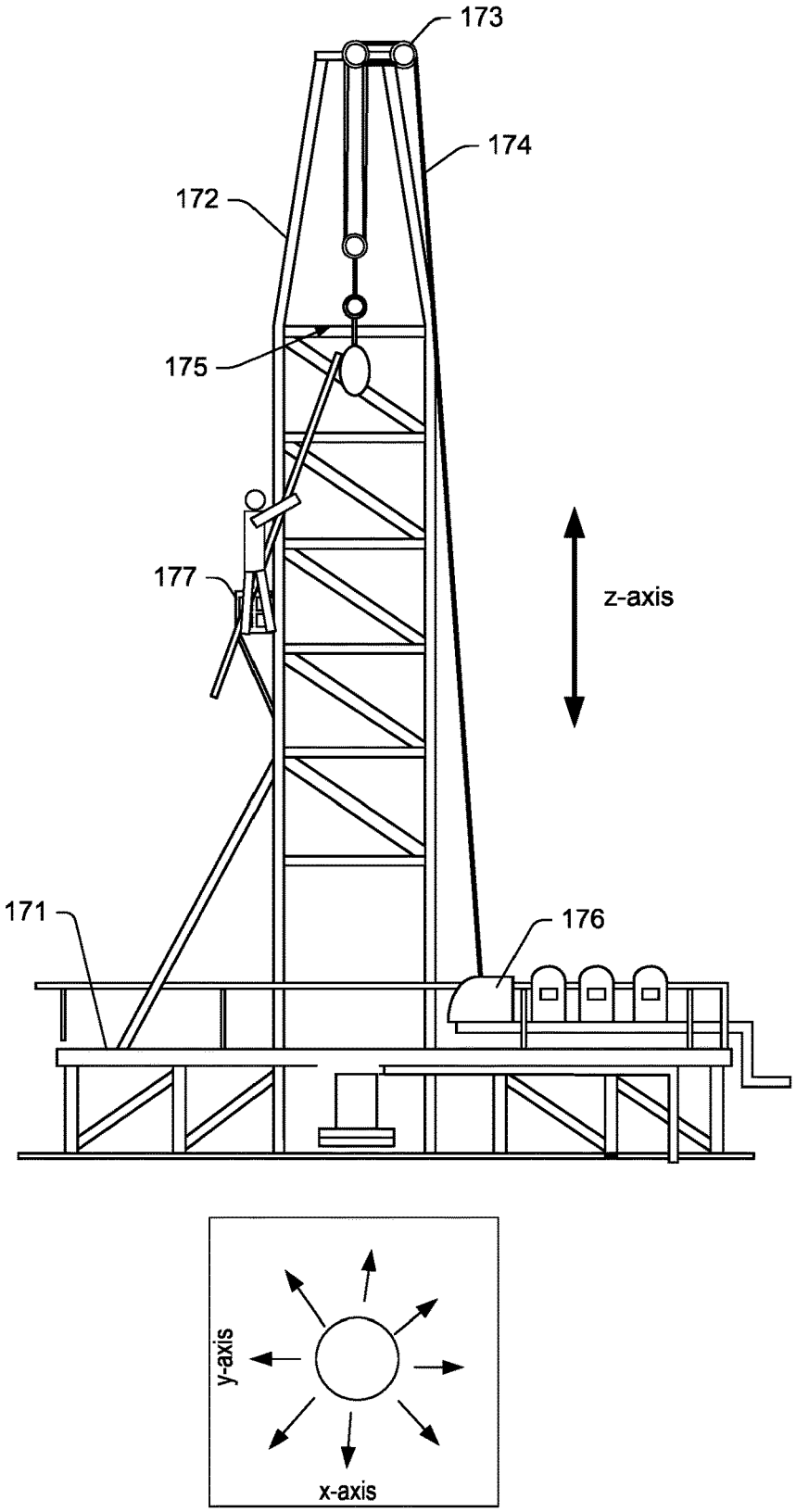
FIG. 5 illustrates an example of a system with a coordinate system.

FIG. 5 shows a portion of the equipment 170 of FIG. 1 with respect to a z-axis and an x,y-plane, defined by an x-axis and a y-axis. As an example, a cylindrical or other coordinate system may be used. As shown in FIG. 5, the traveling block assembly 175 can move in various directions; noting that various operations are effectuated via movement along the z-axis.

Figure 6:
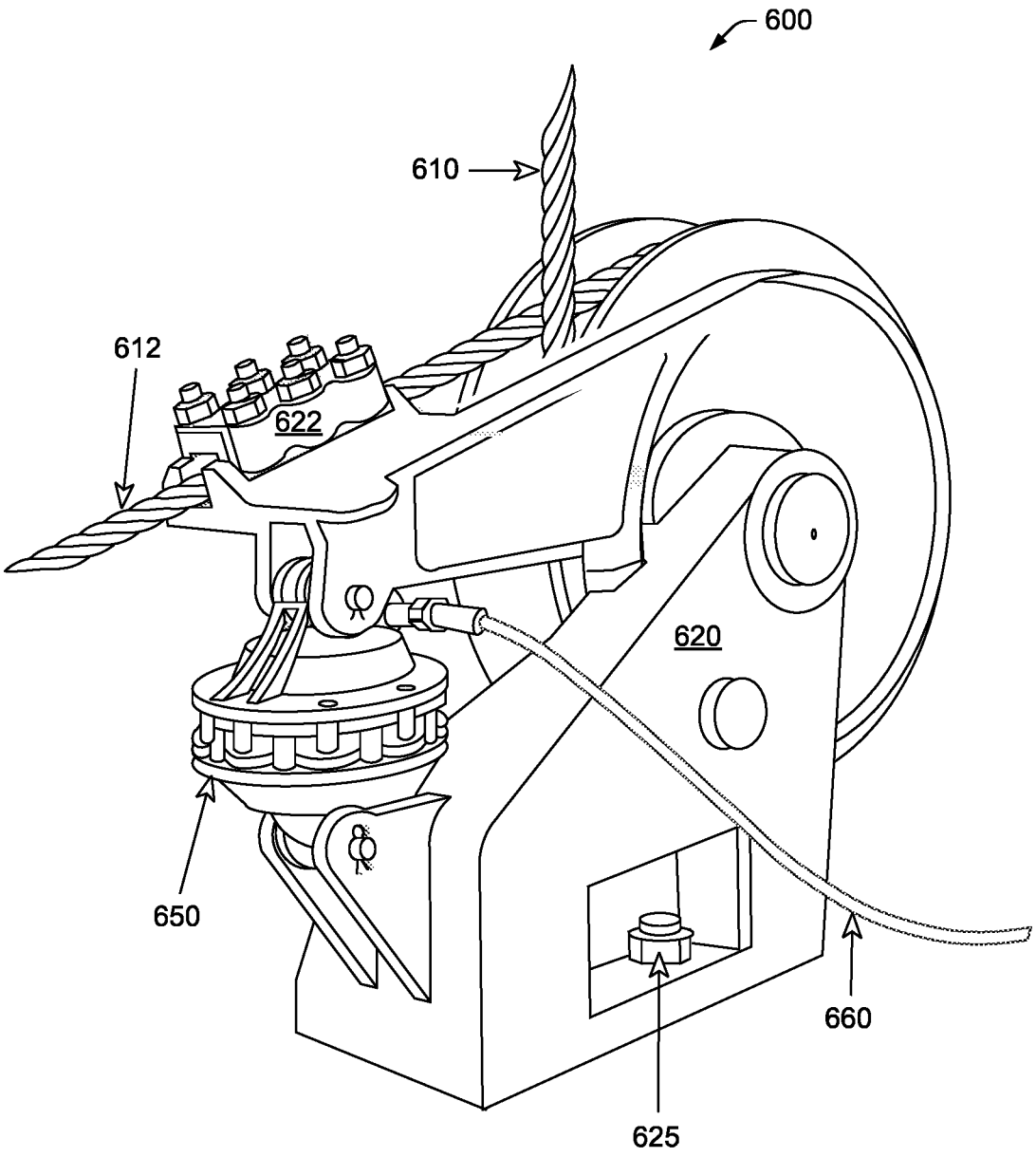
FIG. 6 illustrates an example of equipment.

FIG. 6 shows an example of a drawworks assembly 600 that can be operatively coupled to line where the line includes a so-called deadline 610 and a supply reel line 612 operatively coupled to a body 620. In the example of FIG. 6, a deadline tie-down anchor 622 of the body 620 firmly grips one end of the drilling line and keeps it from moving; noting that the body 620 itself is anchored, for example, via an anchoring mechanism 625 (e.g., bolted to a rig's substructure or to another heavy, stationary part of the rig).

Besides anchoring the drilling line, the assembly 600 can also serve as a mount for a weight indicator sensor such as a load sensor 650. Such a sensor may be operatively coupled to a hydraulic line that can output a weight indication to a gauge, etc. For example, a drilling console can include a gauge that indicates to an operator how much a traveling block load may be and, for example, how much weight is on a bit. As an example, a load may be referred to as a hookload, which indicates how much weight is hanging from a hook. As an example, weight on a bit may be how much drill stem weight is pressing on the bit.

As an example, the load sensor 650 may be a strain sensor (e.g., a strain gauge). As an example, as weight of a load on a deadline flexes the deadline, the load sensor can pick up the flexes and send a signal to the weight indicator gauge (e.g., on the rig floor, drilling console, etc.). The weight indicator may be configured to translate such a signal into weight on the bit and the hookload.

As an example, an assembly such as the assembly 600 of FIG. 6 can be used to estimate depth of equipment in a bore in a geologic environment. For example, depth of a drill bit may be of interest, depth of a tool may be of interest, etc. As an example, where a tool can acquire measurements in a bore, these may be recorded, plotted, analyzed, etc., with respect to depth. In such an example, the depth may be an estimate acquired at least in part via an assembly such as the assembly 600 of FIG. 6.

As an example, a "tape measure" approach may include measuring distance between pipe joints, for example, prior to insertion of the pipe into a bore. For example, consider a scheme where a driller keeps a tally of pipe measurements that is utilized to calculate an "official" depth of a well.

As mentioned, tools may be used to acquire information in a bore. For example, consider logging while drilling. In logging while drilling (LWD), an approach that can implement continuous tracking of depth may help to produce measurement registries that may be more accurate than those achieved via a joint-to-joint tracking scheme.

As an example, a depth tracking system based on a rotary encoder records movement of a travelling block in between joints to infer measurement of pipe length as it is lowered into or pulled out of the ground. Other measurements may be derived from a rotary encoder process. For example, it may be possible to track rate of penetration while drilling, or pipe speed when tripping (e.g., measurements that help provide for safe and efficient operations).

A so-called geolograph implements a rotary encoder where a sensor is based on a roll of steel line attached to structure of a derrick (e.g., near a crown block) and the other end attached directly to a travelling block. In the geolograph, line unwinds through a wheel of known circumference whose shaft is connected to a rotary encoder. The rotational movement is translated into pulses that can be tracked to compute block position from a given reference point.

The assembly 600 of FIG. 6 may be referred to as a drawworks encoder approach. A drawworks sensor can be easier and safer to install than a geolograph and utilize a more compact approach by installing the rotary encoder directly on a main shaft of a drill hoisting drum. Depending on length of cable wrapped onto a drawworks drum, to allow for a complete block travel on a derrick, it may wrap onto itself, for example, about 2 or 3 times. In such an approach, the effective diameter of the drum changes, and one revolution of the rotary encoder corresponds to different lengths of line spooling off the drum, hence different distances travelled by the block. Due to multi-wrapping, use of a drawworks encoder involves a relatively complicated calibration procedure, which is to be repeated each time the drill line is replaced due to wear. Further, to calibration, a block reference is often to be reset. Being mechanical in nature and being in-line with the main drawworks shaft means that operations are stopped to perform replacement.

As an example, a drawworks can include one or more rotary encoders (e.g., stacked on the rotational axis of the drawworks). As an example, multiple encoders may provide redundancy and for sharing signals with one or more other components, systems, etc. As an example, consider a two channel in quadrature electrical encoder with index and complements where a supply voltage may be in a range of approximately 5 V to 10 V (e.g., or more or less) with current draw of approximately 120 mA (e.g., or more or less) and a frequency response of 150 kHz (e.g., or more or less). Such an encoder can output data from one or more of the channels, which may be received by an interface operatively coupled to one or more processors.

Knowledge of depth can help inform an operator as to a well's actual location, how much casing to bring to a well site, where perforating may be performed, and log information (e.g., to answer a question as to whether a log shows an actual extent of a reservoir). Such concerns can exist where there are mismatches between a driller's tally, wireline depth, and while drilling depth.

Depth information can be a starting point for various operations. For example, depth information may be used to determine lengths and distances for purposes of budgeting materials, scheduling services, requesting permits, and determining construction times. Such factors can impact estimation of cost of a project. While operations are being executed, workers and supervisors may build according to a plan by using depth information-based metrics.

Life of a well, from a planning phase onward, can depend at least in part on depth information. Such information may be used to calculate well trajectory, materials, schedules, well sections and regulatory-related information. Depth information may be used for one or more correlation indexes (e.g., as to previous wells to estimate the zones of interest for economical and safety reasons). Depth references can be used to create a drill plan for a defined well trajectory. Depth information may be used to design one or more well sections, for example, so wellbore stability may be enhanced. Drilling fluids and conditioning chemicals can be estimated, casing quantities and cement volumes and proper equipment scheduled based at least in part on depth information.

Depth from multiple wells in an area may be used by one or more geologists and/or petro-physicists to feed complex models to define development plans and to assess feasibility of such plans.

A drilling process can include adverse conditions that impact the depth measurement. For example, drill pipe thermal expansion and drill pipe mechanical stretch can impact depth measurement. Also, consider phenomena such as pipe squat and sag effect, variable friction factors while rotating and sliding drilling, pressure effects, buoyancy force and offshore rig heave and tidal produced errors. From the drilling process itself setting and removal of slips and drill-off can also affect measurement. In a depth tracking system, as well as in a driller's tally, such error sources can exist. Further, the deeper the well, the more deviated the well, etc., the more prominent such errors may become.

A slip or slips can be a device (e.g., an assembly of components) used to grip a drill string in a relatively non-damaging manner and suspend it in a rotary table. A slip can include wedges that are hinged together, forming a near circle around a drill pipe. On a drill pipe side, replaceable, hardened tool steel teeth can be utilized that embed slightly into the side of the pipe. On an outer side, slips can be tapered to match the taper of a rotary table. As an example, after a rig crew places slips around a drill pipe and in the rotary, a driller can slowly lower the drill string. As the teeth on the inside of the slips grip the pipe, the slips are pulled down. This downward force pulls the outer wedges down, providing a compressive force inward on the drill pipe and effectively locking everything together. Then the rig crew can unscrew the upper portion of the drill string (e.g., kelly, saver sub, a joint or stand of pipe) while the lower part is suspended. After some other component is screwed onto the lower part of the drill string, a driller can raise the drill string to unlock the gripping action of the slips, and the rig crew can remove the slips from the rotary.

To add a length of drill pipe to a drill string to continue drilling. In what is called jointed pipe drilling, joints of drillpipe, each about 30 ft (e.g., about 9 m) long, can be screwed together as a well is drilled. When the bit on the bottom of the drill string has drilled down to where the kelly or top drive at the top of the drillstring nears the drill floor, the drill string between the two can be lengthened by adding a joint or a stand (e.g., consider three joints) to the drill string. Once the rig crew is ready, the driller stops the rotary, picks up off bottom to expose a threaded connection below the kelly and may turn the pumps off. The crew can set the slips to grip the drill string temporarily, unscrew the threaded connection and screw the kelly (e.g., or top drive) into the additional joint (or stand) of pipe. The driller picks that joint or stand up to allow the crew to screw the bottom of that pipe into the top of the temporarily hanging drill string. The driller then picks up the entire drill string to remove the slips, carefully lowers the drill string while starting the pumps (e.g., if stopped) and rotary, and resumes drilling when the bit touches bottom. A skilled rig crew may be able to physically accomplish such actions in about a minute or two.

As an example, a local positioning system can help to reduce pipe strapping errors. Such an approach may enhance wireline logs. As an example, a method can include acquiring wireline depth information, which may account for cable stretching, tension regime and thermal factors. As an example, a method may include correlating local positioning system information and wireline depth information. As an example, a method can include associating wireline tool data (e.g., as to wireline tool measurements) with one or more of local positioning system information and wireline depth information. As an example, local positioning system information may be utilized to adjust wireline depth information or other depth information (e.g., measured depth, etc.).

As an example, a local positioning system may be utilized to determine position of a block (e.g., as the block moves up and/or down to determine one or more of its position, speed, acceleration, etc.). As an example, depending on local positioning system capabilities, pendulum movements may be determined (e.g., frequency, etc.), which may be driven by mechanical drivers, weather, etc. As an example, position and/or speed may be determined in a manner that does not depend on an initial position of a block. As an example, a method may include powering off a mechanism and powering on a mechanism to move a traveling block where a local positioning system may be implemented in a manner that does not include calibration, recalibration, etc.

As an example, a local positioning system can provide for indirect drill bit depth measurement. As an example, a local positioning system may be implemented at least in part at a level below a rig structure, for example, in a system for offshore operation. Such an approach may help to reduce effect of heave and tide. For example, a local positioning system fit to an offshore rig may be located in a manner that reduces impact of heave and/or tide. As an example, using an array of transceivers, movement of a platform with reference to a riser and waves can be tracked and fed into a compensation algorithm that can calculate accurate depth and tracking.

Figure 7:
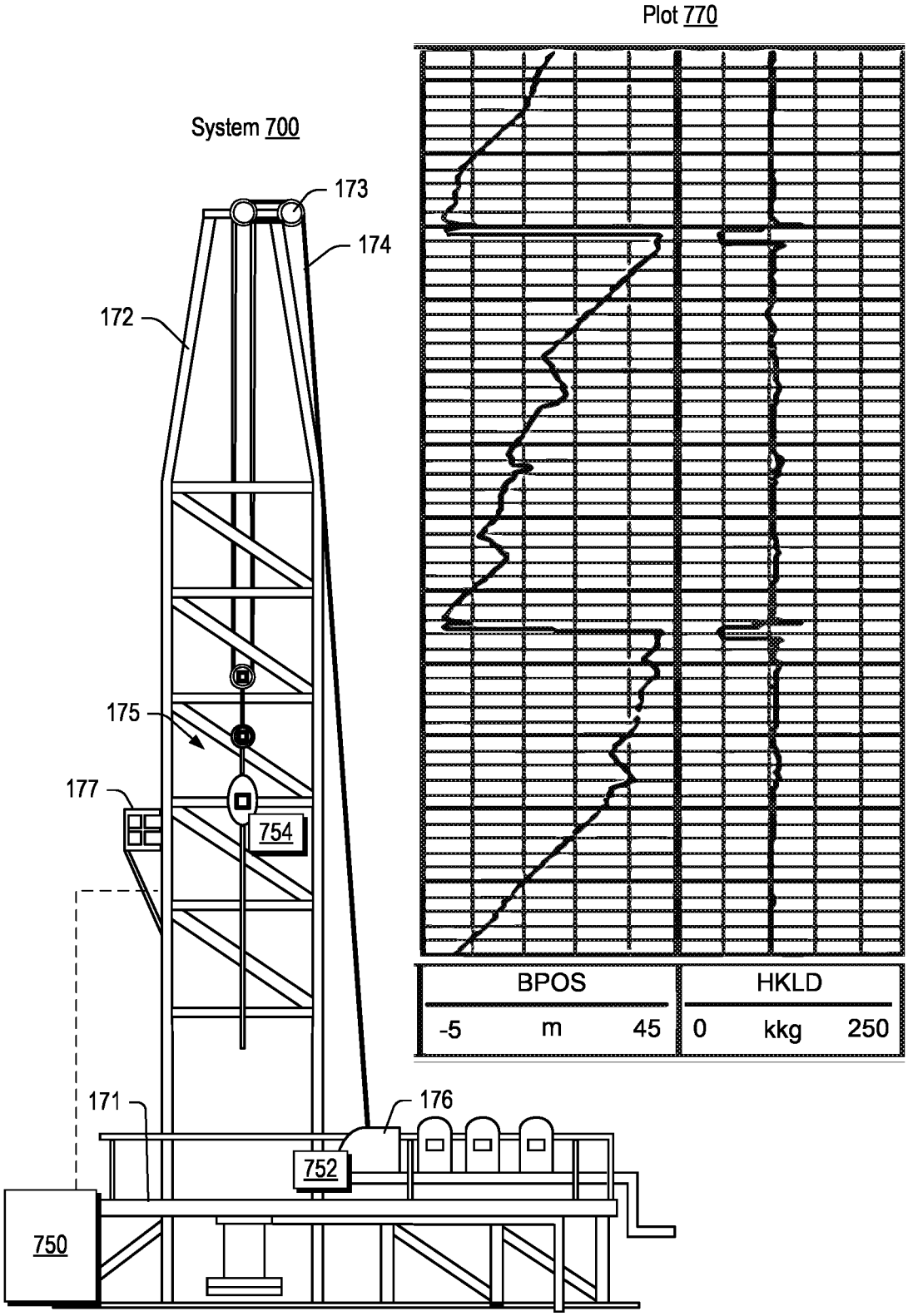
FIG. 7 illustrates an example of a system and an example data plot.

FIG. 7 shows an example of a system 700 that includes one or more data acquisition systems, which can be a computing system with one or more interfaces 750. As shown, such a computing system may be part of or operatively coupled to various equipment, such as, for example, a drawworks computing system 752 and/or a top drive computing system 754. As an example, a data acquisition system may provide for acquiring position and/or load information, for example, as shown in an example plot 770 of FIG. 7 where BPOS is the block position, which can be seen to move in a range from about −5 meters to about 45 meters and where HKLD is the hookload. Both BPOS and HKLD are shown with respect to depth (vertical axis), which may be time stamped.

As an example, data as to block position and/or data as to hookload may be utilized to estimate depth. In such an example, portions of block position data may be associated with pipe length and, where pipe length is measured and tallied, the portions of block position data may be utilized to characterize uncertainty in a pipe length based estimate of depth (e.g., measured depth). As an example, portions of hookload data may allow for determining forces experienced by pipe in a wellbore, which may be utilized to characterize uncertainty in a pipe length based estimate of depth (e.g., measured depth). For example, where pipe stretches with respect to weight and time, hookload data may be utilized to determine an expected amount of stretching per pipe segment, a minimum amount of stretching per pipe segment, a maximum amount of stretching per pipe segment, etc. In combination, block position data and load data (e.g., hookload data) can help to estimate depth and/or characterize uncertainty in one or more depth estimates, which may be based in part on known pipe lengths, measured pipe lengths, etc.

As an example, block position data and/or hookload data may be utilized to determine operational times and/or non-operational times. For example, non-productive time can be a non-operational type of time. Where a block is stationary with respect to time (e.g., over an increment of time that exceeds a predetermined increment of acceptable non-movement), a wellsite may be in a non-productive mode. In such an example, hookload data may be analyzed to determine whether such data is changing or stationary. As an example, an analysis of one or more types of data may occur in response to data indicative of a stationary block. As an example, a stationary block may be an event as determined by a computing system. In such an example, the event may be characterized with an amount of certainty or uncertainty and, for example, one or more notifications issued based at least in part on occurrence of the event and optionally based at least in part on certainty of the event and/or uncertainty of the event.

Figure 8:
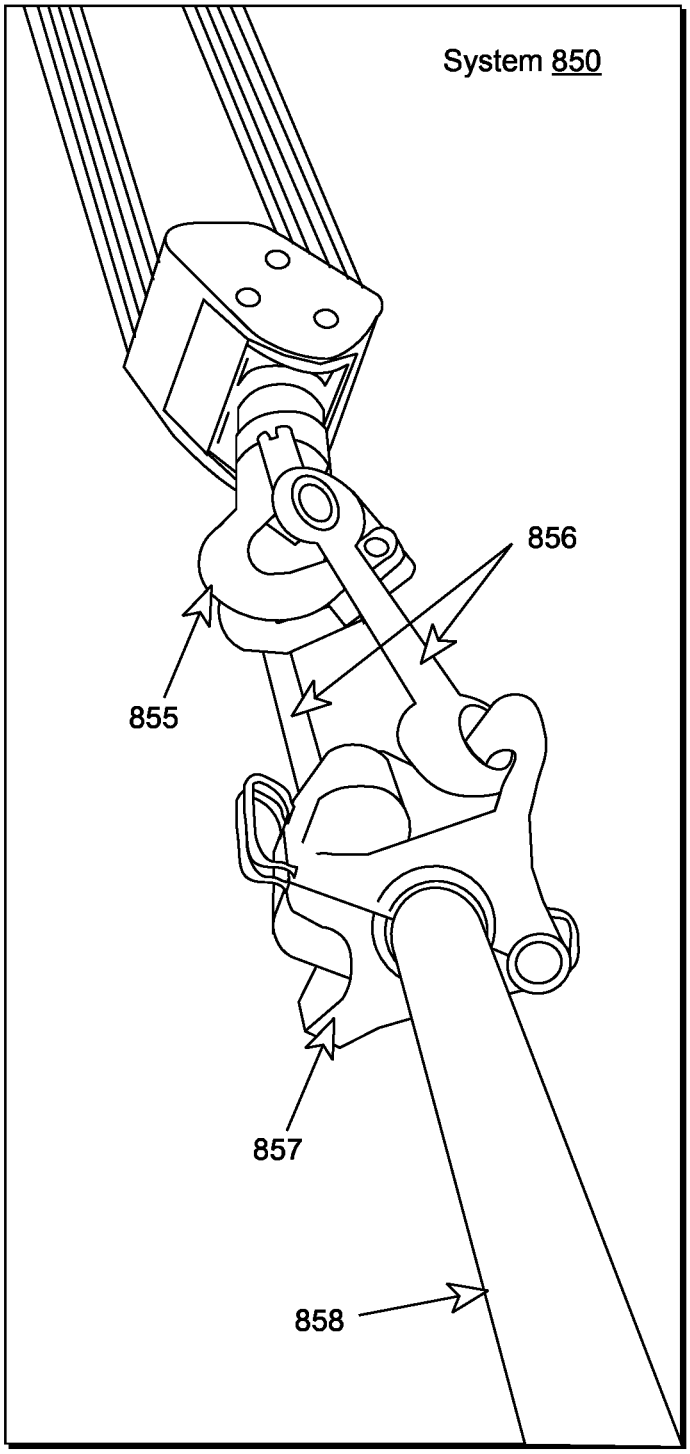
FIG. 8 illustrates examples of systems for handling equipment.
Figure 8:
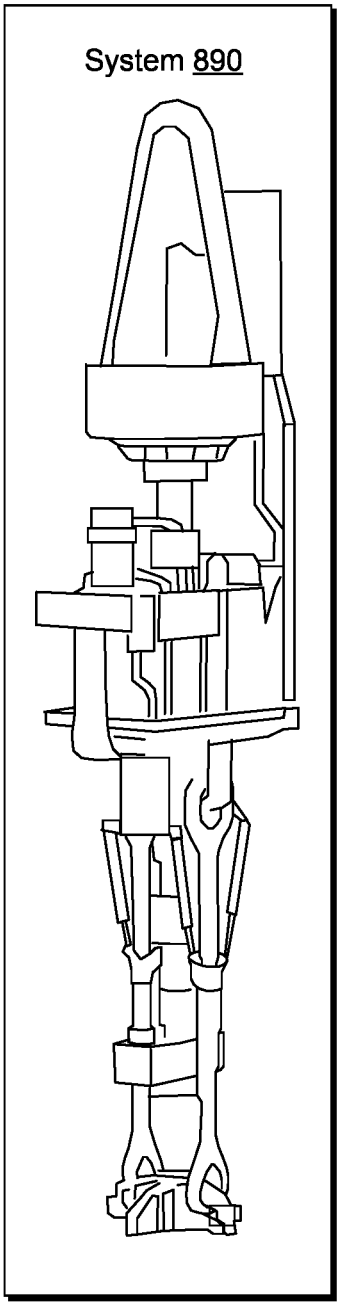

FIG. 8 shows an example of a system 850 that includes a traveling block 854, a hook 855, bails 856 and an elevator 857 that can latch a pipe 858. FIG. 8 also shows a system 890 that includes various components such as a rotary drive, bails and an elevator. As mentioned with respect to FIG. 7, a computing system may be part of equipment, for example, consider a computing system embedded in the system 890, which may be a top drive system.

As an example, an elevator may be a hinged mechanism that may be closed around drillpipe or other drillstring components to facilitate lowering them into a bore or lifting them out of a bore. In a closed position, arms of an elevator may be latched together to form a load-bearing ring around a component (e.g., pipe, etc.). A shoulder or taper on the component to be lifted may be larger in size than the inside diameter of an opening of a closed elevator. In an open position, an elevator may "split" into portions and, for example, may be swung away from a component.

As an example, a hook may be a J-shaped piece of equipment that can be used to hang various other equipment. As an example, a hook may hang a swivel and kelly, elevator bails or a top drive unit. A hook may be attached to a traveling block and provide a way to pick up heavy loads with the traveling block. A hook may be locked or free to rotate, for example, so that it may be mated or decoupled with items positioned around the rig floor.

As an example, a system may include a top drive (e.g., or top drive). A top drive can turn a string, for example, via one or more motors (e.g., electric, hydraulic, etc.). As an example, a top drive can include gearing that can be coupled to a short section of pipe called a quill, which, in turn, may be screwed into a saver sub or a string. As an example, a top drive may be suspended from a hook. In such an example, the rotary mechanism can travel up and down a derrick or a mast. A top drive arrangement may be used with or without a rotary table and kelly for turning a string (e.g., a drill-string).

Figure 9:
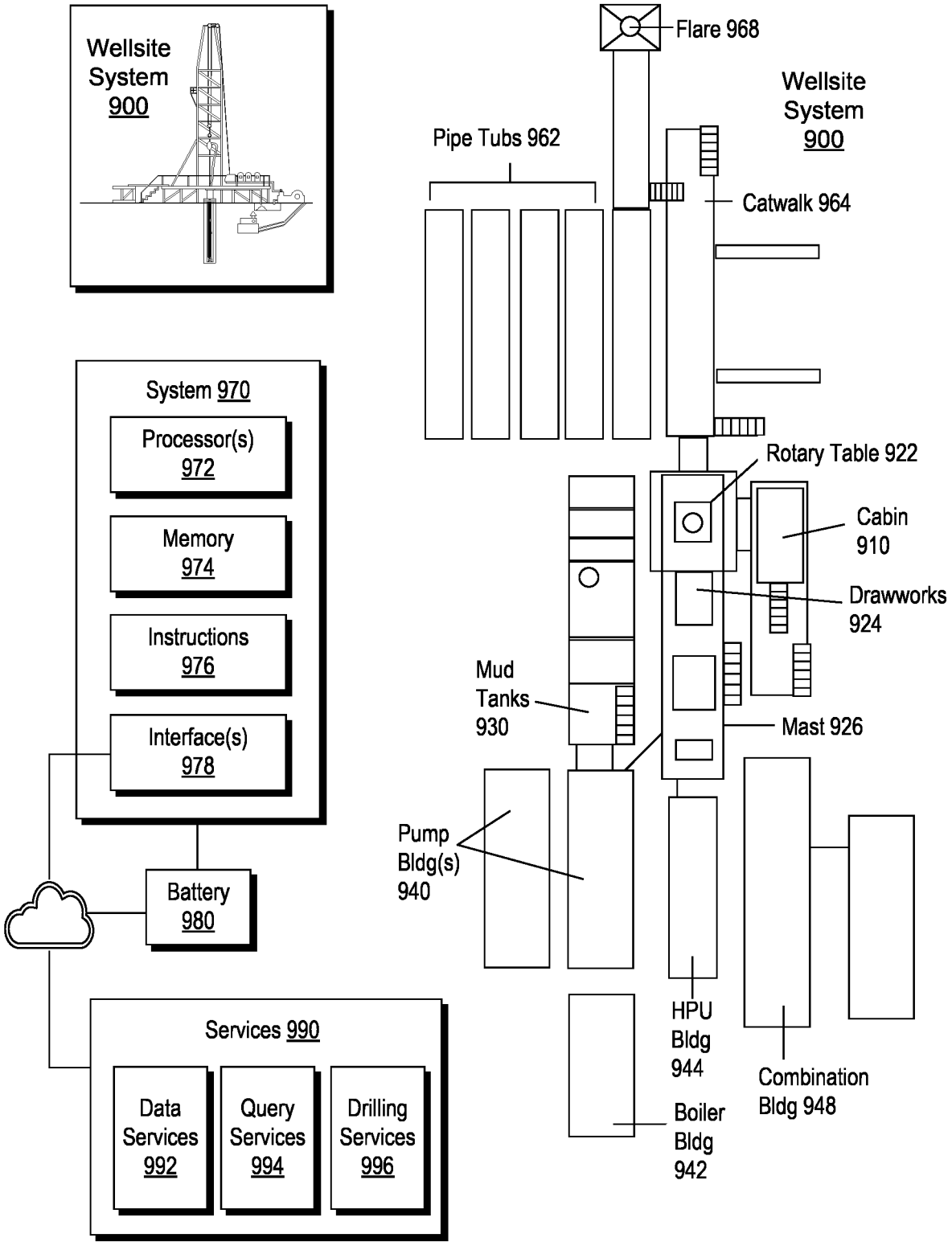
FIG. 9 illustrates examples of equipment and an example of a computing system.

FIG. 9 shows an example of a wellsite system 900, specifically, FIG. 9 shows the wellsite system 900 in an approximate side view and an approximate plan view along with a block diagram of a system 970.

In the example of FIG. 9, the wellsite system 900 can include a cabin 910, a rotary table 922, drawworks 924, a mast 926 (e.g., optionally carrying a top drive, etc.), mud tanks 930 (e.g., with one or more pumps, one or more shakers, etc.), one or more pump buildings 940, a boiler building 942, an HPU building 944 (e.g., with a rig fuel tank, etc.), a combination building 948 (e.g., with one or more generators, etc.), pipe tubs 962, a catwalk 964, a flare 968, etc. Such equipment can include one or more associated functions and/or one or more associated operational risks, which may be risks as to time, resources, and/or humans.

As shown in the example of FIG. 9, the wellsite system 900 can include a system 970 that includes one or more processors 972, memory 974 operatively coupled to at least one of the one or more processors 972, instructions 976 that can be, for example, stored in the memory 974, and one or more interfaces 978. As an example, the system 970 can include one or more processor-readable media that include processor-executable instructions executable by at least one of the one or more processors 972 to cause the system 970 to control one or more aspects of the wellsite system 900. In such an example, the memory 974 can be or include the one or more processor-readable media where the processor-executable instructions can be or include instructions. As an example, a processor-readable medium can be a computer-readable storage medium that is not a signal and that is not a carrier wave.

FIG. 9 also shows a battery 980 that may be operatively coupled to the system 970, for example, to power the system 970. As an example, the battery 980 may be a back-up battery that operates when another power supply is unavailable for powering the system 970. As an example, the battery 980 may be operatively coupled to a network, which may be a cloud network. As an example, the battery 980 can include smart battery circuitry and may be operatively coupled to one or more pieces of equipment via a SMBus or other type of bus.

In the example of FIG. 9, services 990 are shown as being available, for example, via a cloud platform. Such services can include data services 992, query services 994 and drilling services 996.

As an example, information sensed by drawworks equipment such as the drawworks assembly 600 of FIG. 6 may be utilized to determine an estimated depth and/or to adjust an estimated depth. For example, weight sensed via the load sensor 650 may be utilized to adjust a stretching parameter associated with one or more types of string segments that are disposed downhole and/or an encoder may be utilized to estimate and/or adjust a depth where the encoder can acquire data as to length of wire, deployed, wound, etc.

As an example, information sensed by rig equipment such as the system 700 of FIG. 7 may be utilized to determine and/or adjust an estimated depth. For example, block position (BPOS) may be sensed and utilized to estimate depth and/or to adjust an estimate depth. While an encoder of drawworks is mentioned, one or more other techniques, technologies, etc., may be utilized to sense or otherwise measure block position (BPOS). For example, consider machine vision, accelerometer(s), gyroscopes, position sensors, etc.

As an example, various types of information may be combined to reduce uncertainty and/or to estimate uncertainty associated with an estimated depth. In such an example, an operator may be able to view such types of information and adjust and/or comment thereon with respect to one or more drilling operations.

Figure 10:
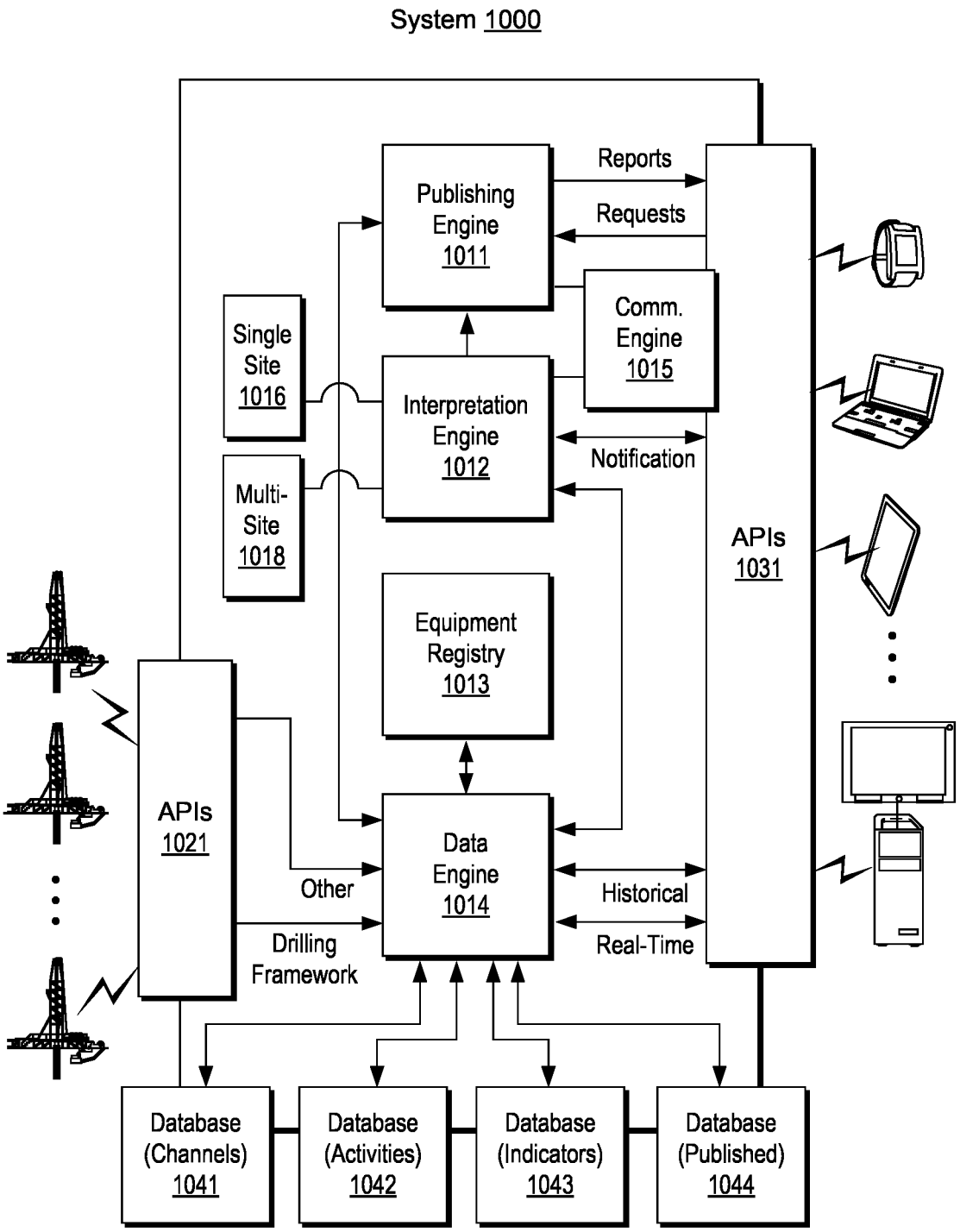
FIG. 10 illustrates an example of a system.

FIG. 10 shows an example of a system 1000 that includes a publishing engine 1011, an interpretation engine 1012, an equipment registry 1013, a data engine 1014 and a communication engine 1015 as well as application programming interfaces 1021 and 1031 and operatively coupled databases 1041, 1042, 1043 and 1044.

In the example of FIG. 10, the components 1011, 1012, 1013, 1014 and 1015 can be hosted by a cloud computing platform, which may also host at least a portion of the system 800 of FIG. 8 and/or at least a portion of the system 900 of FIG. 9. As an example, the equipment registry 1013 can be a registry associated with an equipment provisioning framework that may operate, for example, via resources provided in a cloud computing platform. As an example, the equipment registry 1013 can be rig site specific where each rig site includes a dedicated equipment registry. As an example, the system 1000 may include a plurality of equipment registries for a plurality of rig sites.

In the example of FIG. 10, the data engine 1014 may correspond to and/or be operatively coupled to one or more features of the wellsite system 700 of FIG. 7 (e.g., the computing system 750, equipment of the wellsite system, etc.). As shown in the example of FIG. 10, the data engine 1014 can be operatively coupled to one or more of the APIs 1021 and to the equipment registry 1013 (e.g., or registries). As shown, the data engine 1014 can be operatively coupled to the databases 1041 to 1444. Further, the data engine 1014 can be operatively coupled to the publishing engine 1011 and the interpretation engine 1012 as well as, for example, one or more of the APIs 1031.

In the example of FIG. 10, various components may be in a trusted or secure zone where, for example, the APIs 1021 and/or the APIs 1031 provide predefined calls and responses for components in the trusted or secure zone. As an example, the APIs 1031 can expose functionality of one or more components in the trusted or secure zone. For example, a computing device with a browser application may issue an API call to the system 1000 where the system 1000 responds to the API call with information transmitted to the computing device that can be rendered to a display via the browser application. In such an example, the computing device may be prohibited from accessing functionality of components in a trusted or secure zone where such functionality is not exposed via an API defined call.

As an example, the APIs 1021 can be utilized by rig site equipment, for example, for purposes of provisioning, data transmission, control commands, etc. As an example, the APIs 1021 can provide for handshakes between rig site equipment and one or more components of the system 1000 where information may be transmitted before, during or after a handshake.

As an example, the system 1000 can receive drilling framework information from one or more rig sites (e.g., via a system as in FIG. 7) and/or other information from one or more rig sites.

As an example, the interpretation engine 1012 can issue one or more notifications, which may be based on one or more events. For example, the interpretation engine 1012 can receive information, determine an event and issue a notification for that event. As an example, a notification of the interpretation engine 1012 can be issued to one or more destination addresses, for example, according to the communication engine 1015, which may operating according to information in a communication matrix.

As shown in the example of FIG. 10, the interpretation engine 1012 can be implemented for a single site 1016 and/or for multiple sites 1018. For example, the interpretation engine 1012 can include algorithms for handling single site information and algorithms for handling multiple site information. As an example, where the system 1000 receives information for a plurality of well plans the plurality of well plans may be analyzed individually and/or collectively. As an example, a well plan can be a digital well plan for an individual well to be drilled and/or completed and/or a well plan can be a digital master well plan for a plurality of wells to be drilled and/or completed. As an example, a digital master well plan can include information as to equipment and/or other resources (e.g., human resources, power, water, mud, etc.) that may be utilized at a plurality of sites. In such an example, an event that occurs at one site may possibly impact one or more other sites.

As an example, a method can include generating reports using a system such as, for example, the system 1000. As shown in the example of FIG. 10, the publishing engine 1011 may respond to requests received as API calls by generating and issuing one or more reports.

As shown in FIG. 10, the system 1000 can include features for acquiring information about a rig, which can be state information. As an example, a system may operate automatically to determine a state or states based at least in part on information received by the system, which can include information acquired via one or more sensors, one or more devices with input mechanisms for user input, etc. As an example, a report may be generated based at least in part on a state or states (e.g., based at least in part on state information). As an example, a report may be triggered based on a push system and/or a pull system. For example, an oilfield operator may query a system to determine one or more states of the system (e.g., where a state can be a system state, a subsystem state, etc.). As an example, a report may be triggered based on state information, time, or another type of trigger.

As an example, the system 1000 can include receiving data associated with one or more drilling operations, analyzing at least a portion of the data and identifying one or more events and classifying the events. For example, the interpretation engine 1012 can include interpreting information to identify one or more events and to classify the one or more events. In such an example, an event may be classified as being associated with a particular type of performance (e.g., drilling, formation, equipment, etc.) and, for example, may be classified as being a "good" event or a "bad" event, optionally along one or more axes. For example, an axis from bad to good may be utilized and, for example, an associated cost, which may range from negative to positive. Thus, an event may be classified as being good with a positive financial or other type of cost return on achievement of that event. Such an event may be desirable to achieve while drilling. As an example, another type of event may be classified as being bad with a low financial or other type of cost impact. In such an example, avoidance of such an event may be considered to be optional due to low impact on cost; whereas, for example, a bad event with a high financial or other type of cost impact may be assessed for avoidance. Such an assessment may impact a drilling plan, etc., for one or more wells, which are being drilled, being planned to be drilled, etc.

As an example, the interpretation engine 1012 can be or include an inference engine. As an example, an inference engine can use logic represented as IF-THEN rules. For example, consider a format of such rules as IF <logical expression> THEN <logical expression>. IF-THEN statements (e.g., Modus Ponens) can represent various types of logic including, for example, human psychology as humans can utilize IF-THEN types of representations of knowledge. As an example, an inference engine may implement inductive algorithms that can predict a next state (e.g., next event, worsening of an event, improvement of an event, etc.) based upon a given series of information. As an example, an inductive framework can combine algorithmic information theory with a Bayesian framework.

As an example, the interpretation engine 1012 can be part of a knowledge base, learning and evaluation block of a system. In such an example, the interpretation engine 1012 may receive information from a knowledge base (e.g., one or more sources of information), may learn by training one or more algorithms (e.g., including retraining one or more algorithms), and may evaluate information based at least in part on one or more trained algorithms. As an example, an "expert" may review information output by an interpretation engine where the expert may approve, disapprove, modify, comment, etc. as to such output. In such an example, a mechanism may capture the expert feedback and utilize at least a portion of the feedback for purposes of training the interpretation engine.

As an example, an expert station may be a computing system that is operatively coupled to an interpretation engine that can intervene in operation of the interpretation engine. For example, where output is deemed lacking, input may be received via an expert station to comment on such output, to halt transmission of such output, to cause reinterpretation of information to generate new output, etc.

As an example, a system can be a drilling event analysis system, which can include an analysis engine, which may be a machine learning engine (e.g., Bayesian, etc.). As an example, consider the APACHE STORM engine (Apache Software Foundation, Forest Hill, Md.).

The APACHE STORM engine can be implemented as a distributed real-time computation system. Such a system can receive and process unbounded streams of data. Such a system may provide for real-time analytics, online machine learning, continuous computation, distributed RPC, ETL, etc. Such a system may integrate with one or more queueing and database technologies. As an example, a topology may be constructed that consumes streams of data and processes those streams in one or more manners, optionally repartitioning streams between each stage of computation. As an example, a topology can be constructed as a graph of computation where, for example, a node in a topology includes processing logic, and links between nodes indicate how data may be passed around between nodes.

As an example, data may be available in the WITSML standard (Wellsite Information Transfer Standard Markup Language, Energistics, Sugar Land, Tex.) developed as part of an industry initiative to interfaces for technology and applications (e.g., to monitor wells, manage wells, drilling, fracturing, completions, workovers, etc.). For example, a machine learning system can receive data organized in the WITSML standard where such data may pertain to one or more of drilling, completions, interventions data exchange, etc. As an example, a system may be operatively coupled to resources associated with one or more entities (e.g., energy companies, service companies, drilling contractors, application vendors, regulatory agencies, etc.). While WITSML is mentioned, one or more other types of data schemes may be utilized.

As an example, a machine learning system may receive data and automate identification and collection of drilling events. As an example, a machine learning system can include identification and classification of events. As an example, such an approach may be utilized to assign a probability of an event occurring for a scenario or scenarios. For example, a type of event may be associated with drilled wells and information for a "to be drilled well" (e.g., a scenario) may be input where output can assign a probability of that event occurring during drilling of the "to be drilled well". Such output may be associated with a trajectory distance, optionally a depth.

As an example, a well planning platform may be operatively coupled to a machine learning system such that during well planning, events and probabilities of their occurrence may be indicated. During well planning, the platform may issue notices and/or suggestions as to one or more parameters that can be utilized to reduce occurrence of such an event during drilling and/or increase occurrence of such an event during drilling, which may be based on a cost assessment (e.g., for good and bad types of events and associated costs, which may be cost estimates as to time, resources, etc.).

As an example, machine learning may occur based on one or more types of input. As an example, input may be via one or more mechanisms. For example, information may be generated with respect to planning and may be included in a digital well plan or digital well plans. As an example, where a system includes a master review component (e.g., an expert station), such a component may input information that can assist in learning. As an example, one or more users at one or more computing devices may interact with one or more GUIs that can capture information that may be utilized for learning (e.g., training one or more artificial intelligence algorithms, engines, etc.).

As an example, a machine learning system may be operatively coupled to a well planning platform where the machine learning system includes a network or nodes and associated logic, for example, series logic statements. As an example, logical statements may make up an algorithm that can search one or more databases where, for example, the algorithm may identify content that meets one or more criteria for risk. As an example, such risk may include risk as specified via one or more WITSML criteria.

As an example, a risk may be associated with time for making up a bottom hole assembly (BHA). In such an example, logic may identify what is the average time for a rig or the field, and then compare BHA make-up events to that average time.

As an example, a machine learning system may implement an algorithm that applies to a real-time data stream, for example, as received from a rig at a wellsite (e.g., from computerized equipment, etc. at a wellsite). In such an example, a series of logic statements may be utilized where streaming data channels from the rig are analyzed to identify and/or classify one or more events that occurred or that may have occurred. In such an example, an event may have occurred, whether good or bad, where the event was noted by an operator; or, for example, an event may have occurred, whether good or bad, where the event was not noted by an operator. In such instances, a probability of that event may be assigned. Such an approach may optionally be utilized to identify noted events that may be false positives as well as noted events that were successfully noted (e.g., confirmation of the operator's judgement).

As an example, a method can include identifying one or more types of events by implementing a topology that includes a directed acyclic graph. For example, the APACHE STORM application can include utilization of a topology that includes a directed acyclic graph (DAG). A DAG can be a finite directed graph with no directed cycles that includes many vertices and edges, with each edge directed from one vertex to another, such that there is no way to start at any vertex v and follow a consistently-directed sequence of edges that eventually loops back to v again. As an example, a DAG can be a directed graph that includes a topological ordering, a sequence of vertices such that individual edges are directed from earlier to later in the sequence. As an example, a DAG may be used to model different kinds of information.

As an example, a method can include receiving data as receiving real-time data as acquired from wellsite equipment and/or as receiving data from at least one database.

As an example, a system may utilize information that is in a JSON (JavaScript Object Notation) data-interchange format. Such information can be machine parsable and generatable and can be based on a subset of the JavaScript Programming Language. As an example, JSON can be a text format that is language independent and that uses conventions in the C-family of languages (e.g., C, C++, C#, Java, JavaScript, Perl, Python, etc.).

As an example, information in JSON can include the following structures: a collection of name/value pairs (e.g., an object, record, struct, dictionary, hash table, keyed list, associative array, etc.); and an ordered list of values (e.g., an array, vector, list, sequence, etc.).

As an example, a communication matrix may be defined on a job-by-job basis. As an example, a communication matrix can be part of a digital well plan. As an example, a communication matrix may be complete as generated by a well planning framework or may be to be completed after receipt by a system such as the system 1000. As an example, a portion of information in the communication matrix may be included in a digital well plan.

As an example, the system 1000 may be implemented to reduce non-productive time (NPT) at one or more rig sites. As an example, an operator may be responsible for monitoring two or more rig sites. In such an example, the operator may have a functional bandwidth (e.g., a human bandwidth)

such that information can be transmitted from the system 1000 to a computing device of the operator, which may include a browser or other type of application that can render information to a display.

As mentioned, the interpretation engine 1012 can be a trained interpretation engine that can be trained using one or more experts. For example, an individual with 10 years or more of experience may be utilized to assess information and to determine courses of action in response to the assessment of the information. For example, the individual may be considered to be a trend-spotter where the individual identifies trends based on an assessment of the information. In such an example, the interpretation engine 1012 can "learn" (e.g., be trained) using those identified trends. In such an example, where received data can be assessed by the interpretation engine 1012 and matched to a scenario to which the interpretation engine 1012 has been trained, the interpretation engine 1012 can output a likelihood of what may occur and/or one or more actions that can mitigate or may mitigate an expected trend or trends.

As shown in the example of FIG. 10, the system 1000 can include components for issuing notifications, for issuing reports and for transmitting information such as, for example, historical information and/or real-time information.

As an example, where a load of an operator may be expected to be at or near a maximum (e.g., practical mental information handling load), the system 1400 can include one or more components that can effectuate load shedding that can direct notifications to one or more other destination addresses to shed load of the operator that may be at or near a maximum load.

As an example, the system 1000 can implement one or more queues where notifications can be ordered in the one or more queues. In such an example, the queues may be managed such that ordering can change over time prior to a notification in a queue or queues being issued (e.g., transmitted to one or more destination addresses). For example, an active queue may include one or more items (e.g., notifications) that can escalate and/or de-escalate prior to issuance. As an example, a filter scheme may be implemented as to one or more queues for one or more rig sites.

As an example, one criterion can be non-productive time (NPT) at a rig site. As an example, such a criterion may be linked to a phase of operations at a rig site. For example, a phase may be associated with time criticality that may be associated with expense, risk, and/or ability to reschedule. As an example, where a phase is operational as to a particular task that is difficult to reschedule (e.g., due to having to trip-out and trip-in, etc.), NPT may be weighted to make its impact more profound (e.g., higher priority).

As an example, time tracking can be implemented by the system 1000 of FIG. 10 to determine schedule time and/or to determine non-productive time (NPT); noting that these two types of times may be related. For example, NPT can lead to a likelihood of running beyond a schedule time. As an example, such times may be related to one or more rig sites. For example, consider equipment being used at one rig site that is planned to be used at a different rig site or rig sites. In such an example, an event that occurs at one rig site can impact implementation of a digital well plan at one or more other rig sites. As an example, where an operator is responsible for a plurality of rig sites, a master schedule for the plurality of rig sites may be affected by occurrence of an event at one of the rig sites. As an example, an interpretation engine may operate at an individual rig site level and at a master level for a plurality of rig sites. In such an example, the interpretation engine may be trained to identify trends as to one or more events at individual rig sites that can impact one or more operations occurring or to occur at one or more other rig sites. In such an example, the interpretation engine may issue notifications to one or more destination addresses in a manner to coordinate one or more actions to diminish impact on a master schedule, which may be defined at least in part by a digital master well plan for a plurality of wells to be drilled and/or completed at a plurality of sites.

As an example, the InterACT system (Schlumberger Ltd., Houston, Tex.) may be implemented as part of a system. As an example, the InterACT system may provide for rendering of information to one or more displays. As an example, the TECHLOG wellbore framework (Schlumberger Limited, Houston, Tex.) may be implemented as part of a system, which provides wellbore-centric, cross-domain workflows based on a data management layer. The TECHLOG wellbore framework includes features for petrophysics (core and log), geology, drilling, reservoir and production engineering, and geophysics.

As an example, the InterACT system may be implemented to provide for connectivity, collaboration, information handling, etc. Such a multifunction system may provide for collaboration to facilitate planning and implementation of downhole, desktop or other workflows. Such workflows may include one or more of a stimulation operation, a drilling operation, wireline logging, a testing operation, production monitoring, downhole monitoring, etc. (e.g., as workflow steps, workflow processes, workflow algorithms, etc.). Collaboration may occur between any of a variety of parties such as clients, partners, experts, etc. Processor-executable instructions may provide for a variety of graphical user interfaces (e.g., for devices such as desktop terminals or computers, tablets, mobile devices, smart phones, etc.).

As an example, a data exchange system may include one or more features of the aforementioned InterACT system. As an example, data may be exchanged between one layer and another layer using a markup language. An example of a markup language is the WITSML markup language. The use of WITSML data objects and the data access application programming interface (API) can allow for development of an application that may exchange data with one or more other applications, to combine multiple data sets from different entities (e.g., services, vendors, etc.), for example, into an application (e.g., for analysis, visualization, collaboration, etc.).

As an example, one or more industrial information technology platforms that may include Open Platform Communications Data Access (OPC DA) functionality, which can be used to connect to one or more sensors and/or pieces of equipment, for example, through Classic OPC and/or OPC Unified Architecture (UA) as well as one or more standards such as, for example, MODBUS, WITSML, etc. As an example, connections, whether wired and/or wireless, may provide for data acquisition and/or control, where such connections may be operatively coupled to a simulation system.

As an example, the system 1000 may be implemented in a manner that includes continuous improvement. For example, consider the interpretation engine 1012 as learning through training of one or more algorithms (e.g., inference algorithms, etc.) based on data received and feedback from one or more sources. In such an example, where the system 1000 is implemented for a field that includes a plurality of wellsites, as the wellsites are developed (e.g., wells drilled), the system 1000 can learn from some of the wellsites and improve operations at other wellsites in the field. In such an approach, the field may be developed in a manner whereby the last drilled well is drilled in less time than a first drilled well. For example, the last drilled well may be drilled with less non-productive time (NPT) and, for example, with less uncertainty as to one or more metrics (e.g., depth, etc.).

As an example, data such as block position data (e.g., BPOS), load data (e.g., HKLD, block weight, etc.), etc., may be received by the system 1000 for one or more of a plurality of wellsites in the real-time and analyzed using the interpretation engine 1012 to generate results, which can include a rate of penetration result for each of the plurality of wellsites. As an example, the interpretation engine 1012 may utilized various types of data and trained algorithms to reduce uncertainty and/or to characterize uncertainty as to rate of penetration for each of the plurality of wellsites. Where the wellsites are in a common field and drilling through layers that span the field, comparisons may be made from wellsite to wellsite. As an example, the interpretation engine 1012 can learn based on data from one of the wellsites by training one or more algorithms and utilize such one or more trained algorithms to analyze data from one or more of the other wellsites in the field. In such an example, non-productive time (NPT) may be reduced for one or more of the wellsites based on learning as to one or more of the other wellsites. In such an example, uncertainty as to one or more metrics may be reduce, for example, consider a reduction in uncertainty as to wellbore depth, weight on bit, rate of penetration (e.g., whether past, current or future), etc.

As an example, planned tripping speeds may be determined by a simulation utility such as, for example, the VIRTUAL HYDRAULICS simulation utility (VH utility). As an example, the system 1000 of FIG. 10 may include the VH utility. As an example, a system may be operatively coupled to one or more simulation frameworks. For example, the system 1000 may be operatively coupled to one or more simulation frameworks that can simulate physical phenomena (e.g., equipment operation, fluid mechanics, stress in a formation, etc.).

As an example, a drilling process can be broken down into various activities, for example, from top level activities (e.g. drilling, tripping, etc.) to lower level activities (e.g. inslip or in-slips (IS), outslip or out-of-slips (OOS), making connection, circulation, etc.). The detection of a drilling unit (e.g., a pipe, a stand, etc.), can facilitate recognizing and inferring drilling activities. For example, once a stand is detected, various statistics and performance indexes of drilling activities (e.g., KPIs) can be available to measure and improve drilling efficiency. Slip status can facilitate stand detection because the drill string is to be in-slips (IS) and make connection before drilling or tripping a stand. While referred to as a "slip status", such a status may be referred to as a "slips status" or "slips state", where slips are an assembly of components.

Slip status can be computed in a rig state computational framework. In such an example, a hookload threshold (e.g., HKLD Th) above a travelling block weight (e.g., BLK WT, as may be observed by a human) may be utilized. Such an approach can be suitable for estimates at relatively deep drilling depths; however, accuracy can be diminished as to slip status at shallow depths. Further, a manual hookload threshold involves human observation.

As an example, an automated system may operate without input based on human observation as to one or more hookload parameters. Such an automated system may provide for automation of slip/stand detection process in batch runs or in real-time (e.g., without operator observation input). As an example, a method can include processing information for slip/stand detection where such information can be or can include streaming data in real-time.

A method can include receiving data, analyzing the data and detecting slip status. Such a method may operate in real-time where one or more sensors acquire data and where such data is transmitted to a system (e.g., a computer, etc.). As mentioned, slip status can be utilized for stand detection during drilling and/or tripping. As an example, a system can provide for: inslip/outslip detection (IS/OOS); pipe changing detection; and stand begin/end detection (e.g., for drilling stands).

As to data that can be received by a system, such data may be in the form of channels. For example, consider one or more of the following channels: surface torque (STOR), which may be in one or more different types of units, which can include unitless, surface RPM (SRPM), standpipe pressure (SPPA), hookload (HKLD), weight on bit (WOB), bit depth (BDEP), hole depth (HDEP), rate of penetration (ROP), block height (BHT) (e.g., for certain cases, there may be no block height); etc. Note that two different depths are mentioned, which include bit depth (BDEP) and hole depth (HDEP). These depths can differ as a bit can be at an end of a drill string and hence move with the drill string while a bottom of a hole can be part of a geologic formation where rock has been crushed by a bit.

As to stand detection, inference results can include at least several of: drill stand start event (e.g., drilling of the stand started, on bottom drilling start); time and hole depth; drill stand complete event (e.g., drilling of the stand completed, ready to pull off bottom); time and hole depth; make connection start event (e.g., get in-slips); time and bit depth and hole depth; make connection complete event (e.g., get out-of-slips); time and bit depth and hole depth; tripping stand start event; time and bit depth; tripping stand complete event; time and bit depth; casing "stand" start event; time and bit depth; casing "stand" complete event; time and bit depth; etc.

Several drilling states can be defined. Note that one or more drilling actions (e.g. going in-slips or out-of-slips, making connections, etc.) can be observed during operations in the field, for example, via video (e.g., digital camera observation). One or more of such actions can be detected from analysis of streaming drilling data.

As to states, consider: inslip/outslip, where for inslip (IS), the slip device (e.g., slips) is placed around the drill pipe to hold the weight of drilling string as in a borehole and where for outslip (OOS), the slip device (e.g., slips) is lifted away such that equipment is "hanging"; rotary where surface rotation may be occurring (e.g., also consider a downhole motor, etc.); pipe changing, where pipe changing involves adding or removing drill pipe after drilling or tripping a stand; stand begin/end, where stand begin/end applies to drilling stands, not tripping stands, where stand begin corresponds to the first on bottom time/depth after pipe changing, and where stand end corresponds to the last off bottom time/depth before pipe changing.

Figure 11:
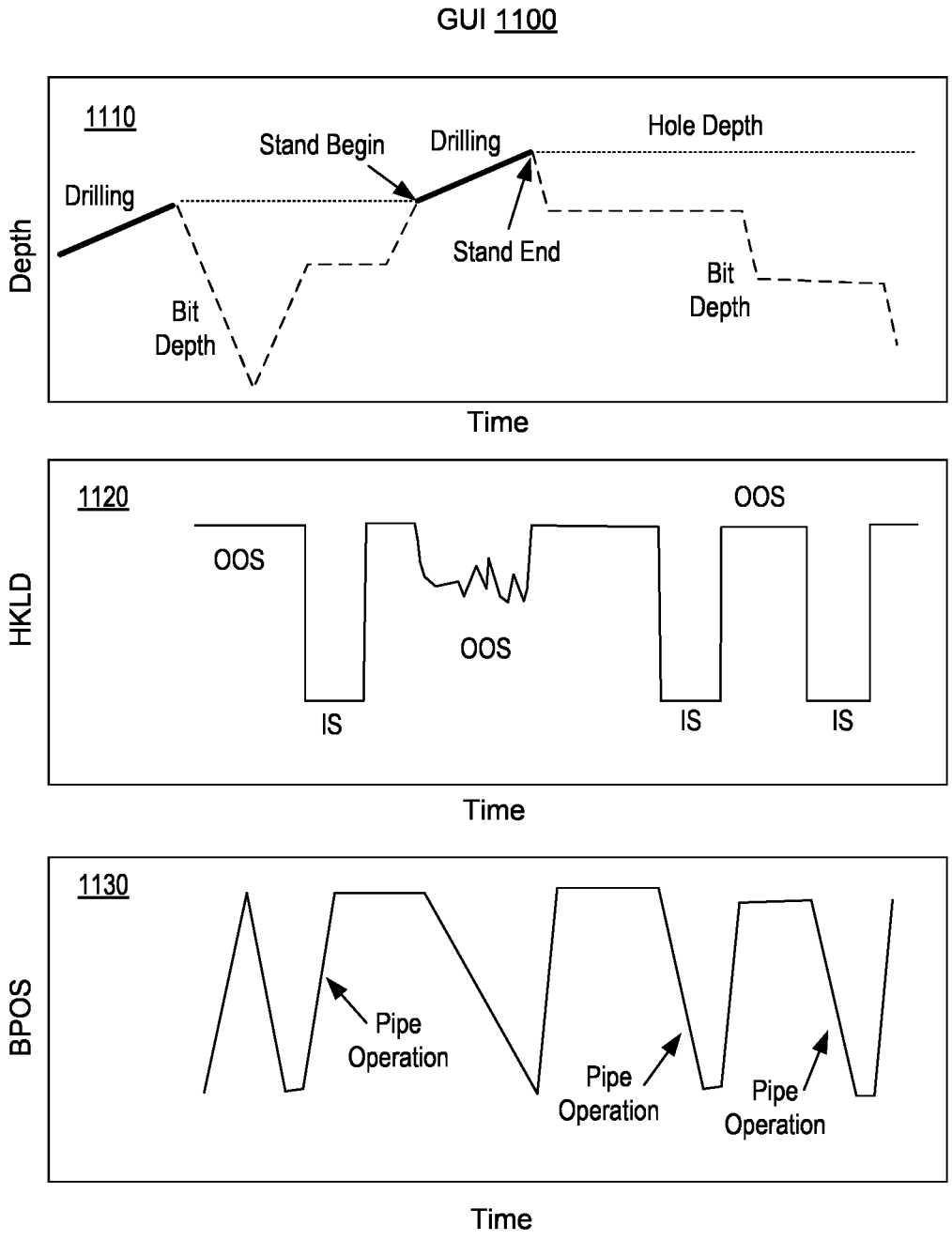
FIG. 11 illustrates an example of a graphical user interface.

FIG. 11 shows an example of a graphical user interface 1100 that includes various plots of data with respect to time 1110, 1120 and 1130 and various detected actions that can be utilized to define one or more states. For example, the plot 1110 shows depth versus time where hole depth (HDEP) is increasing by drilling and where bit depth (BDEP) is controlled via surface equipment, the plot 1120 shows hookload (HKLD) versus time where the weight changes depending on slip status (e.g., IS or OOS), and the plot 1130 shows block position (BPOS) versus time where the block position changes responsive to rig driven operations that include pipe-related operations (e.g., a pipe, a stand, etc.). As explained, drilling operations can include going into and out-of-slips where pipe is added (e.g., as a pipe or a stand) to allow a drill bit at an end of a drill string to drill deeper into the Earth.

A method can include analyzing data for purposes of slip detection and/or stand detection. In such an example, the method may couple or decouple slip detection and stand detection.

Figure 12:
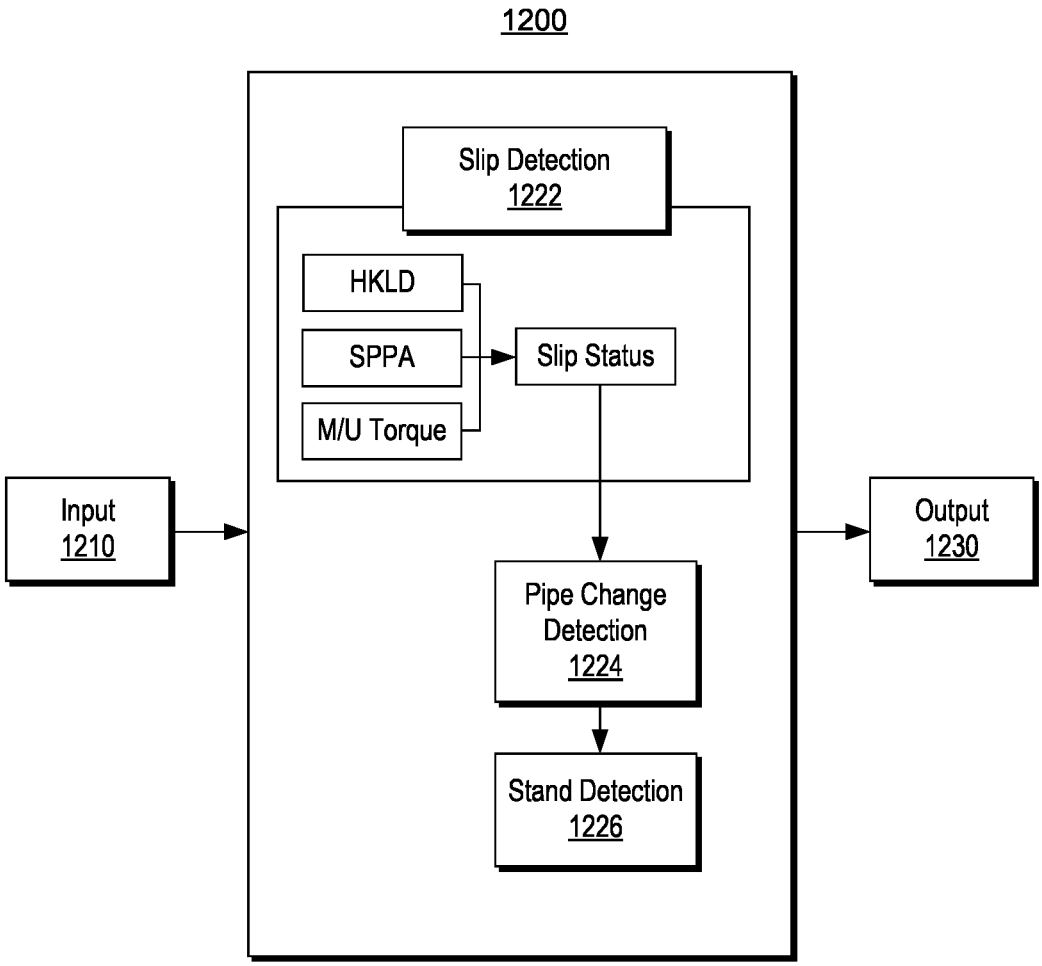
FIG. 12 illustrates an example of a system.

FIG. 12 shows an example of a system 1200 that can receive input 1210 and generate output 1230 via a slip detection component 1222, a pipe change detection component 1224 and a stand detection component 1226. The system 1200 can be part of rigsite equipment that can help control one or more rigsite operations.

As shown, the slip detection component 1222 can utilizes input such as data for HKLD, SPPA and make-up torque (MU Torque or M/U TOR) to determine slip status. The slip status may then be utilized for one or more of pipe change detection and stand detection by the components 1224 and 1226, respectively. The slip detection component 1222 can include various sets of instructions that can be executable by a processor and, for example, the input 1210 and the output 1230 may be received and transmitted via one or more interfaces.

In the example of FIG. 12, the system 1200 can provide for slip detection, pipe changing (pipe change detection) and stand detection (e.g., via received data and processor-executable instructions stored in memory and executable by one or more processors, etc.). As shown, slip status can be based on one or more types of slip detection such that slip status may be detected from multiple channels to provide an ultimate slip status. For example, consider slip detection based on HKLD, based on SPPA or based on M/U Torque. As shown, pipe change detection can judge whether a drill pipe is added or removed during an inslip duration. As desired, stand detection can be run to detect where a stand begins and ends.

As to the input block 1210 of the system 1200, input channels for the slip detection component 1222 can include: hookload (HKLD), block position (BPOS), surface torque STOR), standpipe pressure (SPPA), bit depth (BDEP) (e.g., optionally in limited usage to detect first on bottom time), and hole depth (HDEP) (e.g., optionally limited usage to detect first on bottom time and separate shallow/deep depth). As to the stand detection component 1224, the input block 1210 of the system 1200 can include input channels as follows: hookload (HKLD), block position (BPOS), surface torque (STOR), standpipe pressure (SPPA), bit depth (BDEP) (e.g., heavy usage), and hole depth (HDEP) (e.g., heavy usage).

As an example, the system 1200 may utilize and/or convert data to one or more types of units. For example, units of channels can be: hookload (klbf), block position (ft), surface torque (lbf-ft), stand pipe pressure (psi). As an example, bit depth units and hole depth units may be arbitrary.

As an example, the slip detection component 1222 can utilize 1 second datasets; noting that it may handle data with one or more selected sampling rates. However, a lower sampling rate may degrade detection accuracy in some circumstances.

Figure 13:
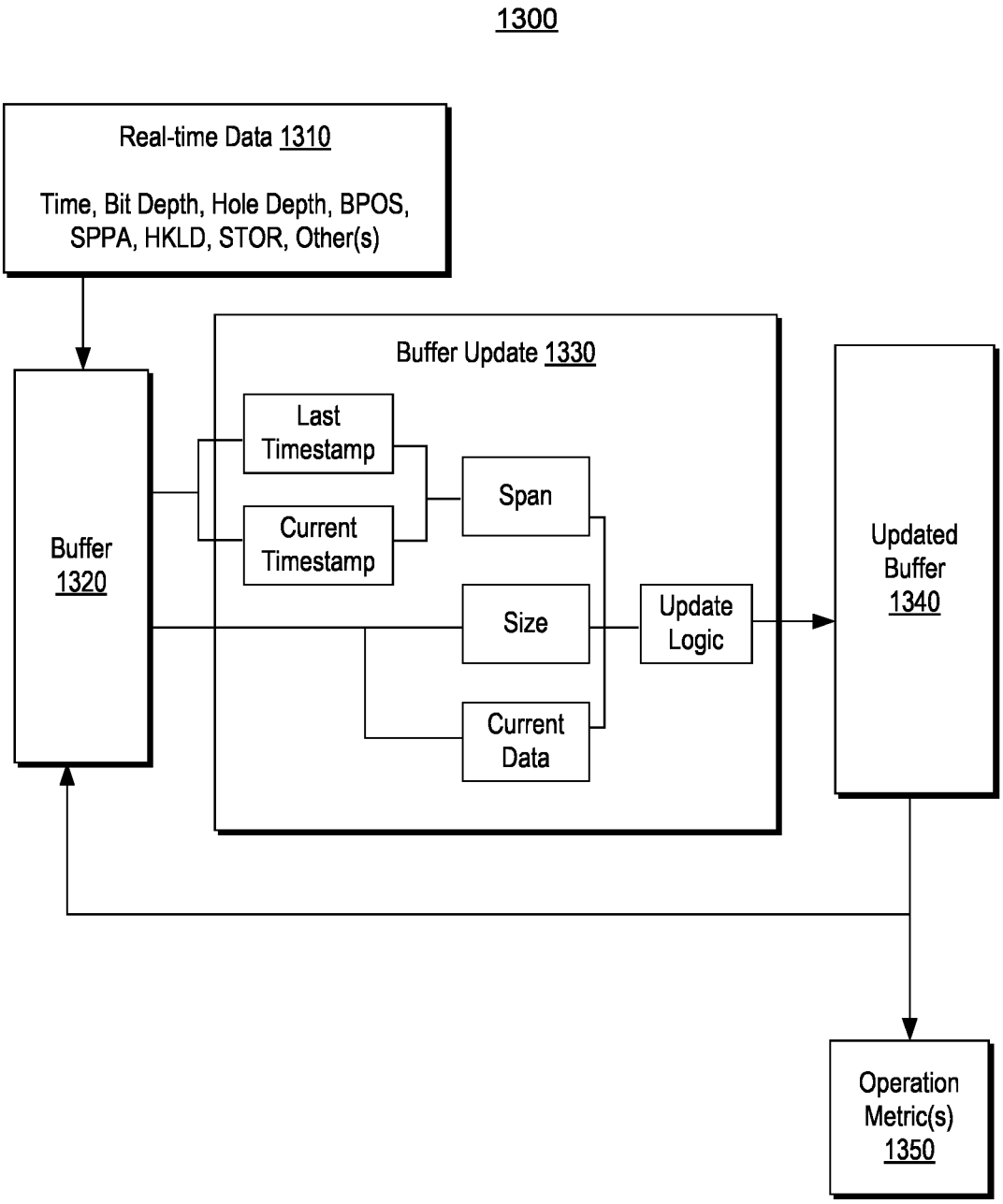
FIG. 13 illustrates an example of a system.

FIG. 13 shows an example of a system 1300 that includes a real-time data input block 1310, a buffer 1320, a buffer update component 1330, an updated buffer 1340 and an output block 1350 for output of one or more operation metrics, which may be utilized, for example, in controlling one or more rigsite operations.

The system 1300 of FIG. 13 can perform one or more methods that can handle input data such that the input data may be processed for handling empty data or lower frequency (e.g., less than about 1 Hz). When data comes in, the system 1300 may buffer raw data from 2 to 60 points in the buffer 1320 depending on the channel. This means that the null data can be firstly saved to the buffer 1320 and then updated later. For different channels, different buffer sizes can be assigned.

As an example, two or more different types of buffers can be used. For example, consider a $1^{st}$ type of buffers that has buffer size 2 and stores previous and current measurements. Such a $1^{st}$ type of buffers may be listed as following: time buffer, BDEP buffer, HDEP buffer, SPPA buffer, BPOS buffer, and HKLD buffer. A $2^{nd}$ type of buffer can include 3 buffers, which can store raw measurements at first and then be updated to time-wise buffer, secondly, for example, by extrapolation: surface torque (STOR) buffer with buffer size 5, surface torque (STOR) buffer with buffer size 60, and HKLD buffer with buffer size 15.

With 2 buffered time data points, a timespan between currently and previously received timestamp can be calculated. If the timespan is larger than approximately 1 s, as an example, the buffer can be updated by buffer updating logic using timespan, buffer size and current data.

As an example, consider the following logic to perform buffer updates for the $1^{st}$ type of buffer: if current measurement is not null value, the buffer updating is forgone; whereas, if the current measurement is null value, the value can be replaced by previous measurement in updated buffer and then used for computation. As to the $2^{nd}$ type of buffer:

(1) If the timespan>=~60 s, the buffer will be refreshed by filling in current data backwards if it is not absent which means more believing the current observation if the time gap is big enough (>=~60 s); If the current data of channel is absent, carry forward from previous non-absent value.

(2) When the timespan<~60 s, it can include 2 different cases:

(a) When the buffer size<=timespan: the processing method is same as that for timespan>=~60 s case described above.

(b) When the buffer size>timespan: the missing data during the timespan can be filled by carrying forward last non-absent value. Also, this non-absent value can be carried forward to current timestamp if current data is absent. Otherwise, the current data can be kept.

As to output, the following output may, for example, be inferred by slip/stand detection: timestamp of going in-slips, timestamp of going out-of-slips, pipe change or not, timestamp of drilling stand begin, and timestamp of drilling stand end. As an example, one or more of the following may be output by a system such as the system 1200 of FIG. 12: slip status and confidence, HKLD Th (e.g., auto threshold for other slip detection algorithms), estimated BLK WT during each stand (e.g., tracking hookload sensor shifting), estimated off bottom HKLD (e.g., potentially useful for detecting hole cleaning condition and anomaly operation), M/U Torque, estimated stand end depth at the beginning of stand, and false negative stand detection alarm.

As an example, the system 1200 may provide the following output: slip status (e.g., 1-in-slips, 0-out-of-slips), drilling stand count, HKLD high (or "hi"), HKLD low (or "lo"), HKLD Th, and M/U Torque. As an example, the system 1200 can be operatively coupled to one or more devices, via wire and/or wirelessly, for communication of output and/or for communication of one or more control signals that can depend at least in part on at least a portion of output.

As an example, a system can provide for issuance of one or more notifications as to one or more detected events, which can include, for example: timestamp/bit depth of getting in-slips, timestamp/bit depth of getting out-of-slips, stand begin (for drilling), stand end (for drilling), and pipe change (e.g., add, remove, none) at timestamp of getting out-of-slips.

As to one or more components of a system such as the system 1200, a slip detection component can provide for inferring slip status based on information from various different channels (e.g., combining information therefrom to compute an ultimate slip status). As to a component or components for inslip/outslip features, one or more of the following channels and features optionally provide insight on the slip status: HKLD, SPPA and surface torque (e.g., STOR or makeup torque).

Figure 14:
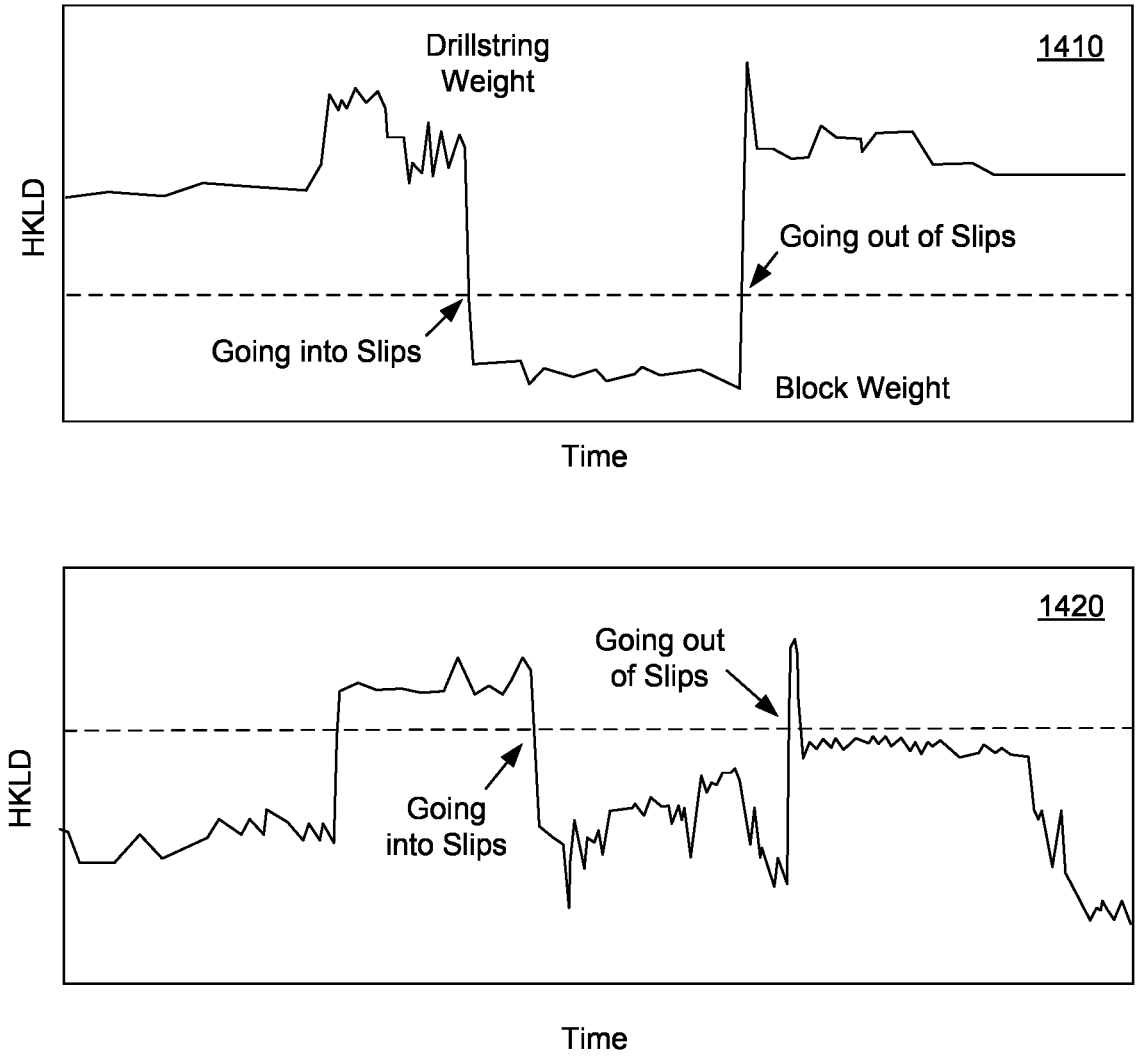
FIG. 14 illustrates examples of graphical user interfaces.

FIG. 14 shows example plots 1410 and 1420, which may be part of one or more GUIs rendered to a display or displays. The plot 1410 shows HKLD versus time and the plot 1420 shows HKLD versus time. Hookload is a relevant channel that can tell slip status in some scenarios. As shown in FIG. 14, a hookload signal can be analyzed for slip status (e.g., inferred by hookload with respect to time). Before going in-slips, a certain amount of drill string weight can be taken by a hoisting system, for example, depending on a well's trajectory. When the slip device is placed, the drill string weight will be taken by slip device and the hoisting system holding the travelling block. This means that the hookload can drop while going in-slips depending on bit depth and well trajectory, and vice versa for going out-of-slips. In such scenarios, slip status can be computed by imposing a threshold line, which is shown as a single threshold value of the hookload (HKLD) that remains constant with respect to time. As shown in the plot 1410, the slip status is inslip (IS) if below the line and out-of-slips (OOS) if above the line. Thus, one single threshold is utilized to determine IS and OOS status.

In FIG. 14, the plot 1420 shows another scenario that can be considered a shallow depth scenario. The plot 1420 shows a hookload signal at shallow depth where a constant hookload threshold approach to detect the slip status can, at time, be inaccurate (e.g., inaccurate detection results).

As to a stand pipe pressure signal, compared to a hookload signal, the stand pipe pressure tends to have a lesser ability for detecting the transition moment between inslip and outslip.

Figure 15:
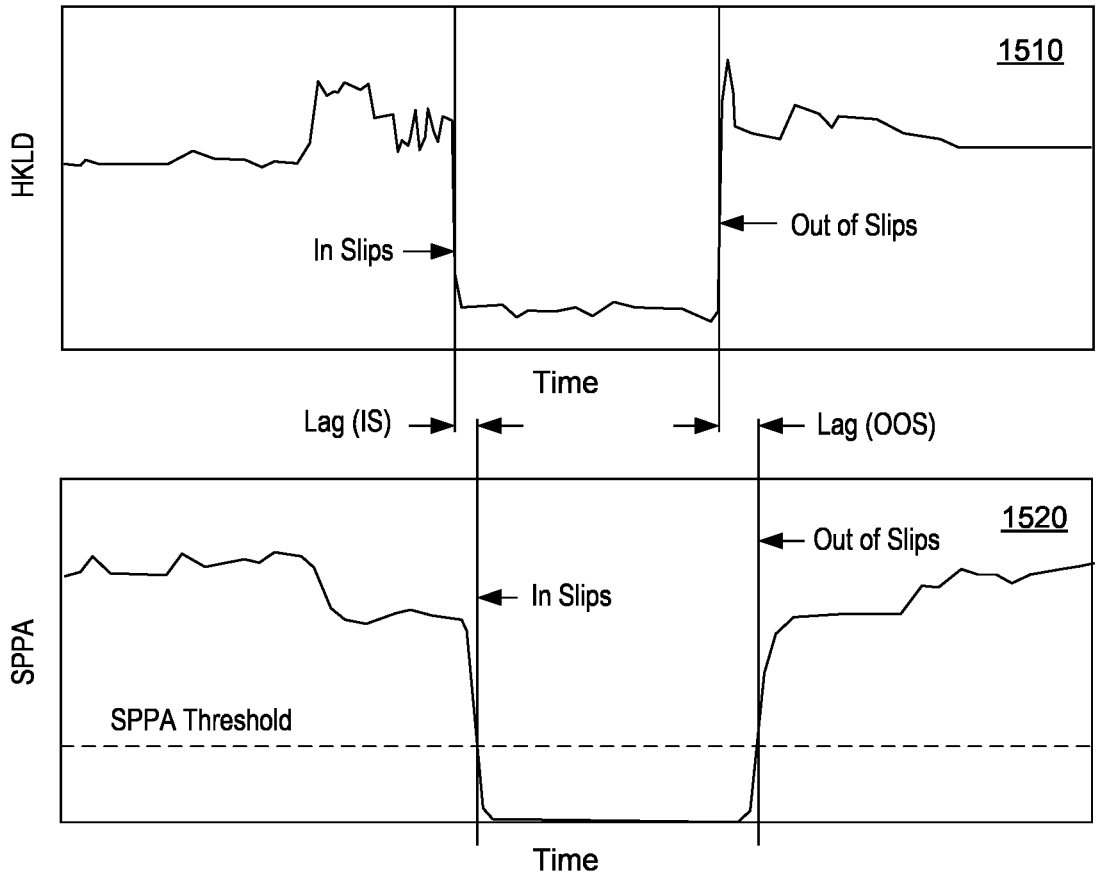
FIG. 15 illustrates examples of graphical user interfaces.

FIG. 15 shows example plots 1510 and 1520 for HKLD versus time 1510 and for SPPA versus time 1520, which may be part of one or more GUIs. During operations, a pump (e.g., mud pump) can be turned off at some time after going in-slips; thus, there can be a lag between inslip time inferred by SPPA.

The plots 1510 and 1520 shows slip status inferred from SPPA and compared with HKLD, showing a SPPA threshold (SPPA Th) and actual inslip time. After a connection is made, a pump can be turned on for pumping, for example, at some time after going out-of-slips. In such an example, a lag in time can be seen between outslip time from SPPA and actual marked indication in data; noting that an exception can be for continuous circulation of drilling fluid (e.g., drilling mud) during a pipe change.

As an example, SPPA may be utilized for screening out possible inslip/outslip intervals, which can improve detection(s). For example, a system can receive SPPA information (e.g., real-time data, etc.) and utilize such information to confirm and/or adjust slip status (e.g., by joint effort with one or more other channels).

Figure 16:
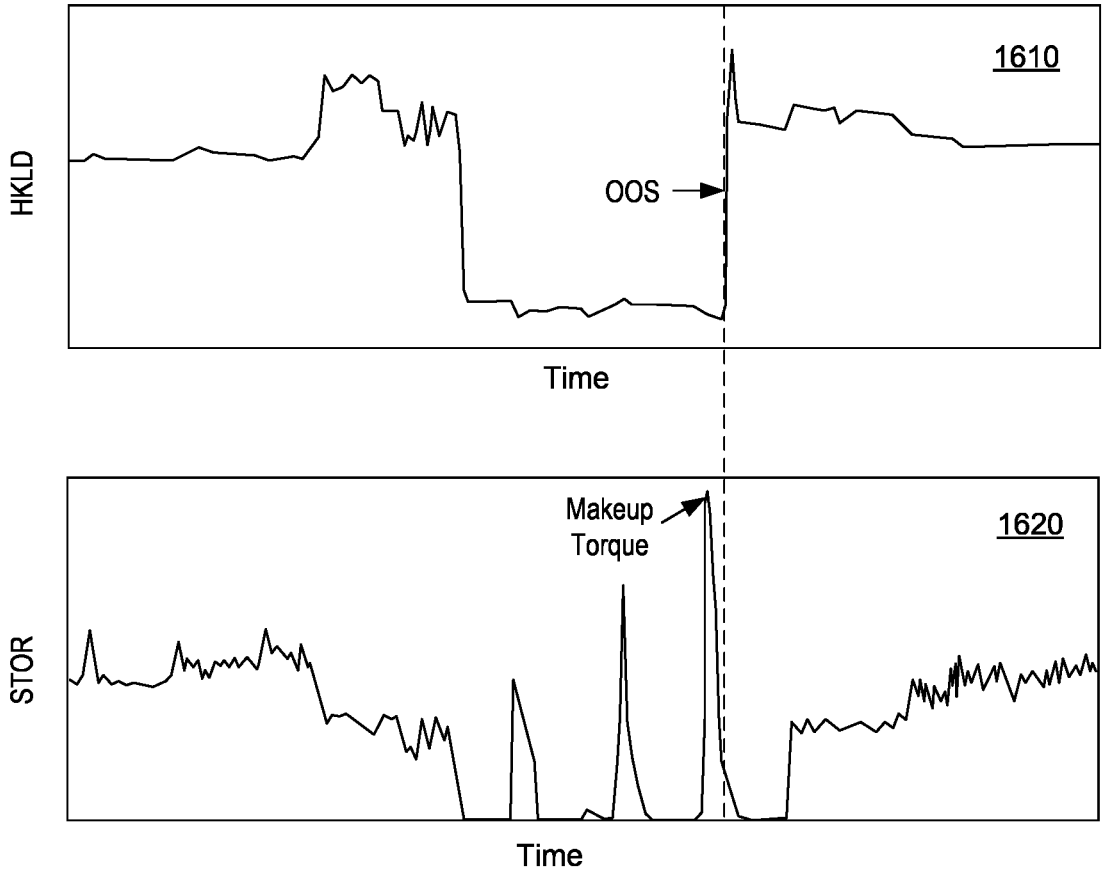
FIG. 16 illustrates examples of graphical user interfaces.

FIG. 16 shows example plots 1610 and 1620 for HKLD and STOR versus time, respectively. As to surface torque (e.g., STOR or M/U Torque), as explained, a system can include components for inferring slip status from surface torque (STOR or M/U Torque).

As shown in FIG. 16, torque data (e.g., STOR or M/U Torque) can be suitable for analysis for inslip confirmation during drilling. In the example plot 1620, the makeup torque does not refer to the makeup torque of drill pipe; rather, it is the makeup torque between a saver sub and a $1^{st}$ drill pipe from surface. Makeup torque data may be available during drilling. Makeup torque may be relatively constant across a run. As an example, makeup torque (e.g., STOR or M/U Torque) can be used by a system to confirm and/or adjust slip status (e.g., with data from one or more other channels).

As to examples of other channels that may be helpful for slip detection, such channels can include one or more of surface RPM, block velocity, Omron control system signal, etc. Depending on availability, one or more of these channels can be incorporated into slip detection.

As to slip status via hookload, as mentioned, a hookload threshold can be utilized to detect slip status particularly when separation is rather distinct between drill string weight and block weight. In such a situation, a manual method can include observing hookload signal and setting an appropriate hookload threshold. As an example, a method can include receiving hookload data and analyzing the hookload data via one or more processors to detect slip automatically, for example, for multiple jobs (e.g., multiple data sets). As an example, a method can include automatically calculating slip status, for example, using a dynamic hookload threshold.

As mentioned, a threshold method may be less accurate while drilling and tripping near surface where drill string weight and block weight may not have a distinct enough separation. In such a scenario, a method to detect the slip status at shallow depth can include recognizing a hookload sudden change at a transition moment of going in-slips and out-of-slips.

Figure 17:
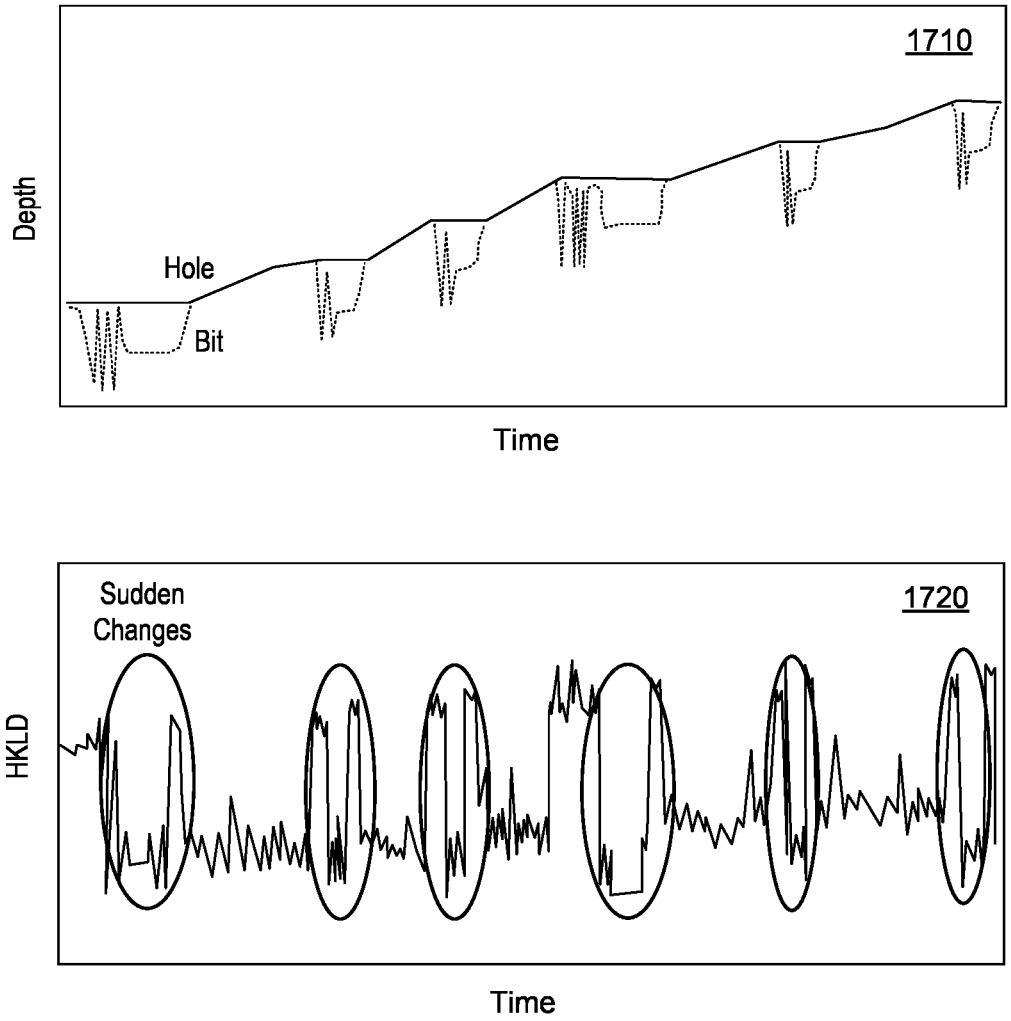
FIG. 17 illustrates examples of graphical user interfaces.

FIG. 17 shows example plots that include a plot of bit depth (BDEP) and hole depth (HDEP) versus time 1710 and HKLD versus time 1720 with some examples of sudden changes identified. As an example, a sudden change can be identified based on a sudden change criterion or criteria (e.g., hookload change, hookload slope with respect to time, etc.). The amount of hookload sudden change can relate to bottom hole assembly (BHA) weight and drill pipe weight, etc. With an increase of depth, the change amount tends to be larger and larger (e.g., when the well is vertical near surface). As an example, a method can include inferring slip status at least in part by tracking and updating the amount of hookload sudden change stand by stand. In such an example, a method can include calculating a standard deviation (SD) of hookload data with respect to time in a sliding window that can measure the amount of hookload sudden change. Such an approach may be referred to as a hookload standard deviation approach (HLSD). Another approach can be utilized, for example, at depths that are determined not to be "shallow", which may be referred to as a dynamic hookload approach (DHL).

Figure 18:
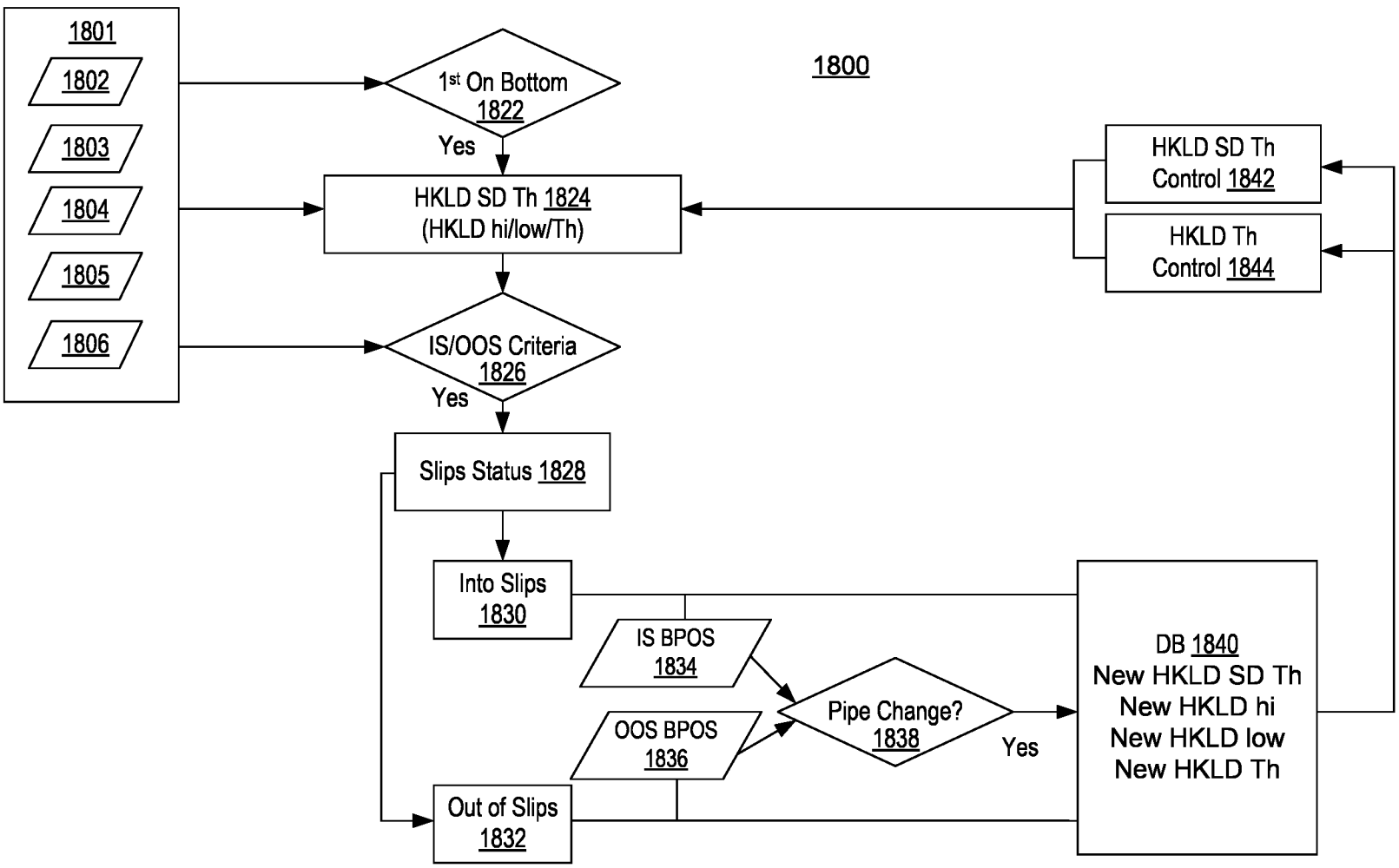
FIG. 18 illustrates an example of a method.

FIG. 18 shows an example of a method 1800 that includes a data block 1801 for receiving various types of data, a decision block 1822 as to first on bottom (e.g., first on bottom of hole), a HKLD SD Th block 1824, a decision block 1826 as to IS/OOS criteria, a slips status block 1828 (e.g., slip status), an in-slips block (IS) 1830, an out-of-slips block (OOS) 1832, a IS BPOS block 1834, an OOS BPOS block 1836, a decision block 1838 as to pipe change, a database block 1840, a HKLD SD Th control block 1842 and a HKLD Th control block 1844. As an example, the data of the data block 1801 can include BDEP as data 1802, HDEP as data 1803, HKLD as data 1804, STOR as data 1805 and BPOS as data 1806.

The method 1800 can include slip detection logic by hookload feature that can be implemented by a system that includes one or more processors. Though such a hookload feature can provide a signature for detecting the transition moment between inslip and outslip, hookload as an input can be supplemented.

In the method 1800, the detection logic can be described with respect to data starting from drilling; noting that detection logic for data starting from tripping is described below. In the method 1800, the data 1801 is shown as including different types of data 1802, 1803, 1804, 1805 and 1806, where such data can include BDEP and HDEP, which can be utilized to determine a first on bottom point $T_s$ (see, e.g., the decision block 1822). The first on bottom point can occur where the first drilling stand begins, but sometimes it may start from somewhere during tripping, for example, due to a data issue (e.g., data problem, etc.).

Once the first on bottom point is determined, a slip detection algorithm can be initialized. In such an approach, BDEP data may be acquired but not necessarily utilized in the slip detection algorithm. At a bottom point moment, the algorithm can set the initial hookload standard deviation (SD) threshold ($STD_0$) based on hookload value at $T_s$ as shown in Eq. (1):

$$STD_0 = \begin{cases} 0.1\ HKLC(T_s) & \text{if } 10 < 0.1\ HKLD(T_s) < 50 \\ 10 & \text{if } 0.1\ HKLD(T_s) < 10 \\ 50 & \text{if } 0.1\ HKLD(T_s) > 50 \end{cases} \quad (1)$$

Besides initial hookload SD threshold, several other initial values can be utilized such as hookload high, hookload low and hookload threshold, as explained herein. With initial values defined and given, the algorithm can start to detect the slip status by choosing different inslip/outslip criteria.

Figure 19:
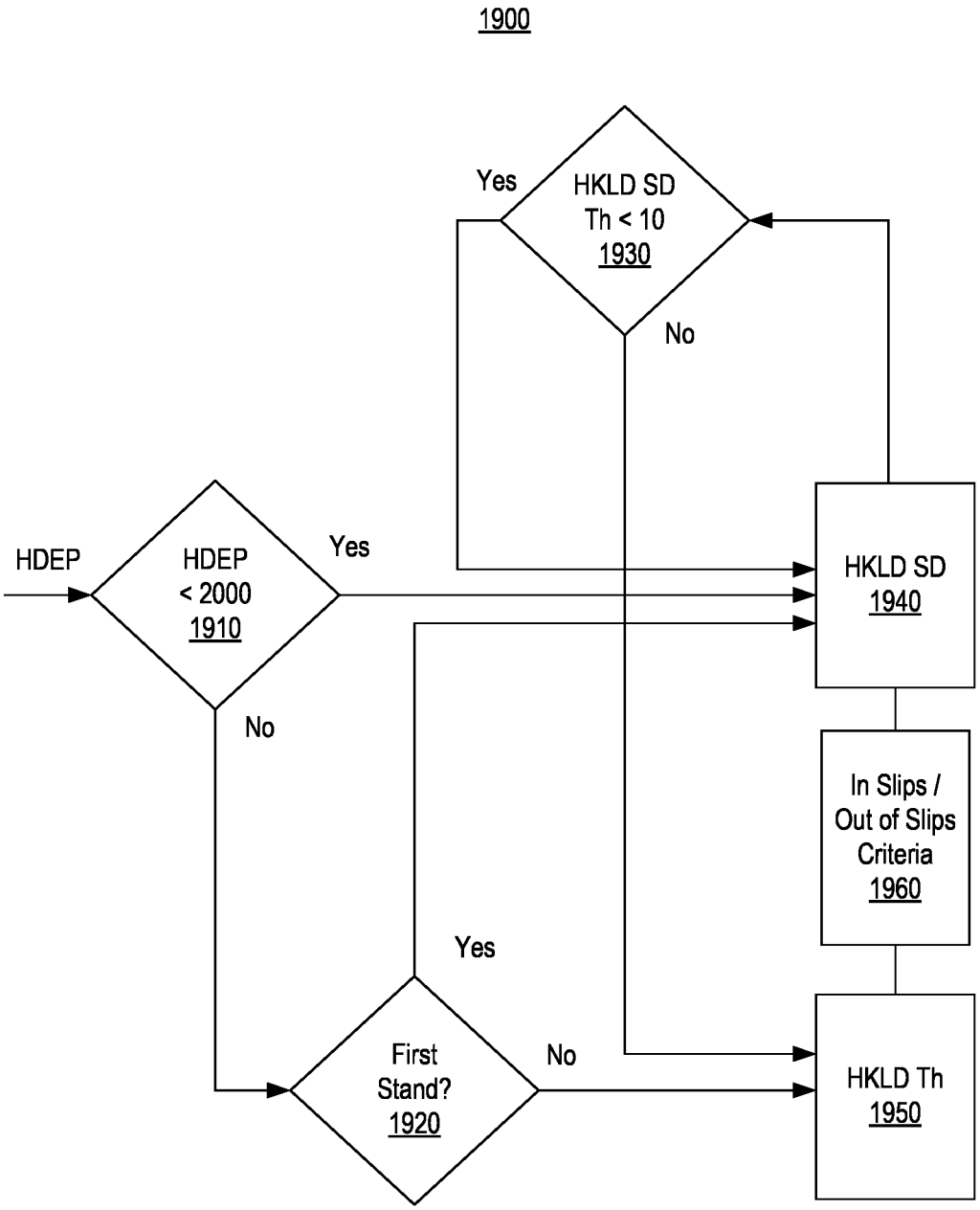
FIG. 19 illustrates an example of a method.

FIG. 19 shows an example of a method 1900 that can include selecting different inslip/outslip criteria. As shown, the method includes a decision block 1910 for deciding whether HDEP is less than a certain value, a decision block 1920 for deciding whether a first stand is present, and a decision block 1930 for deciding whether a HKLD SD Th is less than a certain value. As shown, the decision logic can provide for determinations as to a HKLD SD per a block 1940, a HKLD Th per a block 1950 and IS/OOS criteria per a block 1960.

As an example, when received data starts from a HDEP less than approximately 2000 feet per the block 1910, which can be considered as a shallow depth limit, an algorithm can utilize a HKLD SD criterion (block 1940) to detect slip status (e.g., HLSD approach). As shown in FIG. 19, where the decision block 1910 decides that hole depth (HDEP) is equal or greater than approximately 2000 feet, the method 1900 can change to a dynamic hookload approach (DHL) (see, e.g., the first stand decision block 1920).

As an example, if data starts from a HDEP deeper than approximately 2000 feet, the $1^{st}$ stand can be detected by a HKLD SD criterion (see the decision block 1920 "First stand?" in the method 1900 of FIG. 19. In such an example, hookload high/low/threshold values can be appropriately updated after a $1^{st}$ stand and then be used for the following slip detection.

As an example, another manner of determining a switch criterion can utilize a hookload value. For example, a criterion where HKLD SD threshold, as newly obtained, is less than approximately 10 klbf. Such a criterion may be met while tripping stands near surface where, for example, the dynamic hookload threshold approach (DHL) may not work with desired accuracy. FIG. 19 shows the decision block 1930 as to "HKLD SD Thd<10", where, if the criterion is not met, the method 1900 can continue to the dynamic hookload threshold approach (DHL); otherwise, where the criterion is met, the method 1900 can continue with the hookload standard deviation (HLSD) approach.

Various examples of hookload standard deviation criterion (HLSD) and hookload dynamic threshold criterion (DHL) are described below.

Figure 20:
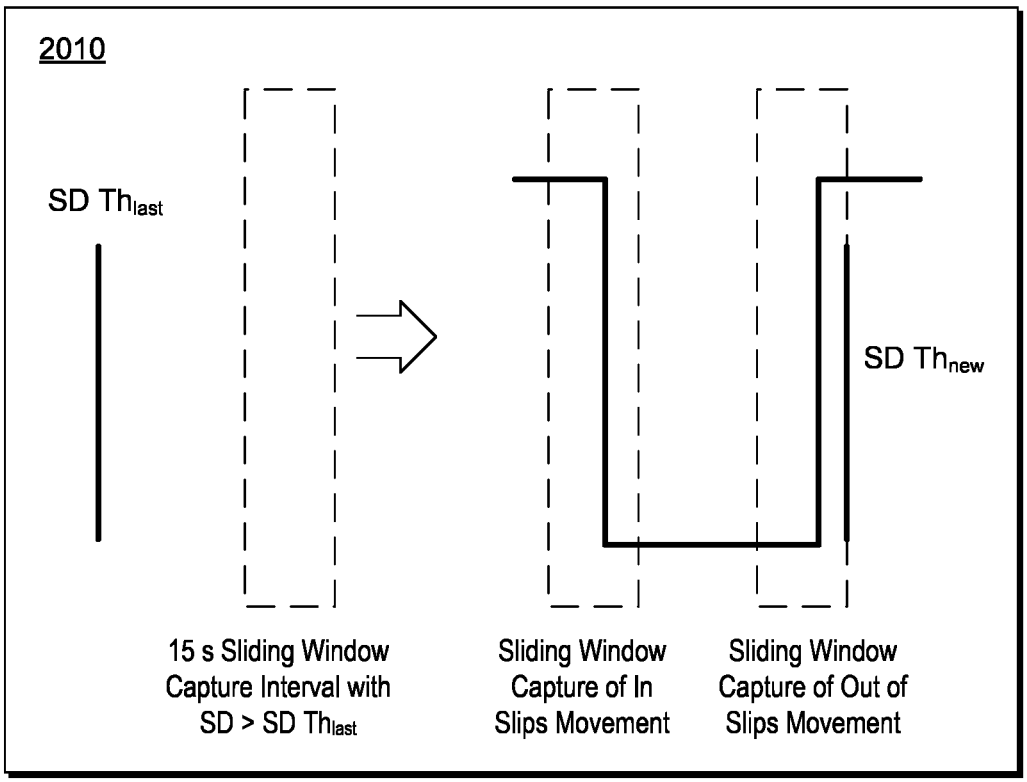
FIG. 20 illustrates examples of methods.
Figure 20:
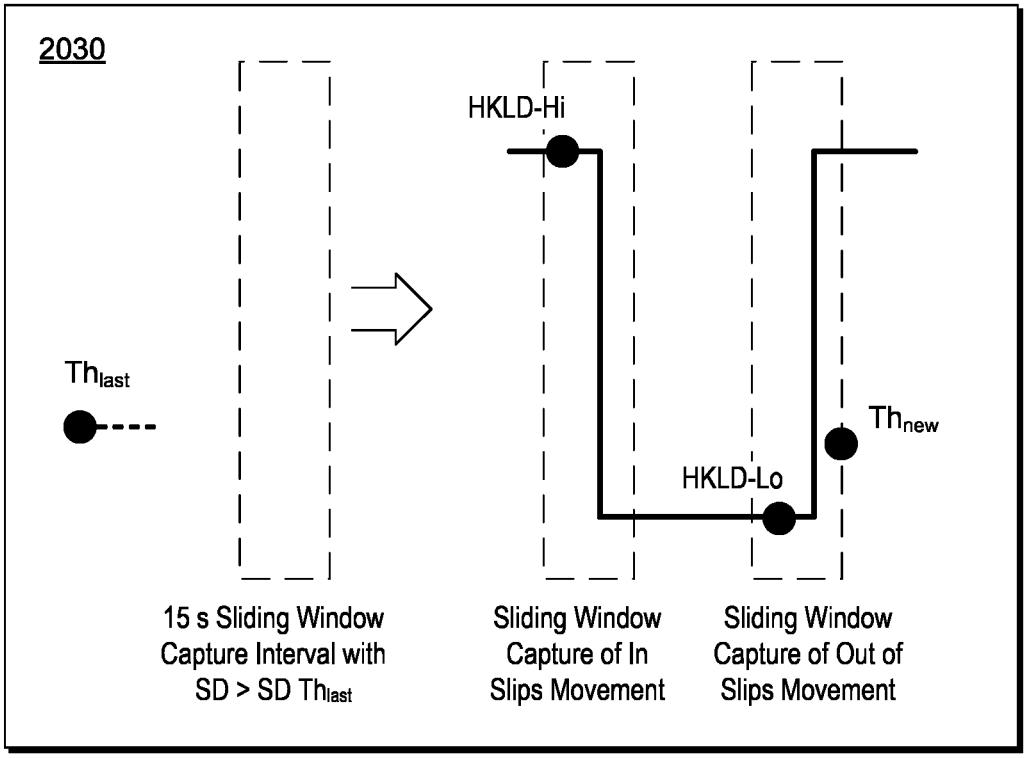

FIG. 20 shows an example of a Hookload Standard Deviation Criterion (HLSD) approach 2010 and a Hookload Dynamic Threshold Criterion (DHL) approach 2030.

The HLSD approach 2010 can include sub-criteria of the hookload standard deviation criterion, which uses the standard deviation threshold obtained from a previous stand to detect the following stand. More specifically, one can have SD threshold from a previous stand and buffered hookload data in a sliding window. When the sliding window moves to the dashed position (see second dashed box from the left), the standard deviation of buffered data is larger than SD threshold. With additional 2 sub-criteria of inslip criteria, the transition moment from outslip to inslip will be captured. The additional sub-criteria are:

1. Mean of the first third of buffered hookload−Mean of the last third of buffered hookload>SD $Thd_{last}$
2. Mean of 5 buffered surface torque<1 (unit: klbf-ft)

Once the transition to inslip is identified, an algorithm can look for the transition to outslip by using, for example, the same SD threshold. When the sliding window moves to dashed position (third dashed box from the left), the standard deviation of buffered data is larger than SD threshold. With additional 2 sub-criteria of outslip criteria, the transition moment from inslip to outslip can be captured. The additional sub-criteria are:

1. Mean of the first third of buffered hookload−Mean of the last third of buffered hookload<−SD $Thd_{last}$
2. Mean of buffered hookload>hookload low value (block weight) from previous stand Once both transition timestamps are captured, pipe change criteria can be applied to check if pipe is changed during inslip by comparing the block position at both timestamps. If yes, the hookload SD threshold from current stand can replace (after control) the previous threshold and then used for the next detection.

As to the Hookload Dynamic Threshold Criterion (DHL) approach 2030, FIG. 20 shows dynamic threshold criteria, which uses the threshold obtained from previous stand to detect the following stand. More specifically, given the threshold from a previous stand and buffered hookload data in a sliding window. In such an example, a method may operation without buffering data longer than 2 data points for such a criterion. However, the same buffer size may be retained to be consistent with the setup of the hookload SD criterion.

In the approach 2030 of FIG. 20, when the sliding window moves to the dashed position (see second dashed box from the left), the transition moment from outslip to inslip can be captured by:

1. Mean of the first third of buffered hookload>$Thd_{last}$
2. Mean of the first third of buffered hookload<$Thd_{last}$ Once the transition to inslip is identified, the hookload High value can be computed as Eq. (2) and stored for use later:

$$\text{Hookload High}=\text{Mean of the first third of buffered hookload} \quad (2)$$

Then, the algorithm can look for the transition to outslip by using, for example, the same threshold. When the sliding window moves to blue dash position (see third dashed box from the left), the transition moment from inslip to outslip will be captured by:

1. Mean of the first third of buffered hookload<$Thd_{last}$
2. Mean of the first third of buffered hookload>$Thd_{last}$ Similarly at this moment, the hookload Low value will be computed as Eq. (3):

$$\text{Hookload Low}=\text{Mean of the first third of buffered hookload} \quad (3)$$

Once both transition timestamps are captured, pipe change criteria can be applied to check if a pipe is changed during inslip by comparing the block position at both timestamps. If yes, the hookload threshold from a current stand can be computed according to Eq. (4) and followed by replacement (after control) of the previous threshold and then used for the next detection.

$$Thd_{new}=\text{HKLD Low}+\max\{2STD_0, 0.25(\text{HKLD High}-\text{HKLD Low})\} \quad (4)$$

Figure 21:
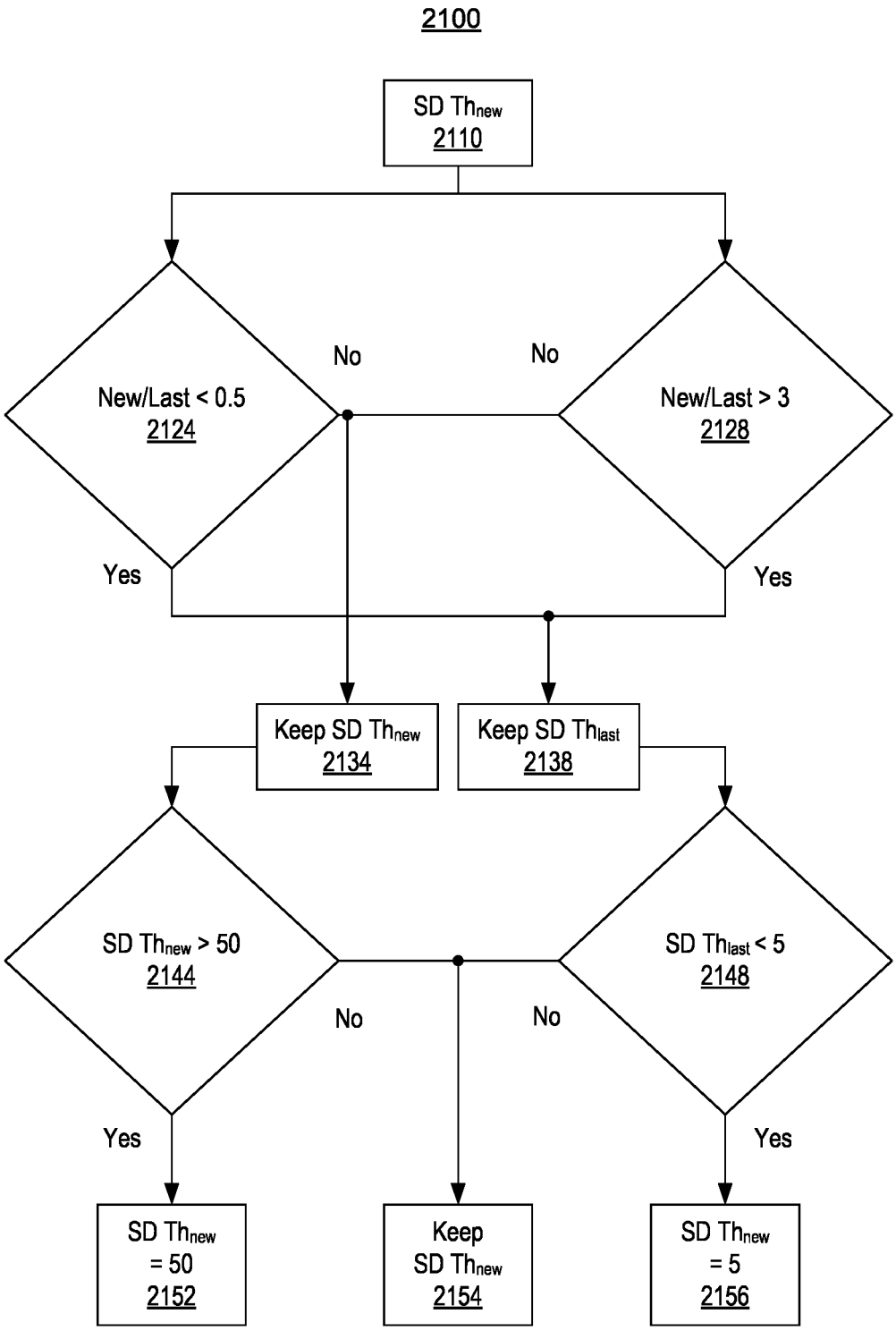
FIG. 21 illustrates an example of a method.

FIG. 21 shows an example of a method 2100 for SD threshold and threshold control. The method 2100 includes a SD $Th_{new}$ reception block 2110, decision blocks 2124 and 2128, keep blocks 2134 and 2138 for "new" and "last", decision block 2144 and 2148, and output blocks 2152, 2154 and 2156 for logical SD $Th_{new}$ determinations.

In the method 2100, for SD threshold and dynamic threshold newly obtained from a current stand, control logic can be applied before replacing a previous threshold. The method 2100 illustrates an example of control logic for SD threshold where, for example, the control logic can set a range (e.g., from about 0.5 to about 3) per decision blocks 2124 and 2128 to be utilized to determine if a new SD threshold is reasonable, for example, by comparing the ratio between a new and an old SD threshold. In such an example, if within the range, a new SD threshold can be kept per the block 2134; whereas, if it is out of range, the value can be reset to the old SD threshold per the block 2138. As shown, the method 2100 can then include regulating the absolute amount of a new SD threshold by a set of a lower bound value and an upper bound value (e.g., 5 klbf and 50 klbf, respectively) per the decision blocks 2144 and 2148, which can ultimately provide one of the outputs 2152, 2154 and 2156.

Figure 22:
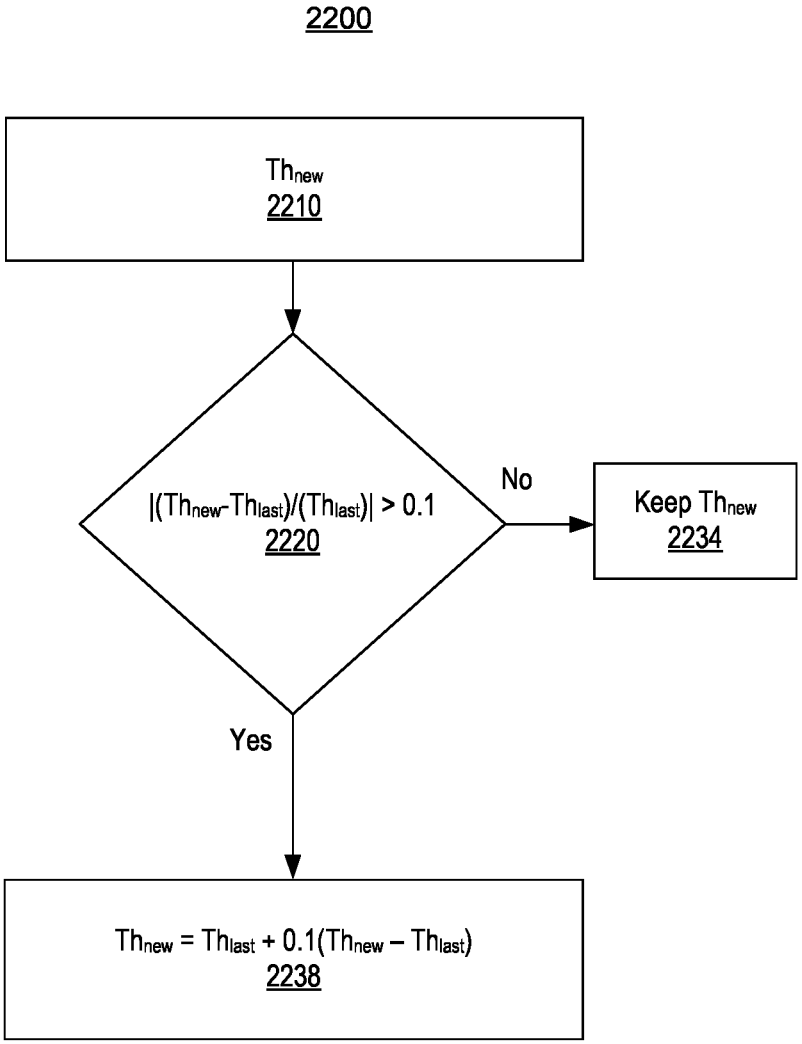
FIG. 22 illustrates an example of a method.

FIG. 22 shows an example of a method 2200 that includes control logic for a hookload threshold (e.g., a dynamic threshold). As shown, the method 2200 includes a reception block 2210 for receiving $Th_{new}$, a decision block 2220, a keep block 2234 and a recompute block 2238.

In the example method 2200 of FIG. 22, control logic can set a percentage threshold (e.g., consider a value of about 10 percent or other appropriate value, which may be tuned) to compare a ratio between a difference of new and old threshold over old threshold (see the decision block 2220). In such an example, where the percentage is set at 10 percent, if below 10 percent, the new threshold is kept per the block 2234; whereas, if above 10 percent, the new threshold is reset to allow for a 10 percent change from the old threshold per the block 2238.

Figure 23:
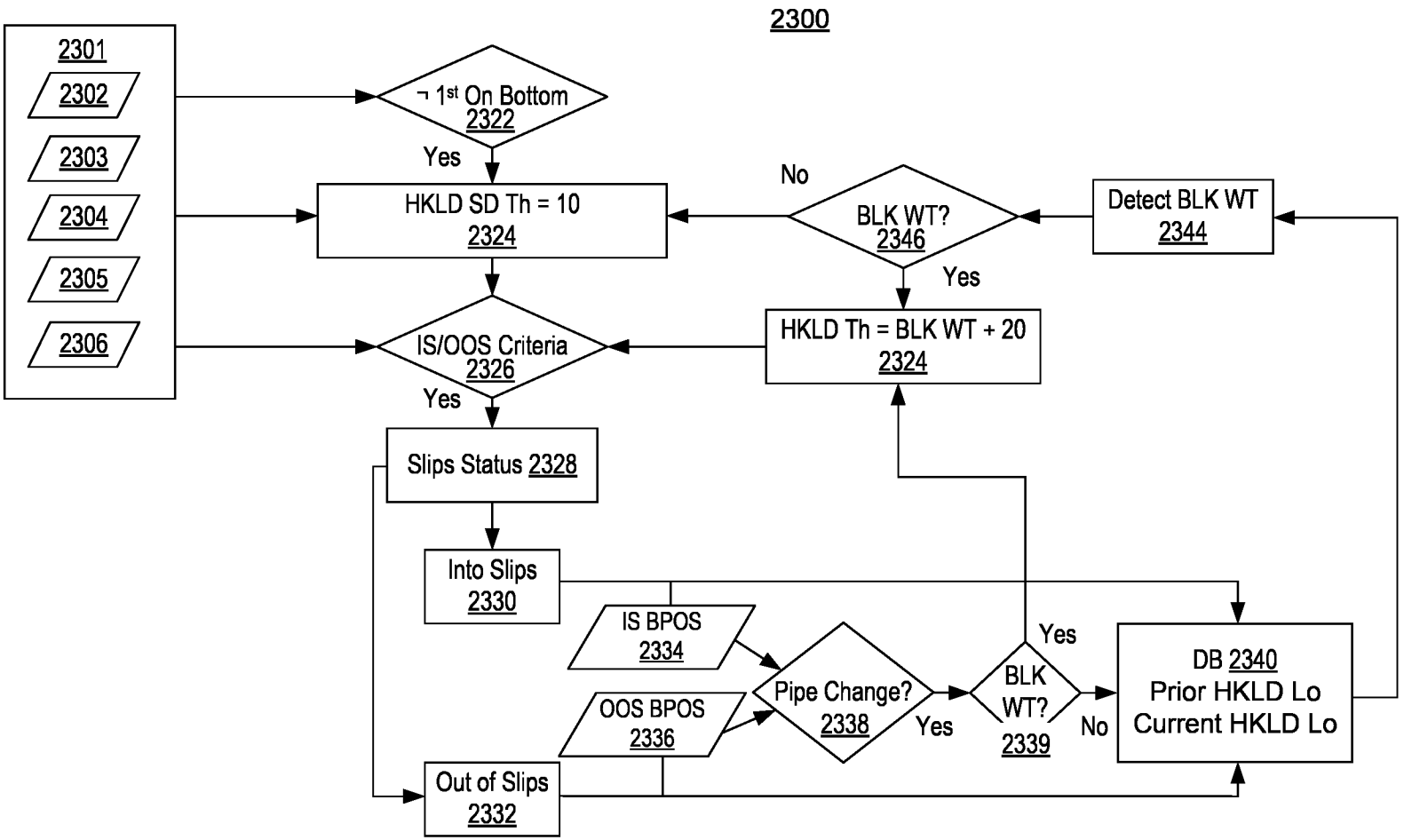
FIG. 23 illustrates an example of a method.

FIG. 23 shows an example of a method 2300 for tripping activity detection before drilling starts. The method 2300 includes various blocks that may be the same or similar to the method 1800 of FIG. 18. For example, the method 2300 includes a data input or reception block 2301 with various types of data 2302, 2303, 2304, 2305 and 2306. Further, the method 2300 includes a decision block 2322 as to first on bottom, a decision block 2326 as to IS/OOS criteria, and a decision block 2338 as to pipe change. Other blocks include a slip status block 2328, an IS block 2330, a OOS block 2332, a IS BPOS block 2334, a OOS BPOS block 2336.

In the example of FIG. 23, the method 2300 also includes a HKLD SD Th set block 2324, a HKLD Th computation block 2324, a database block 2340, a block weight (BLK WT) detection block 2344, a BLK WT decision block 2339 and another BLK WT decision block 2346. As indicated, the method 2300 can include one or more determinations as to BLK WT where, per the computation block 2324, BLK WT may be utilized in computing a HKLD Th value; otherwise, where the decision block 2346 decides that BLK WT is not present per the detection block 2344, the HKLD SD Th may be set per the block 2324. As indicated, one or more loops can exist within the method 2300.

Where the aforementioned logic works for the data starting from drilling activity, it may not necessarily be suitable for detecting tripping activity before the $1^{st}$ on bottom because the detection starts from $1^{st}$ on bottom position. Where the data starts from tripping in or tripping out, such logic can miss those tripping activities. As an example, a method can employ additional logic to detect the tripping activities before $1^{st}$ on bottom as shown in FIG. 23. Thus, the method 2300 can be implemented as to slip detection for tripping activity before drilling when the data starting from tripping.

As an example, if the $1^{st}$ on bottom is not detected yet per the decision block 2322 (see logic symbol "¬" meaning "not $1^{st}$ on bottom"), a hookload standard deviation criterion (or criteria) can be used to detect "going in-slips" and "going out-of-slips" activities by using a fixed standard deviation threshold (e.g., consider a value of about 10 klbf; noting other values may be determined, utilized, etc.). As an example, for each time that the timestamps of these activities are detected, an algorithm can be implemented to detect if pipe is changed during an inslip interval (see, e.g., the decision block 2338). In such an example, if the decision block 2338 decides "yes", the current hookload low can be compared with a previous hookload low. If they are close enough (e.g., <=10 percent), the current hookload low can be identified as block weight. In such an example, then, the following tripping connections can be detected via hookload threshold criterion (e.g., or criteria) by setting threshold as block weight (BLK WT) plus, for example, 20 klbf until the $1^{st}$ on bottom location (see, e.g., the computation block 2324).

As to slip status by SPPA, the slip status detected by SPPA can optionally be via a fixed threshold. For example, SPPA greater than threshold means out-of-slips and SPPA less than threshold means inslip (IS). As an example, a threshold can be set to be about 300 psi based on testing experience; however, (1) this threshold may not cover an exception case with continuous circulation while making connections. In such a situation, SPPA can be larger than 300 psi threshold and an algorithm may give the wrong slip status and/or false negative stand detection. Further, for the drilling stands near surface, SPPA during drilling may not exceed this threshold while drilling. In such a situation, as an example, the slip status can be more determined by hookload logic and makeup torque.

Figure 24:
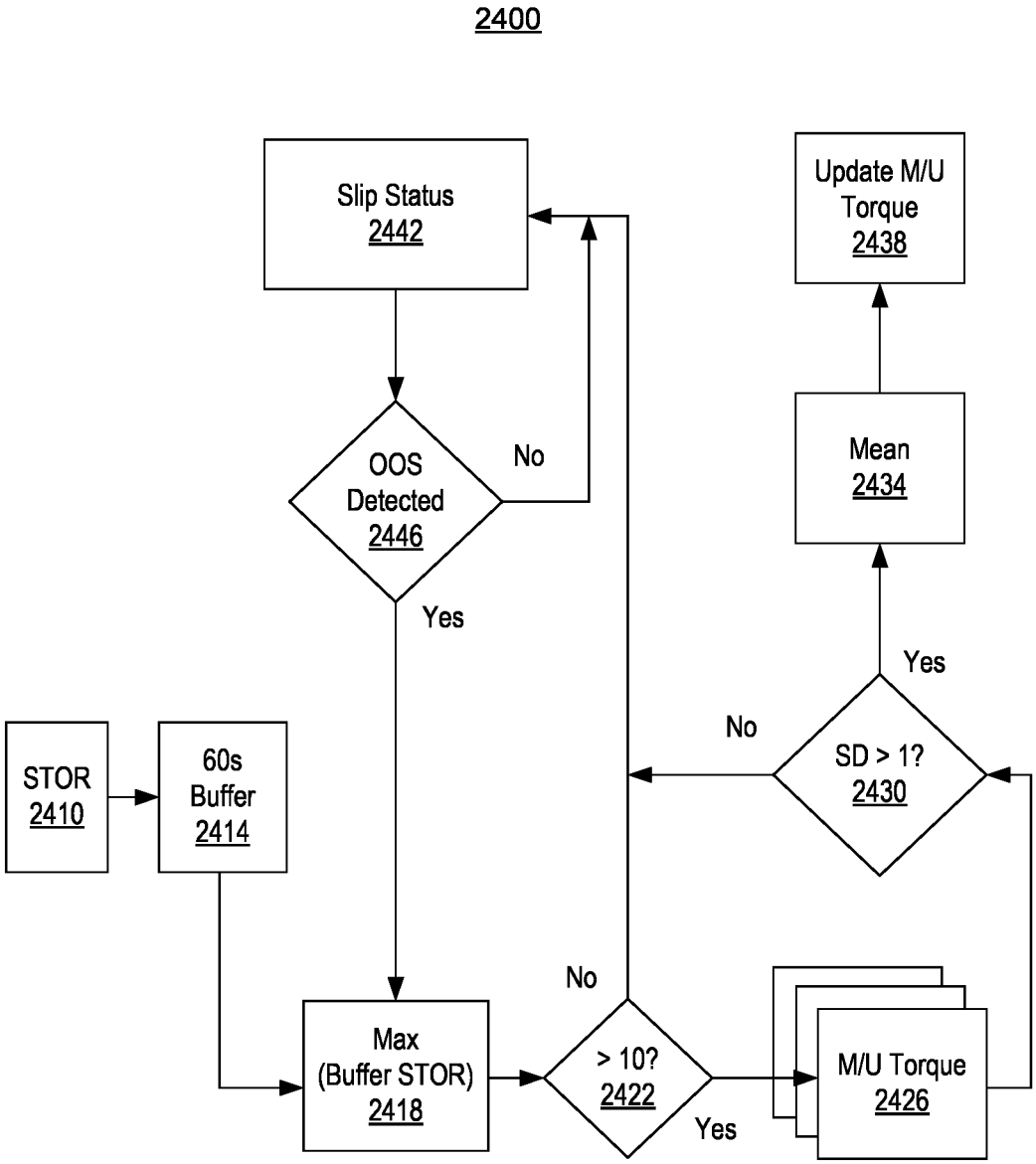
FIG. 24 illustrates an example of a method.

FIG. 24 shows an example of a method 2400 as to slip status based at least in part on makeup torque (e.g., STOR or M/U Torque). In the example of FIG. 24, the method includes a reception block 2410 for receiving STOR data, a buffer block 2414 for storing/buffering an appropriate amount of STOR data (e.g., consider a 60 s buffer, etc.), a max block 2418 for determining a maximum STOR value, a decision block 2422 for determining whether the maximum STOR value is greater than a certain value, a M/U Torque block 2426 that can store various values, a decision block 2430 that can decide if a standard deviation (SD) of the various values is greater than a certain value, where, if so, a mean block 2434 provides for determining a mean value and an update block for updating a M/U Torque value; otherwise, the method 2400 continues to a slip status block 2442, which can continue to a decision block 2446 as to OOS detection, which may operate in a loop that is driven by the decision block 2422 and/or the decision block 2430.

As mentioned previously, the makeup torque (M/U Torque) can be a suitable feature to confirm inslip status. However, the makeup torques for different drilling jobs tend to differ. In real-time, this torque may have to be learned automatically during the first couple of stands. The method 2400 of FIG. 24 can provide for automatic makeup torque learning in real-time.

As an example, based on field data observation, a drill string can go out-of-slips within about 1 minute after makeup. In such an example, 60 s of surface torque data can be received per the block 2410 and can be buffered for makeup torque learning per the buffer block 2414. Once a transition to out-of-slips is detected per the decision block 2446, a signal can be utilized as a trigger for determining the maximum value of buffered STOR per the maximum determination block 2418. As such an approach can also return the maximum value of tripping stands, which tends to be close to 0, this value can be expected to be greater than a threshold (e.g., currently set to 10 klbf-ft) to be believed as a possible candidate of makeup torque. Once a method collects several of such candidates as indicated by the M/U Torque block 2426 (e.g., 3 or more of such candidates), a standard deviation (SD) of the candidates can be computed to provide for decision making per the decision block 2430 to determine if a mean of the candidates can be used as a final makeup torque to be output by the update block 2438.

As an example, once makeup torque is available, the slip status can be detected by a torque threshold, for example, according to Eq. (5):

$$\text{Torque threshold}=\text{Makeup Torque}-1 \tag{5}$$

In such an approach, a surface torque greater than threshold is deemed inslip (IS) and STOR less than threshold is deemed outslip (OOS).

As an example, a method may implement slip detection based at least in part on combined weight. As mentioned, a method may provide several sets of slip status inferred by different logic (e.g., consider two or more). As an example, a method can include merging two or more or three or more logics together to give more accurate and robust slip detection results than using such logics individually.

As an example, a system can implement a method where slip status detected by hookload feature is a foundation of whole slip detection. Such an approach can give fairly accurate results for most of the time (e.g., it can cover slip detection during tripping). As an example, such a system can also implement slip status detected by SPPA and/or makeup torque, either or both of which can serve to confirm or adjust slip status inferred by a hookload feature.

To combine 3 sets of slip status into a final one, different weights can be assigned to the slip status inferred by 3 ways, for example, based on confidence level(s):

The weights ($\text{Weight}_{HKLD}$) for slip status detected by hookload feature:

$$\text{Weight}_{HKLD} = \begin{cases} 1 & \text{inslip} \\ -1 & \text{outslip} \end{cases} \tag{6}$$

The weights ($\text{Weight}_{SPPA}$) for slip status detected by SPPA:

$$\text{Weight}_{SPPA} = \begin{cases} 0.5 & \text{inslip} \\ -1.5 & \text{outslip} \end{cases} \tag{7}$$

The weights ($\text{Weight}_{MUT}$) for slip status detected by makeup torque:

$$\text{Weight}_{MUT} = \begin{cases} 1 & \text{inslip} \\ 0 & \text{outslip} \end{cases} \tag{8}$$

As to such weights, the detection from a hookload feature tends to be relatively trustful for most of the time and can be used as a base; thus, it can be given a standard weight (e.g., assuming 1 is the standard weight) to inslip (positive) and outslip (negative). Compared to the inslip status from the hookload feature, inslip status from SPPA tends to be less reliable. Hence, a lower weight 0.5 can be given to inslip status from SPPA. However, the outslip status from SPPA tends to be more reliable, which means it is more likely being outslip if SPPA is greater than SPPA threshold. Thus, a higher weight can be assigned to outslip status from SPPA. As to slip status from makeup torque, inslip status is meaningful compared to outslip status.

A combined weight can be the summation of individual weights, for example, per Eq. (9):

$$\text{Weight}_{total}=\text{Weight}_{HKLD}+\text{Weight}_{SPPA}+\text{Weight}_{MUT} \tag{9}$$

Table 1, below, lists 8 slip status combinations by 3 detection ways and the total weight calculated by Eq. (9).

The ultimate slip status can be determined by the sign of $\text{Weight}_{total}$: where positive weight means inslip and negative weight means outslip. In addition, the confidence level can be computed, for example, by Eq. (10):

$$\text{Confidence percentage}=\text{Weight}_{total}/2.5\times 100 \tag{10}$$

TABLE 1

Slip status total weight

| No. | HKLD | SPPA | MUT | $\text{Weight}_{total}$ |
|---|---|---|---|---|
| 1 | i | i | i | 2.5 |
| 2 | i | i | o | 1.5 |
| 3 | i | o | i | 0.5 |
| 4 | i | o | o | −0.5 |

TABLE 1-continued

| Slip status total weight | | | | |
|---|---|---|---|---|
| No. | HKLD | SPPA | MUT | $Weight_{total}$ |
| 5 | o | i | i | 0.5 |
| 6 | o | i | o | −0.5 |
| 7 | o | o | i | −1.5 |
| 8 | o | o | o | −2.5 |

TABLE 2

| Slip status confidence level | | | | |
|---|---|---|---|---|
| No. | HKLD | SPPA | MUT | Confidence |
| 1 | i | i | i | 100% |
| 2 | i | i | o | 60% |
| 3 | i | o | i | 20% |
| 4 | i | o | o | −20% |
| 5 | o | i | i | 20% |
| 6 | o | i | o | −20% |
| 7 | o | o | i | −60% |
| 8 | o | o | o | −100% |

As to Table 1 and 2, the inslip or outslip status depends on the sign of total weight in Table 1 and the confidence level of inslip or outslip are given by confidence percentage in Table 2.

As to confirmation examples: At the transition moment to inslip, the most possible detected combination is No. 4 where the hookload drops to block weight and SPPA is not off yet. In such a situation, the slip status will not be reported as inslip until SPPA is turned off which is No. 2. Though it may cause some time lag, the accuracy and confidence of slip detection are increased because the algorithm does not listen to just one voice (e.g., type of data, etc.). While calculating a KPI such as inslip duration, a method can trace back to the very beginning timestamp from hookload feature if desired.

As to an adjustment example by No. 5 case: If inslip before a new stand begins is not detected by a hookload feature somehow, the detected status shows outslip while the actual one is inslip. When this happens, it can cause wrong detection if relying on the hookload feature. With SPPA and makeup torque saying inslip, the algorithm can find out at makeup timestamp that the previous slip status is not valid. Then, the algorithm can trace back the onset of inslip timestamp from SPPA and use makeup timestamp as the end of inslip. Such an approach can adjust the invalid slip status per the hookload feature.

As an example, a method can implement a pipe change detection approach. For example, as long as slip status is detected accurately, pipe change detection can be achieved by recording and comparing the block moving distance between inslip and outslip timestamps. For example, criteria used in the algorithm can be as set forth in the example Eq. (11):

$$|BPOS(outslip)-BPOS(inslip)|>20 \text{ and}$$

$$|BPOS(outslip)-BPOS(inslip)|<140 \quad (11)$$

As to stand detection, where stand detection is desired, a stand detection component can be executed that uses inference result(s) from slip detection and pipe change detections.

Figure 25:
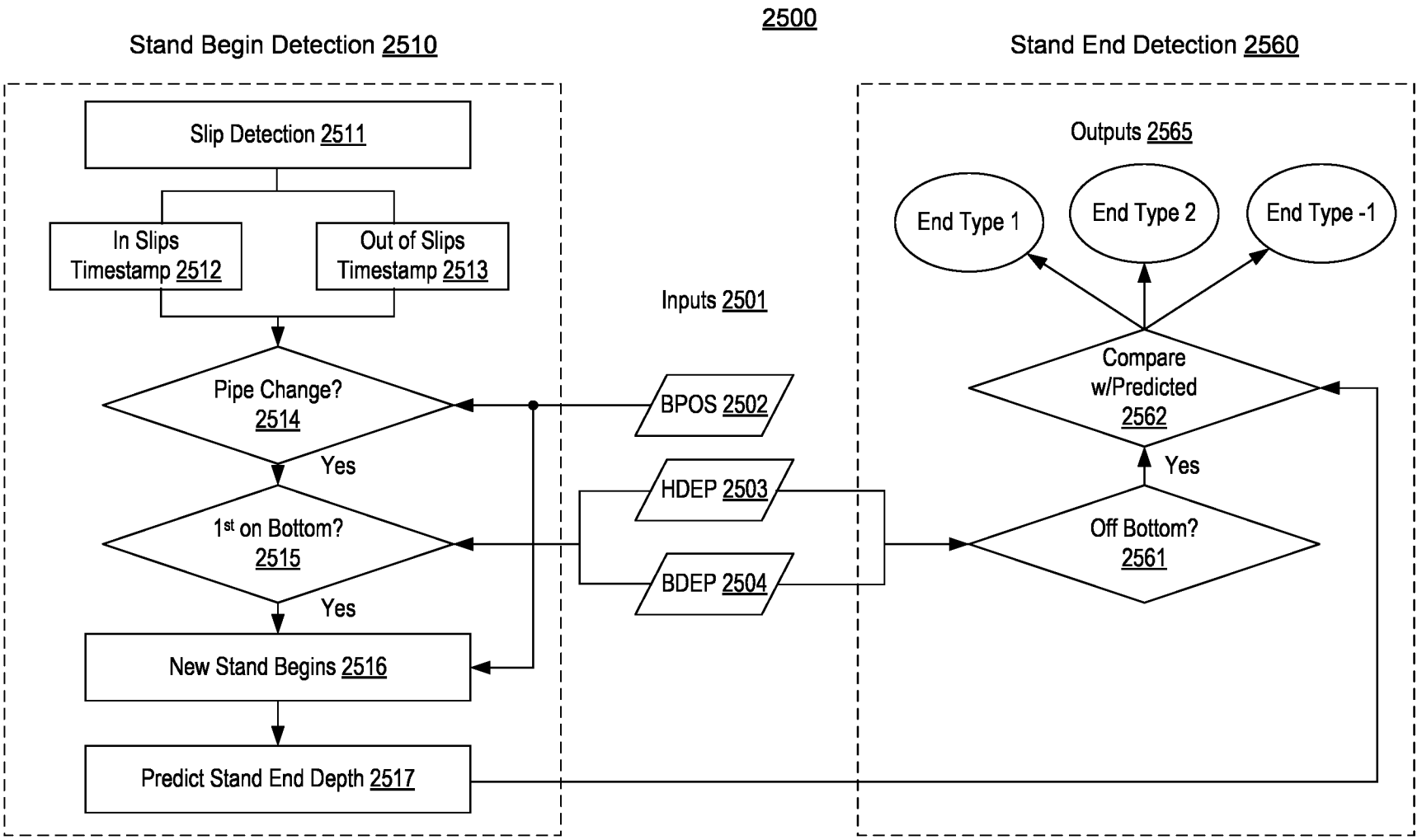
FIG. 25 illustrates an example of a method.

FIG. 25 shows an example of a method 2500 that includes logic of stand detection, including stand begin detection 2510 and stand end detection 2560. As shown, in FIG. 25, various data can be received as inputs 2501, which can include BPOS 2502, HDEP 2503 and BDEP 2504. As to the stand being detection 2510, it can operate using such data and can include a slip detection block 2511, timestamp blocks for in-slips time and out-of-slips time 2512 and 2513, respectively, a pipe change decision block 2514, a first on bottom decision block 2515, a new stand begin block 2516 and a predict stand end depth block 2517. As shown, the stand end detection 2560 can include an off bottom decision block 2561, a comparison block 2562 and one or more outputs 2565 that can be associated with different end types. As shown, the prediction block 2517 of the stand being detection 2510 can output a predicted stand end depth to the stand end detection 2560 for use by the comparison block 2562 such that an appropriate output be determined.

An article entitled "Automatic Slip Status and Stand Detection in Real-Time Drilling", by Zhao et al., Offshore Technology Conference (OTC-29372-MS), Houston, Tex., 6-9 May 2019, is incorporated by reference herein.

As to stand begin detection 2510, once a pipe change is detected per the decision block 2514, an algorithm can look for the next on bottom depth per the decision block 2515 as the begin depth of new stand per the block 2516. In such an approach, based on the recorded block positions at inslip and outslip timestamps of blocks 2512 and 2513, the end depth of this stand can be estimated per the prediction block 2517. As to stand end detection 2560, during one drilling stand, the bit may go off bottom multiple times, which can be handled by the decision block 2561. To infer stand end time and depth instantaneously, a method can include comparing the actual off bottom depth with predicted end depth from the block 2517. In such an example, 3 scenarios or outputs may exist, which may be explained as follows:

End type 2: most likely stand end if $$|\text{Actual off bottom depth}-\text{Predicted end depth}|<10 \text{ feet}$$

End type 1: usually not stand end unless the last drilling stand $$\text{Actual off bottom depth}-\text{Predicted end depth}<-10 \text{ feet}$$

End type −1: possibly false negative or data problem $$\text{Actual off bottom depth}-\text{Predicted end depth}>10 \text{ feet}$$

Various trials involved executing code written in MATLAB and C#. Trails included 11 datasets analyzed by MATLAB code and 5 datasets analyzed by C# code. Among 11 datasets, 9 datasets were provided with 1 s/data rate and 2 datasets as selected from OPTIDRILL framework runs with 1 to 2 s/data rate. Below is a list of test datasets by well number:

Well 43 (MATLAB, C#): starts from surface and ends at ~12200 feet MD including ~200 drilling stands and ~980 tripping stands. This well is a good dataset to test drilling stands at shallow depth, since it has ~40 stands at shallow depth (<2000').

Well 132 (MATLAB, C#): starts from surface and ends at ~12800 feet MD including ~215 drilling stands and ~3800 tripping stands. This well is a good dataset to test drilling stands at shallow depth, since it has ~35 stands at shallow depth (<2000').

Well 164 (MATLAB, C#): starts from surface and ends at ~16500 feet MD including ~250 drilling stands and ~5700 tripping stands. This well has ~30 drilling stands at shallow depth (<2000').

Well 168 (MATLAB, C#): starts from ~1800 feet and ends at ~18000 feet MD including ~180 drilling stands and ~1620 tripping stands. This well has a few drilling stands at shallow depth (<2000').

Well 176 (MATLAB, C#): starts from ~1800 feet and ends at ~18000 feet MD including ~170 drilling stands and ~1460 tripping stands. This well has a few drilling stands at shallow depth (<2000').

Well 74 (MATLAB): starts from surface and ends at ~14000 feet MD including ~180 drilling stands and ~1430 tripping stands. This well is a good dataset to test drilling stands at shallow depth, since it has ~30 stands at shallow depth (<2000').

Well 90 (MATLAB): starts from ~300 feet and ends at ~9400 feet MD including ~210 drilling stands and ~1220 tripping stands. This well is a good dataset to test drilling stands at shallow depth, since it has ~40 stands at shallow depth (<2000').

Well 92 (MATLAB): starts from ~1800 feet and ends at ~17000 feet MD including ~160 drilling stands and ~930 tripping stands.

Well 105 (MATLAB): starts from ~1900 feet and ends at ~16500 feet MD including ~155 drilling stands and 0 tripping stands.

DMM run 26 (MATLAB): a couple of stand around 10000 feet with high block weight around 200 klbf and hookload high around 600 klbf to test the initialization of the algorithm to detect such dataset with large hookload range DMM run 156 (MATLAB): 10+ stands around 31000 feet with high block weight around 260 klbf and hookload high around 1200 klbf to test the initialization of the algorithm to detect such dataset with large hookload range Trial runs demonstrated that detection accuracy tends to decrease with a decrease of sampling rate. The datasets starting from tripping in and tripping out were created from partial data of well 43 and tested.

Various examples of parameters and examples of parameter values are given in Table 3.

TABLE 3

| Parameters | |
|---|---|
| Parameter name | Parameter value |
| Shallow/deep depth boundary | 2000 ft |
| Minimum initial HKLD SD Thd | 10 klbf |
| Maximum initial HKLD SD Thd | 50 klbf |
| Initial HKLD High | 200 klbf |
| Initial HKLD Low | 40 klbf |
| Initial HKLD Thd | 100 klbf |
| Sliding window | 15 s |
| SPPA threshold | 300 psi |
| Makeup torque candidate threshold | 10 klbf-ft |
| HKLD SD Thd for Tripping | 10 klbf |

As an example, a method can include automatic classification of slip states using a self-calibrating technique. As an example, such a method can be implemented using a system that can receive various types of data during rig operations.

As an example, a method can automatically identify the status of slips during well construction operations and utilize a self-calibration mechanism that adapts itself for dynamic changes in a data stream for the automatic calibration of a classification model.

As an example, a system can include an online classifier that aims to classify the state of slips based on HKLD data, which can be acquired using one or more types of rigsite equipment. For example, consider using one or more load sensors (e.g., load cells, etc.). As explained with respect to FIG. 6, equipment can include one or more load sensors such as the load sensor 650. As an example, equipment that includes a load sensor and a processor with memory can be programmed using software and/or hardware to generate slip status. For example, a "smart" drawworks can provide for generation of slip status using data acquired from a load sensor. As mentioned, equipment can include an encoder, which may be a digital encoder. For example, consider a geolograph that implements a rotary encoder where a sensor is based on a roll of steel line attached to structure of a derrick (e.g., near a crown block) and the other end attached directly to a travelling block. In the geolograph, line unwinds through a wheel of known circumference whose shaft is connected to a rotary encoder. The rotational movement is translated into pulses that can be tracked to compute block position from a given reference point.

As an example, a system can generate output as a classifier slip state that can be dependent on the level of hookload that is affected by the process of setting the drill string in-slips (in-slips state) or taking the total load of the drill string onto a traveling block (out-of-slips). As an example, a classification may be performed using one or more types of updates of internal statistics that rely on a detection mechanism of possible connections, for example, which uses the data channels of hookload, top drive (TD) rotation and block position.

As an example, a drawworks or other suitable equipment can include a data interface or data interfaces for receipt of sensor data for HKLD, RPM-TD, and BPOS. For example, consider a load sensor, an encoder and a RPM signal. In such an example, the equipment can output slip status, which may be utilized for controlling one or more operations, marking data, other classifications, etc.

As an example, a traveling system may include a load sensor, a position sensor and an RPM sensor. Such a traveling system may be part of a top drive assembly. For example, consider a top drive assembly that includes a load sensor and a position sensor along with a signal from a speed controller for the top drive and/or a speed sensor. In such an example, the top drive assembly can provide for generation of slip status.

As to classification of rig operations, such operations can be complex and quite varied. For example, operation specifics can evolve through various phases of well construction. A timely and accurate slip status can facilitate downstream computations like bit on bottom or depth which can affect various aspects of operations and/or processing data associated with such operations.

As an example, a method can be trained using historical data such that it can mimic real-time operations where self-calibrations can occur as time advances such that a classifier is a dynamic classifier for aiding in-slips status detections.

As an example, a system can provide for implementation of a robust method to compute slip state on an online data stream in a well construction process, which can be used in equipment control as well as in downstream algorithms like depth and bit on bottom computations.

As an example, a method can automatically identify slip state based on surface sensor measurement of HKLD, BPOS and RPM-TD. Slip state defines where the drill string weight rests. If the drill string weight rests on travelling block, it is out-of-slips (OOS) and if it rests on slips, it is in-slips (IS). A classification can be utilized for one or more purposes, for example, consider one or more control decisions, downstream computations, well construction decision processes, etc.

As explained, a rigsite system can be evolving, which can result in changes in internal statistics of the rigsite system over time. For example, as pipes are added or removed from the drill string, its total weight goes up or down. This phenomenon is especially visible during tripping operations as pipes are added or removed from the drill string in short periods of time. To address such changing conditions, a system can be adaptive (e.g., self-calibrating, etc.) to provide for robust classification of slip states.

As an example, a method can include receiving time-series data and processing such data through a machine model that builds initial statistics based on a probabilistic understanding of connections. As an example, such a method can assign "unknown" to slip status until this initial statistic is built (e.g., using data from operations for a number of pipes, a number of stands, etc.). Once the initial statistics is built, the machine model may be considered to be a trained machine model suitable for use in online classification as to slip status using a real-time data stream. As an example, a system may be self-triggering based at least in part on analysis of received data. For example, consider an online update of statistics that occurs responsive to a new connection being added to a drill string, which may be detected from received data. In such an example, the statistics can better follow an evolving trend of the system and keep a machine model relevant over time better than if a fixed threshold was utilized.

As an example, a system can classify slip state in an online manner from real-time data sets where, for example, results may be compared with a labeled data set for validation (e.g., periodic validation, etc.).

Figure 26:
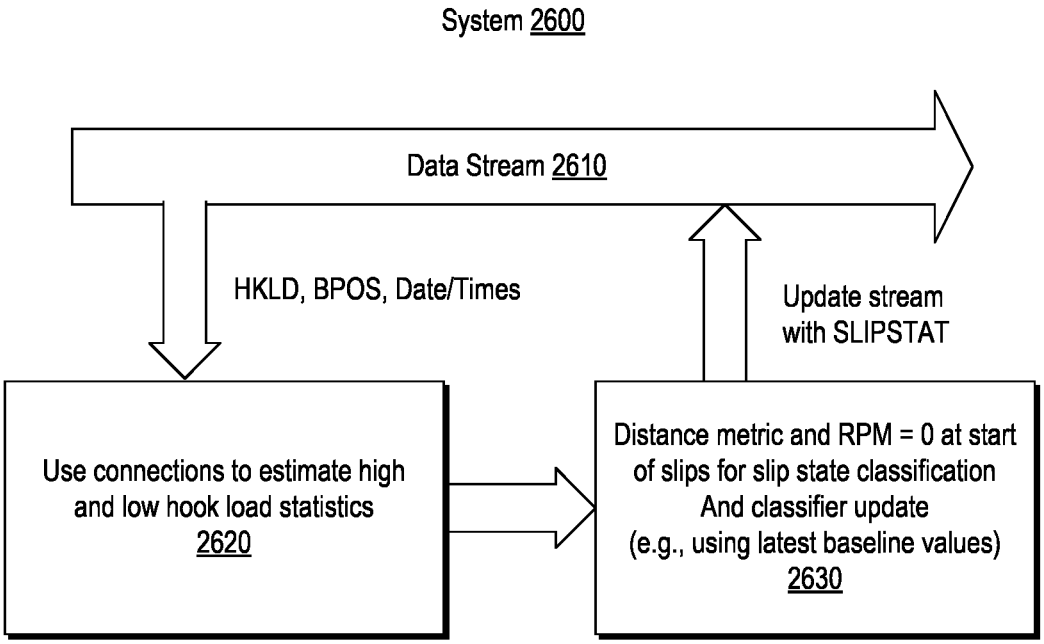
FIG. 26 illustrates an example of a system.

FIG. 26 shows an example of a system 2600 that includes blocks 2620 and 2630 as operatively coupled to a data stream 2610. As shown, HKLD, BPOS and date/times from the data stream 2610 can be utilized by the block 2620 for using connections to estimate hand and low hookload statistics where high pertains to high values of hookload and low pertains to lower values of hookload as may be experienced during rig operations where slips are utilized to bear weight of a drill string. As to the block 2630, it can utilize a distance metric and RPM of zero at the star of slips for slip state classification. In such an example, the data stream 2610 may provide data such as top drive RPM data. The block 2630 can output slip status as, for example, "SLIPSTAT" to the data stream 2610, which may be utilized by one or more other processes.

A system can include two parts that can operate in an iterative cooperative loop, where one part is a learning part and the other par is a classification part. For example, in the system 2600 of FIG. 26, the block 2620 can be a learning part and the block 2630 can be a classification part. As explained, a system may be resident (e.g., implemented within) a piece of equipment or pieces of equipment. As an example, a drawworks may be a piece of equipment that can include sensors for generation of HKLD data and BPOS data. In such an example, the drawworks may include the block 2620. As an example, such a drawworks may receive top drive RPM data and/or may transmit output (e.g., statistics, a trained machine model, etc.) to a top drive controller such that the top drive controller may generate the SLIPSTAT, which can be transmitted to one or more other devices, etc., via a data bus or data busses (e.g., wired and/or wireless).

In the example of FIG. 26, the data from data stream can be passed through the block 2620, which can include machine learning features that tries to detect a possible connection. For example, a condition for a possible connection can be hookload dropping from a high state to a low state and a block moving up or down (e.g., depending on whether a pipe is added or removed) with no rotation during a hookload transition.

Figure 27:
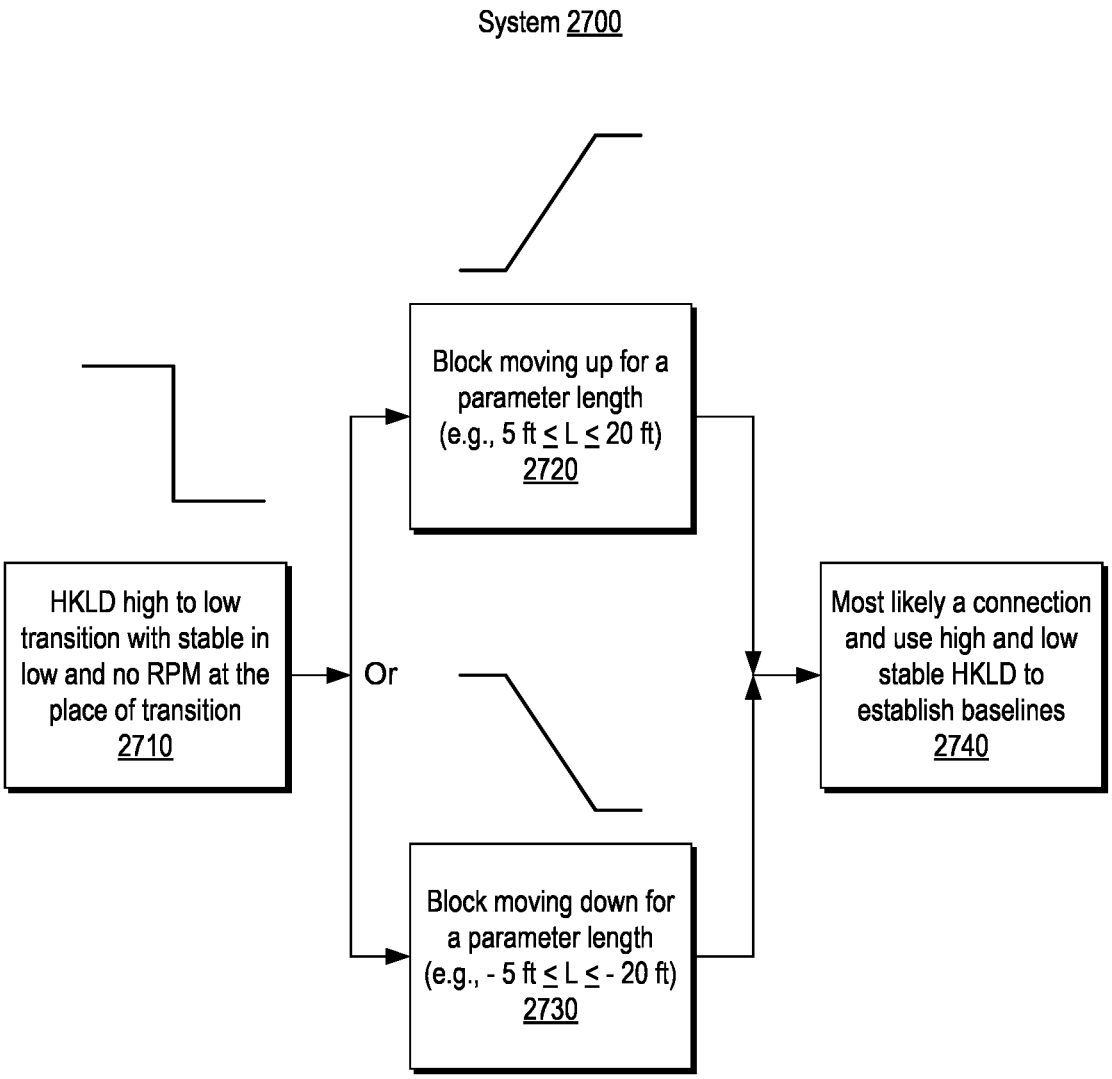
FIG. 27 illustrates an example of a system.

FIG. 27 shows an example of a system 2700 that includes logic for assessing connections. For example, the system 2700 can include a HKLD transition block 2710 that can analyze data for a HKLD high to low transition with respect to time with stability in low and no RPM at the place of transition, a traveling block moving up block 2720 that can analyze data for a traveling block moving up for a parameter length (e.g., in a range from approximately 5 feet to 20 feet), a traveling block moving down block 2730 that can analyze data for a traveling block moving down for a parameter length (e.g., in a range from approximately −5 feet to −20 feet), and a detection block 2740 that can utilize analyses from the block 2710 and the block 2720 or the block 2710 and the block 2730 to detect a connection, for example, a most likely connection using the high and low stable HKLD to establish baselines. As explained, a single, static threshold approach to slip status can lack accuracy, particularly at shallow depths (e.g., less than approximately 3000 feet or 1000 meters, depending on the type of formation, etc.).

Figure 28:
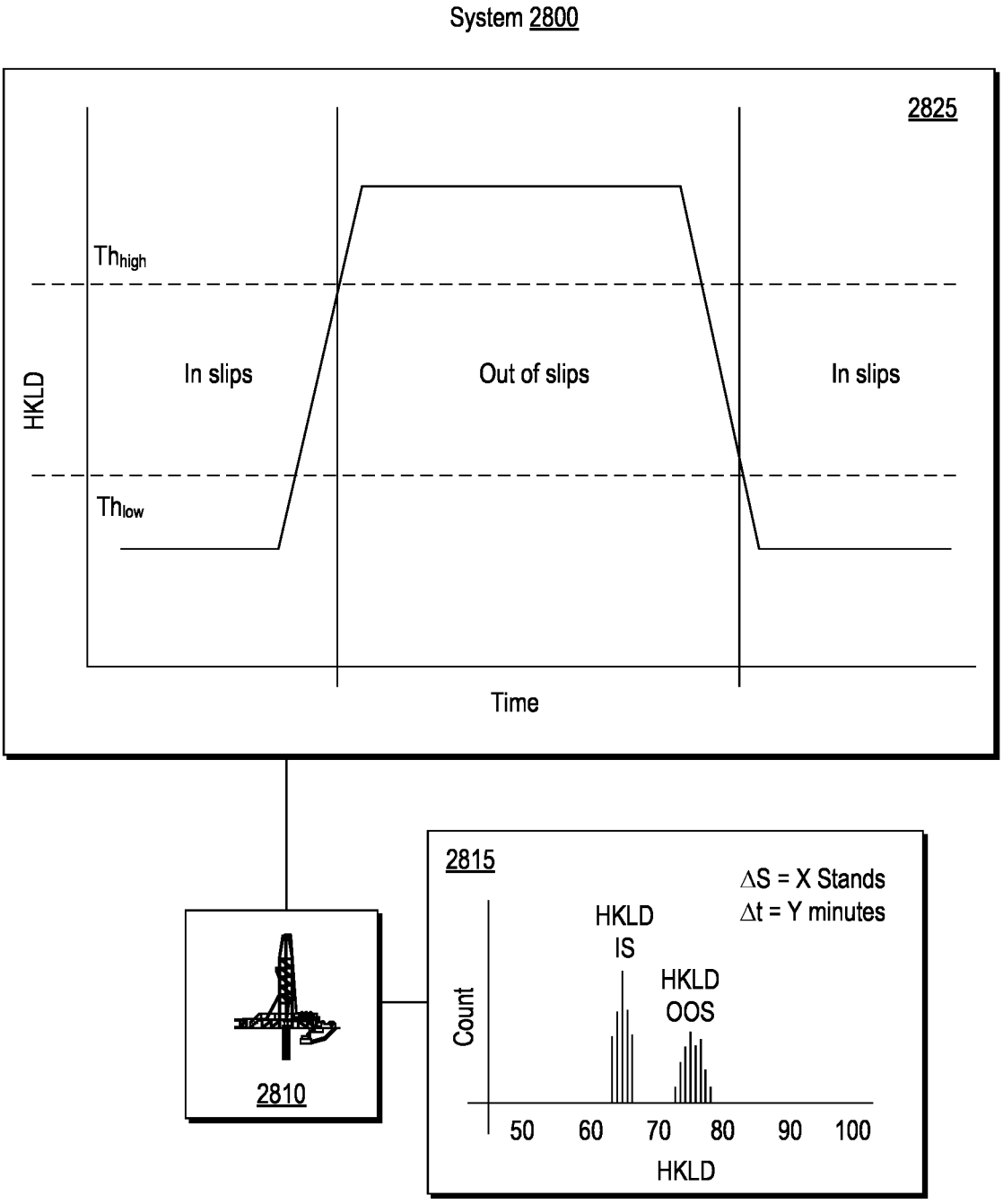
FIG. 28 illustrates an example of a system and examples of graphical user interfaces.

FIG. 28 shows an example of a system 2800, which may include instructions executable to render one or more graphics, graphical user interfaces (GUIs), etc., to one or more displays. For example, consider the system 2800 as including rig equipment 2810 that includes one or more processors and memory storing instructions executable to receive sensor data and to generate one or more GUIs 2815 and 2825. In the example of FIG. 28, the GUI 2815 shows counts for HKLD readings for a number of stands and/or for an amount of time where a cluster is shown in association with HKLD in-slips (IS) and another cluster is shown in association with HKLD out-of-slips (OOS). As an example, the GUI 2815 can be generated as part of a classification component of the system 2800. Such time series data may be utilized to determine a value or values of a high hookload that corresponds to OOS and/or a low hookload that corresponds to IS. As explained, one or both of such values may be utilized to determine a threshold or thresholds. For example, percentages (e.g., or fractions) of a high hookload value (e.g., a value determined statistically, etc.) from a plurality of data points may be utilized to set a high threshold ($Th_{high}$) that detects a transition from IS to OOS using a real-time stream of HKLD data and may be utilized to set a low threshold ($Th_{low}$) that detects a transition from OOS to IS using the real-time stream of HKLD data.

As explained, the system 2800 can include logic for operations that utilize more than one single threshold, for example, consider the low threshold ($Th_{low}$) and the high threshold ($Th_{high}$). In such an example, one or more of the thresholds can be dynamic. For example, a dynamic threshold can change automatically during operations (see, e.g., the GUI 2815 where the clusters can change responsive to receipt of a real-time stream of HKLD data). As an example, a dynamic threshold can be part of a self-calibrating system. In various scenarios, a low threshold may be dynamic due to behavior of equipment during operations and/or a high threshold may be dynamic due to behavior of equipment during operations. As mentioned, drilling operations at shallower depths tend to cause equipment behaviors that can differ from equipment behaviors at deeper depths. And, formation types, types of drilling, etc., may have effects on behaviors. As an example, the system 2800 can utilize one or more criteria to control classification, threshold determination, etc. For example, consider a system that can reset the counts for one or more of HKLD IS and HKLD OOS based on depth, time, number of stands, length of pipe, number of BPOS changes, sum of BPOS over a period of time, etc.

As an example, statistics may be reset (e.g., forgotten) responsive to detection of tripping out and tripping in where a change occurs in a BHA, which may be determined using a pre-change HKLD and a post-change HKLD. For example, for a given bottom hole depth (e.g., measured depth), tripping out and tripping in can involve the same number of stands such that weight may be expected to be the same for the stands. Where an old BHA is replaced with a new BHA, a difference in weight may be detected, which may reset (e.g., forget) at least high baseline data for drilling operations associated with the old BHA. As an example, where a weight difference is known between an old BHA and a new BHA, the statistics (e.g., prior data with the old BHA) may be adjusted according to the weight difference. For example, where an increase of X lbf is noted, a high baseline may be increased by X lbf. As an example, a reset and/or an adjustment may occur responsive to replacement of a top drive. As a top drive can be suspended by a traveling block and be part of a low baseline, an adjustment may be made to low baseline statistics. As explained, one or more changes may be taken into account to adjust and/or reset one or more baselines and/or thresholds.

In the example system 2800 of FIG. 28, the high threshold provides for detection of a transition from in-slips or in-slips (IS) to out-of-slips or out-of-slips (OOS) and the low threshold provides for detection of a transition from OOS to IS. In such an approach, the detection time for IS to OSS (IS-OOS) may be considered late as to when weight is released from the slips and the detection time for OOS to IS (OOS-IS) is also shifted from the time at which the slips start to bear weight (e.g., as sensed via a load sensor on a deadline, drawworks, top drive assembly, etc.).

As an example, one or more pieces of equipment may include one or more embedded sensors and/or processors that can provide for slip status determinations. As explained, a drawworks can include an encoder on a drum that can determine block position (e.g., BPOS estimation) and/or a top drive assembly can include at least a portion of a position sensor (e.g., machine vision, accelerometer, etc.). Such equipment may also include one or more load sensors (e.g., load cells) that can output weight such as one or more of HKLD weight, block weight (BLK WT), etc. As an example, a system can provide for machine learning, which can be dynamic and operate in real-time for improved slip status.

As explained with respect to the system 2700 of FIG. 27, a method can include detecting a successful possible connection that establishes hookload baselines which correspond to possible high and low states of hookload. In such an approach, high states can be hookload levels during out-of-slips (OOS) and low states can be hookloads during in-slips (IS) (see, e.g., the GUI 2815). As an example, each of such baselines can be modeled as a probability distribution that can evolve over time as the system changes. For example, consider using a Gaussian distribution that can evolve over time where, for example, a 1D approach may utilize a Gaussian mixture model where one Gaussian distribution is utilized for hookloads in-slips (IS) and another Gaussian distribution is utilized for hookloads out-of-slips (OOS).

As explained with respect to the system 2800 of FIG. 28, such baselines can be thresholds suitable for use by a machine model that can classify hookload into discrete states (e.g., slip status). Before baselines are established, a system may have a machine model in an untrained or partially trained state such that classifications output are "unknown" (e.g., or "waiting"). In such an approach, once the baselines are established, a trained machine model can determine that a slips state transition occurs when the hookload value leaves the top or bottom per an appropriate threshold or thresholds (e.g., 65 percent of the total hookload low-high range respectively for out-to-in or in-to-out slips transition, etc.). As an example, a method can include, when moving from low to high, the hookload has to cross an 85 percent mark to be considered a successful transition from OOS to IS and when moving from high to low, it has to cross a 15 percent mark to be considered a successful transition from IS to OOS. In such an example, the 85 percent mark (e.g., threshold) can be 85 percent of a high baseline and the 15 percent mark (e.g., threshold) can be 15 percent of a high baseline. In such an example, classification using low and high baselines can help to make the high baseline more accurate. Inclusion of a low baseline in a classifier can help to capture data that are not part of a high baseline. Further, such an approach can help to address noise in data.

Referring again to the system 2800 of FIG. 28, example transitions between IS-OOS and back OOS-IS are shown where the boundaries of 65 percent and 35 percent are determined as avoiding impulsive transition on noisy operating conditions of a sensor. As an example, a range may be utilized from approximately 51 percent to approximately 95 percent for a high threshold and a range may be utilized from approximately 3 percent to approximately 49 percent for a low threshold. As an example, a method can include tailoring percentages where, for example, one or more false detections occur. For example, where a false detection occurs, a high threshold may be increased and/or a low threshold may be decreased such that a spread between the thresholds is increased. As an example, a spread between the thresholds can be in a range of approximately 2 percent to approximately 90 percent. In various examples, a spread can be approximately 30 percent (e.g., 65 minus 35) and approximately 70 percent (e.g., 85 minus 15). As an example, a spread may be in a range of approximately 20 percent to approximately 80 percent.

As explained with respect to the system 2600 of FIG. 26, a learning part 2620 and a classification part 2630 can operate as desired. For example, whenever a new connection is detected, the learning part 2620 can updates internal statistics of the baseline, which can be transmitted to the classification part 2630. The update of the statistics can be useful where an upper envelope of the hookload changes substantially over time. For example, an upper envelope may be represented as a Gaussian distribution that evolves over time whereas a lower envelope may be represented as a Gaussian distribution that exhibits lesser evolvement over time (e.g., a more stable distribution with a lesser standard deviation, etc.).

Figure 29:
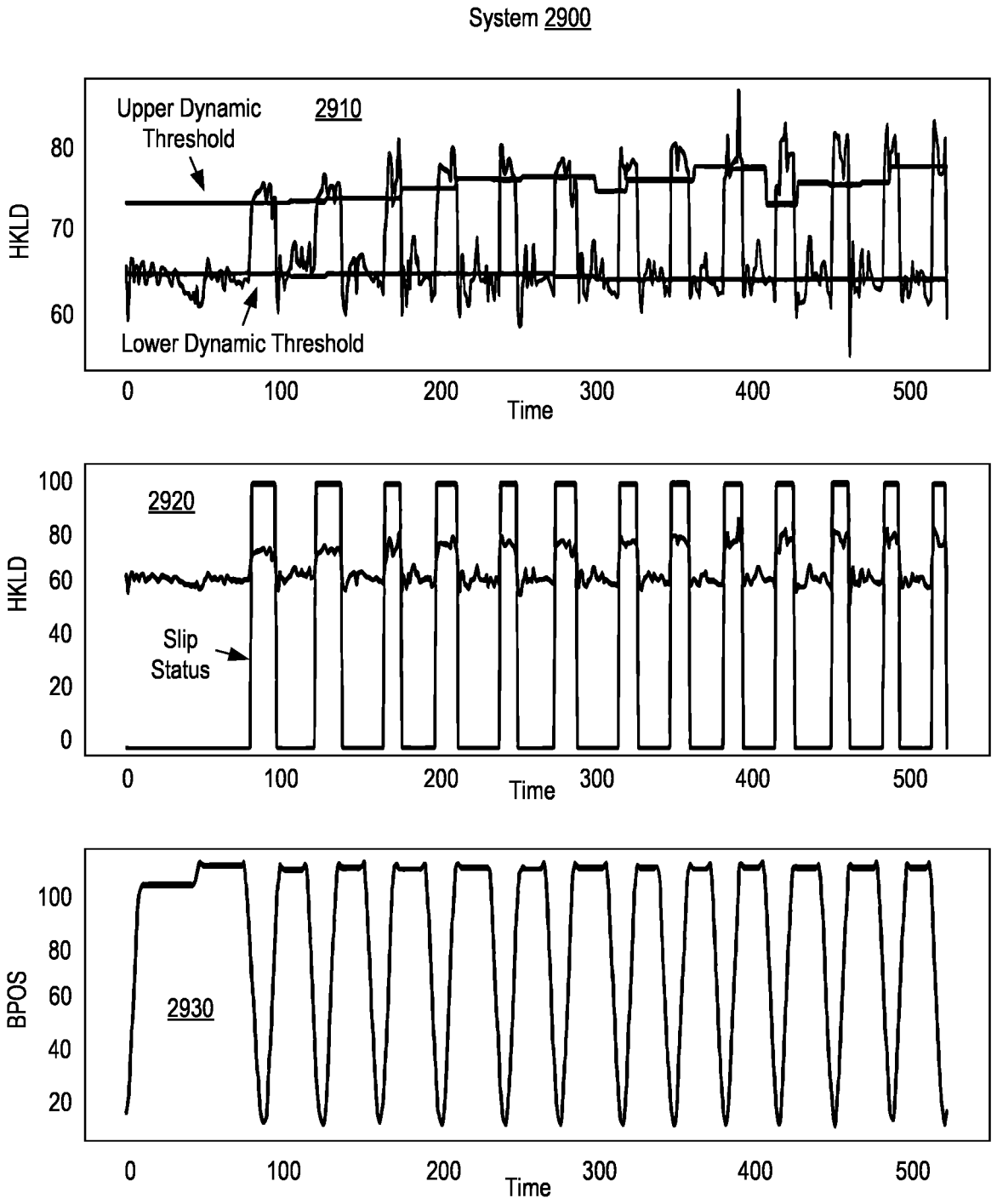
FIG. 29 illustrates an example of a system.

FIG. 29 shows an example of a system 2900 that can generate one or more dynamic classification metrics for determining slip status where the system 2900 may provide for generation of one or more graphics, graphical user interfaces (GUIs), etc. For example, the system 2900 can generate one or more GUIs renderable to a display or displays that show HKLD with respect to time along with one or more dynamic thresholds 2910, that show HKLD with respect to time along with slip status (e.g., in a dual state approach of IS and OOS) 2920, and that show BPOS with respect to time 2930.

In the GUI 2920, the slip status (e.g., slip state) is converted to a discrete value that is scaled to 100 where 100 is out-of-slips (OOS) and 0 is in-slips (IS). In the GUI 2930, the BPOS data provide indications of activity looks like tripping. Thus, in the GUI 2910, the upper dynamic threshold changes during tripping while the lower dynamic threshold changes less.

As an example, an operator may view the GUIs 2910, 2920 and 2930 to understand slip status and its underlying reasoning using one or more of HKLD data, dynamic threshold(s), and BPOS. As explained, physical, operational relationships can exist between HKLD, BPOS and slip status. As explained with respect to various examples, one or more other types of data may be utilized. For example, consider use of torque data (e.g., STOR or M/U Torque).

Referring again to the example system 2800 of FIG. 28, which can be for a single transition cycle (IS-OSS and OSS-IS), classification can be achieved using identified baselines, which can be dynamically updated (e.g., self-calibrating, etc.). As an example, a method can include, for each hookload data point from a data stream, using a classifier to compare the data point to one or more thresholds, which as shown in the example of FIG. 28, include a 65 percent boundary and a 35 percent boundary for high and low baselines, respectively. In such an approach, depending on which side of the boundary the data point lies, a label can be generated as to either out-of-slips (OOS) or in-slips (IS) (see, e.g., the GUI 2920 of FIG. 29).

As explained, by relatively continuously learning one or more baselines, a system can be resilient to changing system dynamics, which may include poor quality sensor data, outliers over time, etc. Such a system can provide for robust classification on which downstream computations and controls can depend.

As an example, a classifier can be a machine learning model that can learn from data and provide an output using data. In such an example, data can be or include time series data, which may be 1D data with respect to time.

As an example, a k-means approach may be utilized for a classifier. For example, a k-means problem can be solved using the Lloyd's algorithm, the Elkan's algorithm, or another suitable algorithm. The scikit-learn framework includes package for k-means computations (sklearn.cluster.KMeans), which includes an algorithm specification as follows: algorithm{"auto", "full", "elkan"} where the default="auto". The Elkan variation can be more efficient on data with relatively well-defined clusters, for example, by using the triangle inequality. However, the Elkan variation tends to be more memory intensive due to the allocation of an extra array of shape (e.g., n_samples, n_clusters). The average complexity is given by O(k n T), were n is the number of samples and T is the number of iteration and the worst case complexity is given by O(n^(k+2/p)) with n=n_samples, p=n_features.

In practice, the k-means algorithm tends to be fast though it can falls in local minima, which may demand restarting. As an example, a method can include restarting a classifier such that it forgets or substantially forgets a baseline or baselines. As an example, consider an operational change in operations at a rig site (e.g., drilling to tripping, tripping to drilling, etc.) where upon detection of a change or other instruction of a change, a classifier forgets or at least partially forgets as to one or more baselines. As noted, a threshold may be based on a baseline or on baselines. For example, consider an upper threshold as being a fraction of an upper baseline and a lower threshold as being a smaller fraction of an upper baseline. As shown in the GUI 2910, during tripping, changes can occur in an upper baseline where an upper threshold may be based on the upper baseline.

The k-means algorithm can be implemented to cluster data by trying to separate samples in n groups of equal variance, minimizing a criterion known as the inertia or within-cluster sum-of-squares. The k-means algorithm can receive as input a number of clusters. For example, for slip status, two clusters can be utilized, which can be specified as a default value of a classifier.

The k-means algorithm can divide a set of N samples X into K disjoint clusters C, for example, where each is described by the mean of the samples in the cluster. Each of the means may be a cluster "centroid". A k-means approach can aim to choose centroids that minimize the inertia, or within-cluster sum-of-squares criterion:

$$\sum_{i=0}^{n} \min_{\mu_j \in C} (\|x_i - \mu_j\|^2)$$

An approach to k-means may be referred to as Lloyd's algorithm, which can include three processes: choosing the initial centroids, with the most basic method being to choose samples from a dataset; after initialization, looping between two other processes, where one assigns each sample to its nearest centroid and the other creates new centroids by taking the mean value of the samples assigned to each previous centroid. In such an approach, the difference between the old and the new centroids can be computed where the algorithm repeats these last two processes until the value is less than a threshold. In other words, it can repeat until the centroids do not move within some amount, which may be statistical, predetermined, etc.

As explained, a k-means approach can include clustering of rigsite data into two clusters, where one cluster is a high cluster and the other cluster is a low cluster. In such an example, the high cluster can be a high baseline and the low cluster can be a low baseline. As explained, a threshold or thresholds may be based on one or more baselines.

As mentioned, an initial number of high and low cycles may occur for equipment operations at a rigsite such that a classifier can learn from that initial number of cycles. As explained, one or more conditions may occur where forgetting and/or relearning occurs, for example, with a new initial number of cycles. As explained, during operations, a classifier can dynamically learn.

As an example, a dynamic learning classifier can be operable using a forgetting factor as to data, which, as explained can be time series data. For example, consider a buffer or number of cycles that can be utilized. As an example, consider a circular buffer where data in the circular buffer are utilized for clustering to derive one or more baselines, for example, consider two baselines, including a high baseline and a low baseline that can correspond to physical operations. At each connection or number of connections, etc., or other event, recalculation of clusters may occur using data that exist in the circular buffer. As an example, a circular buffer may be of an adjustable size, which may be automatically adjustable, semi-automatically adjustable, manually adjustable (e.g., via GUI input, etc.), etc. As another example, consider a forgetting factor that can forget data using one or more criteria such as, for example, one or more of time, number of stands, a type of event, etc.

As explained, equipment can evolve in its behavior, particularly where drilling progresses from surface to deeper depths. As explained, behavior at shallow depths (e.g., less than 3000 feet or 1000 meters, depending on equipment and/or formation characteristics) may differ from behavior at deeper depths. As an example, a forgetting approach or reset approach may be triggered by depth, formation type, equipment, etc. For example, consider a reset that causes initial learning to recommence at a given depth. As another example, consider a section-by-section approach to resetting where, upon changing a BHA, a reset occurs. In such an approach, each BHA can develop its own dynamic clusters and hence dynamic baseline(s).

As an example, once the online learning part 2620 is able to establish high and low baselines, these values can be passed on to the classification part 2630. In such an example, the classification part can use one or more these baselines to construct, for example, an 85 percent of the high baseline as an upper threshold and a 15 percent of the high baseline as a lower threshold. In such an approach, as the high baseline may be less steady than the low baseline, the upper and the lower thresholds can be generated in a manner that captures such unsteadiness. As explained with respect to the GUI 2910 of FIG. 29, the low threshold can be more stable than the high threshold. However, using the upper baseline for both high and low threshold determinations can capture behavior associated with a "most" unstable baseline. In a k-means approach, a plot of clustered data may show that a high baseline cluster is spatially larger, for example, a mean or centroid with a larger standard deviation than a standard deviation of a mean of a low baseline cluster.

As explained, boundaries can be used as crossing boundaries to decide when a transition is from in to out-of-slips (IS-OSS) and vice versa (OSS-IS). For example, when moving from low to high, the hookload has to cross the 85 percent of the high baseline boundary to be considered a successful transition from out to in-slips (OOS-IS) and when moving from high to low, it has to cross the 15 percent of the high baseline boundary. As shown in the example of FIG. 28, boundaries can be vertical lines that define IS and OOS with respect to time.

As an example, a system may provide for detection of a sticky transition, which is different from a simplistic transition that uses a single boundary crossing where above the boundary is considered out-of-slips (OOS) and below is in-slips (IS). As an example, a sticky transition approach can exhibit and/or account for some amount of hysteresis.

While transition detection appears asymmetrical, there can be benefits in that risk of detection of spurious slips transitions can be reduced, especially in hookload signals with noise. As explained, one or more types of physical and/or electrical phenomena may introduce noise. For example, consider vibration of equipment that may include a load sensor where vibration of the load sensor introduces noise. As another example, consider wire (e.g., cable) dynamics which may take on slack and then "snap" on re-taking load. As explained, a classifier approach that classifies using multiple baselines can help to reduce the incidence of false detection, particularly in a shallow section of a well where a hookload sensor tends to create a noisy signal. Again, as explained, at shallower depths, the number of pipes (e.g., stands) may be fewer and hence the weight of a drill string less than for deeper depths. As explained, a weight of a traveling block can be taken into account. Where a drill string weighs more, as generally at deeper depths, its weight can become much larger (e.g., progressively) than the weight of the traveling block. As such, movements of the traveling block that may generate noise in a load sensor may be diminished as the weight of a drill string increases. One or more other of various phenomena may cause noise. As explained, friction between a drill string and a borewall, deviation of a trajectory (e.g., horizontal drilling), etc., can lead to some phenomena that can introduce noise. A robust classifier for slip status that is robust due to improved immunity to noise can improve one or more rigsite operations and/or one or more other operations (e.g., data processing, etc.).

As in to out or out to in-slips transitions (IS-OOS and OOS-IS) tend to be of the order of seconds, such transitions can amortize the cost of asymmetric transition detections (see, e.g., the asymmetry in the graphic of FIG. 28). As explained, a classifier can be a "distance" based classifier where "distance" is a metric in a data sense, for example, in a cluster space.

Figure 30:
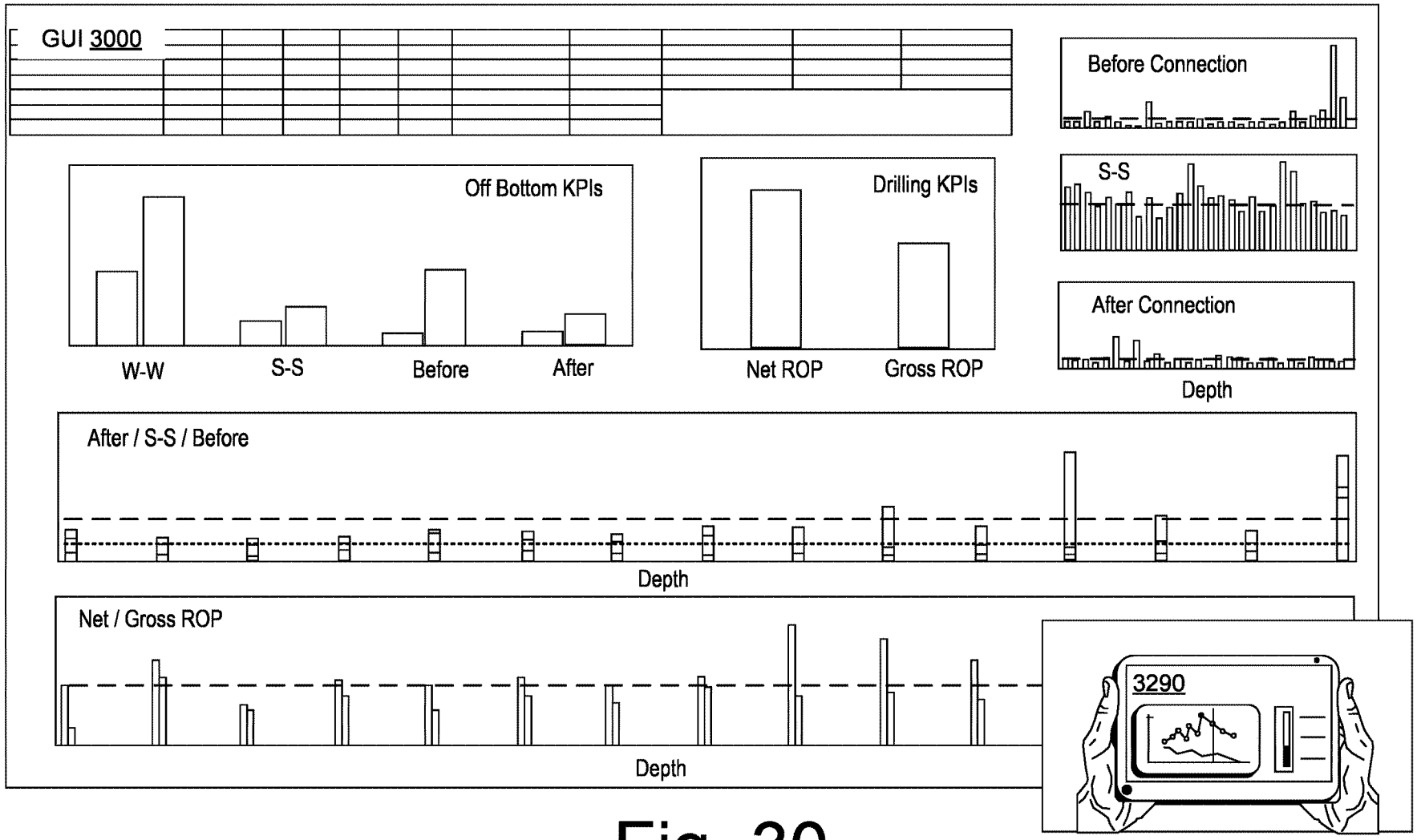
FIG. 30 illustrates an example of a graphical user interface and an example of a computing device.

FIG. 30 shows an example of a graphical user interface (GUI) 3000 that shows a Drilling Analyst KPI Analysis Report, which may be rendered, for example, via a display of a mobile device 3090. As an example, such a report may be generated on a daily or other time basis (e.g., 12 hr. or 24 hr. shift report for client). As an example, a report may filter unrepresentative connection times. As an example, information in the GUI 3000 may be generated by a system such as, for example, the system 1000 of FIG. 10 and/or one or more other systems (e.g., FIG. 26). As an example, such a GUI may include a feedback control that allows information to be transmitted to a system that includes or is operatively coupled to an interpretation engine such as, for example, the interpretation engine 1012 of FIG. 10. In such an example, the interpretation engine can learn from the feedback, whether such feedback is positive, neutral or negative. Positive feedback may indicate that the interpretation engine is operating in an acceptable manner, neutral feedback may be an indication that information has been reviewed and/or received without comment and negative feedback may indicate that one or more outputs of an interpretation engine can be improved (e.g., via further training, etc.).

As an example, a "smart" drawworks and/or a top drive assembly may include circuitry for wireless communications. For example, consider BLUETOOH circuitry that can pair with a device such as a mobile device for transmission of information. As an example, a mobile device may include an app that can receive data from drawworks and/or a top drive assembly where the data can include one or more of baselines, classifier statistics, slips state, etc. (e.g., consider one or more API calls from the app to equipment). As an example, such an app can render a graphical user interface that may provide for viewing statistics and/or other information and, for example, resetting statistics such that a machine learning model is retrained. For example, consider an app that can render a GUI for retraining a k-means classifier for determination of at least one baseline using HKLD data, which may be, for example, from a load sensor or load sensors of one or more types of equipment at a rigsite. For example, consider the GUI 2815 and/or the GUI 2825 of FIG. 28 as being rendered to a mobile device such that one or more decisions can be made and/or reviewed as to operation of a computing system that can determine slips state using HKLD data (e.g., via a machine learning model). Such an approach can provide for on-site control, which may be convenient after changing a BHA, drilling deeper into a formation, experiencing an unacceptable level of noise, etc. As an example, an API call may be made by an app executing at least in part on a mobile device where the API call can call for data and/or call for control of equipment, where such control may include controlling a machine learning model as to training, re-training, etc. For example, consider an app that can render a reset graphic control to a display of a mobile device where actuation of the reset graphic control transmits an instruction (e.g., via an API call, etc.) that causes a reset of a classifier (e.g., a reset of statistics, etc.) where upon reset the classifier is re-trained using time series data from rig operations (e.g., HKLD data, etc.).

Figure 31:
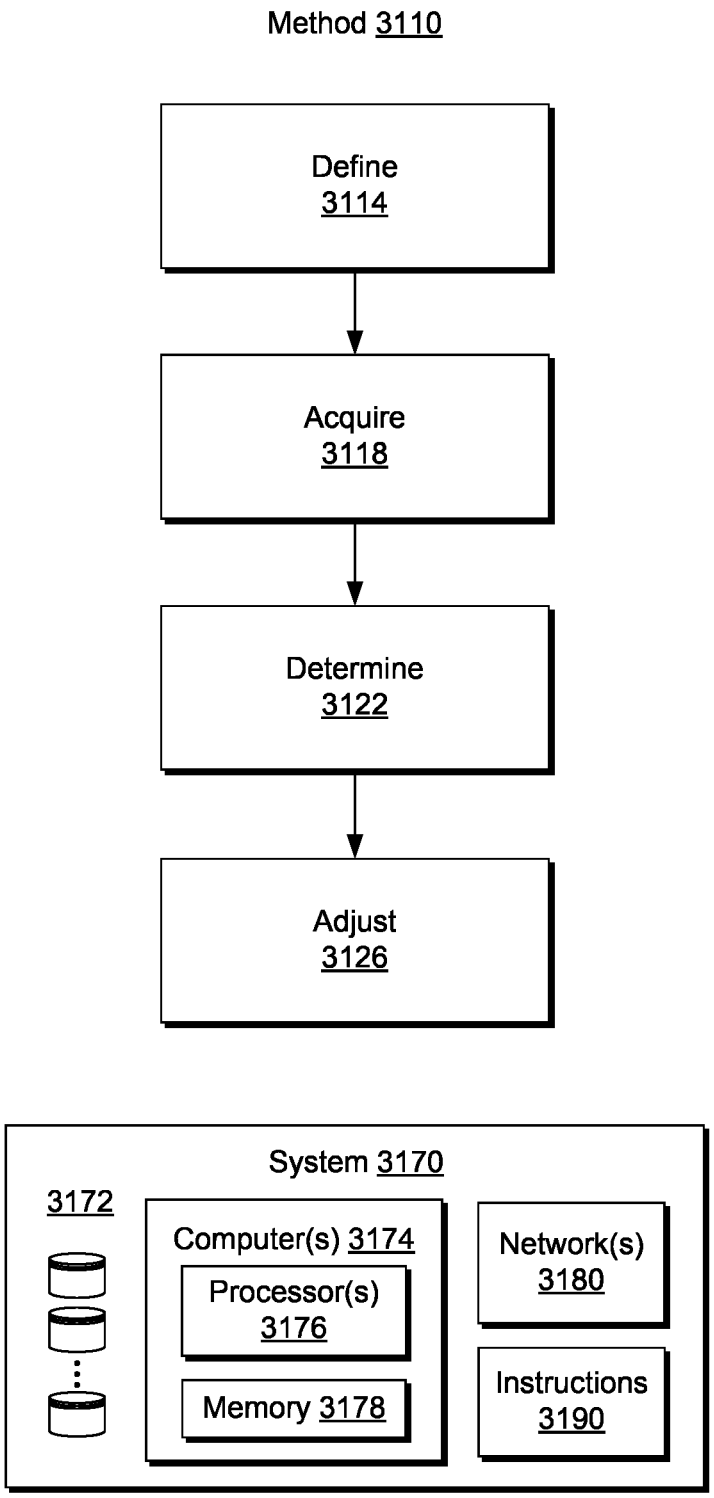
FIG. 31 illustrates an example of a method and an example of a system.

FIG. 31 shows an example of a method 3110 that includes a definition block 3114 for defining metrics, an acquisition block 3118 for acquiring data; a determination block 3122 for determining deltas; and an adjustment block 3126 for adjusting at least one process. Such a method may be a continuous (e.g., continual) improvement process. As an example, the method 3110 can include redefining one or more metrics and/or introducing one or more new metrics. In such an example, the determining deltas may be in real-time based at least in part on acquisition of real-time data via one or more channels.

As an example, a system may provide for RT KPI values that may be utilized, for example, for planning, for establishing quality benchmarks, for process improvement, etc. As an example, one or more section by section comparisons, trend comparison across regional markets, etc., may be made based at least in part on one or more RT KPIs. As an example, a drilling analyst may be supported by RT KPIs, for example, to achieve new performance targets. As an example, a method can include learning and, for example, improving performance (e.g., section by section, etc.).

As an example, a system may include one or more components for RT KPIs in PTK (e.g., one or more sets of processor-executable instructions stored in memory and executable by one or more processors).

As an example, a method can include pushing the speed limit of moving pipe in an operation. As an example, a method can include comparing a best speed and an actual speed. As an example, a method can include comparing a planned speed and an actual speed, where a cone of uncertainty may exist for future actual speeds and, for example, where adjustments may be made to reduce deltas and/or to increase speed(s). As an example, a method can include tripping in and/or tripping out.

As an example, a method can include defining metrics, determining a plan with respect to time, receiving data, determining deltas and making one or more adjustments. As an example, a method may include selecting channels and defining one or more functions based at least in part on a channel (e.g., associated information). As an example, a channel can be a real-time channel.

As an example, a well may be a deviated well or a horizontal well. As an example, a method can include reducing risk of sticking based at least in part on RT KPI information. As an example, a method can include gathering data for the rig and plotting in real-time versus plan to show deviations and/or other metrics.

As an example, a display may convey information to an operator of a rig during operation. Such information can include information as to deviations and, for example, as to one or more of velocity, acceleration, position versus time.

As an example, a system can include a rig, data acquisition equipment and analysis modules. For example, consider a system that includes a rig, the InterACT framework and a performance tool kit (PTK) framework. As an example, a system may include one or more features of the system 1000 of FIG. 10. As an example, adjustments may be made that improve performance, which may include slowing down or speeding up one or more processes (e.g., depending on one or more goals, etc.). As an example, slowing down may reduce risk of sticking, etc. As an example, an adjustment may aim to meet one or more regulatory goals.

In the example of FIG. 31, the system 3170 includes one or more information storage devices 3172, one or more computers 3174, one or more networks 3180 and instructions 3190. As to the one or more computers 3174, each computer may include one or more processors (e.g., or processing cores) 3176 and memory 3178 for storing the instructions 3190, for example, executable by at least one of the one or more processors. As an example, a computer may include one or more network interfaces (e.g., wired or wireless), one or more graphics cards, a display interface (e.g., wired or wireless), etc.

Figure 32:
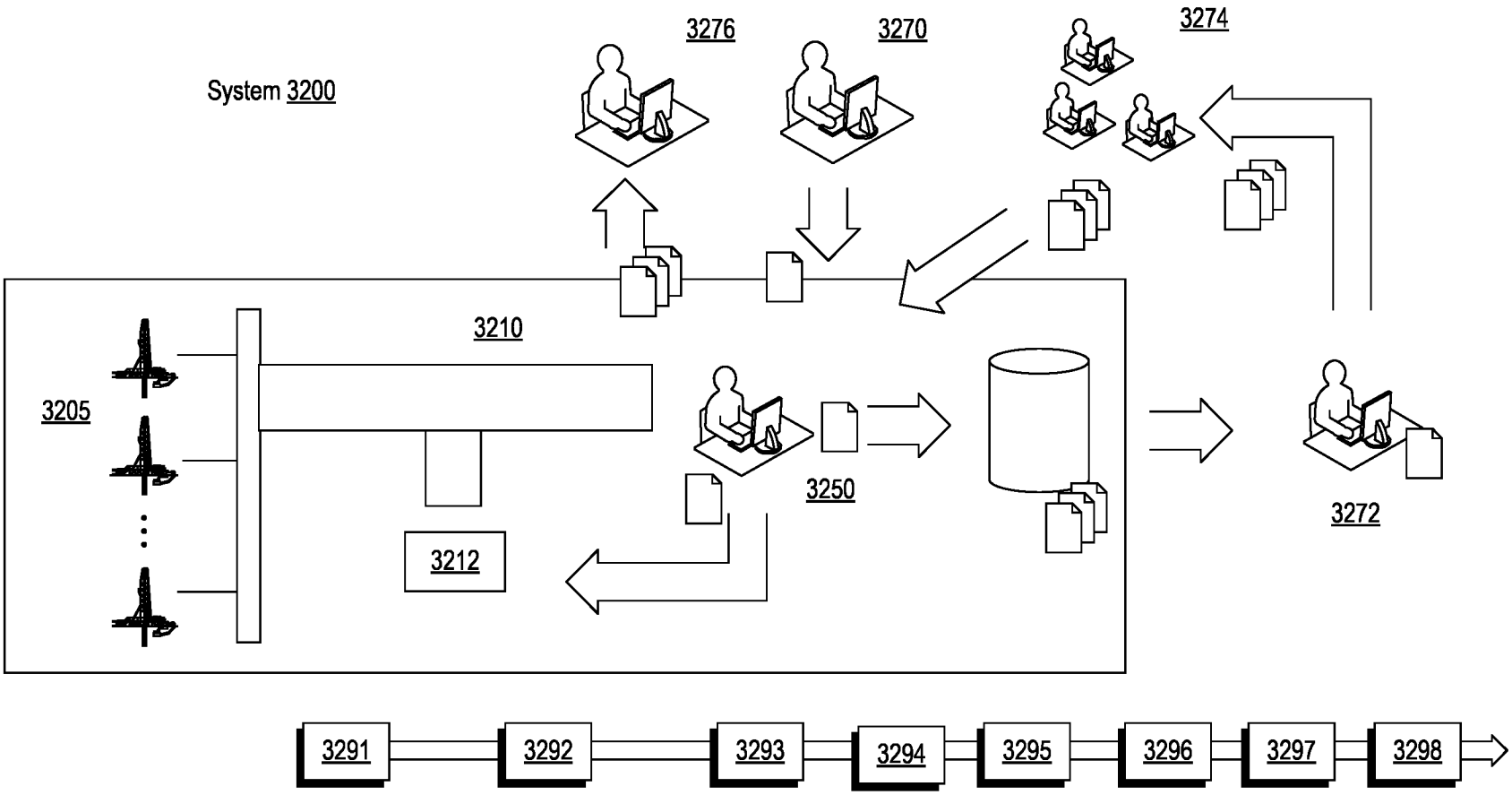
FIG. 32 illustrates an example of a system and example workflows.

FIG. 32 shows an example of a system 3200 and examples of workflows as associated with a plurality of wellsites 3205. In the example of FIG. 32, the block 3210 can correspond to various components of the system 1000 of FIG. 10 (e.g., and/or one or more other systems). As shown in the example of FIG. 32, a plurality of wells being drilled and/or completed (e.g., or otherwise being operated, etc.) can transmit information to one or more data interfaces that can provide data to an engine 3212, which can be or include an interpretation engine such as the interpretation engine 1012 of the system 1000 of FIG. 10. Such an engine may be or may include an inference engine.

As shown in the example of FIG. 32, a master review component 3250 can be implemented that can review output, which can include results of the interpretation engine 3212. As an example, the master review component 3250 may be operated to effectuate one or more forms of quality-control (QC) as to the output. As an example, an interpretation engine can output information that can be reviewed prior to transmission of the information to one or more destination addresses.

In the example of FIG. 32, rig site equipment can be an "actor" that can generate events, etc. As an example, rig site equipment may issue notifications or information that causes a system to address one or more situations that may be occurring at a rig site. For example, a delay may exist at a rig site due to an action or actions that are not being taken elsewhere.

FIG. 32 shows various digital files, which may be streaming files, discrete files, information associated with an API call, information associated with an API response, etc. FIG. 32 also shows various stations 3270, 3272, 3274 and 3276, which correspond to a wellsite assignment station 3270, a cross-fleet station 3272, an operations management station or stations 3274 and an escalation station 3276.

As an example, a workflow can include receiving an assignment file from the wellsite assignment station 3270, which may include a communication matrix file. The master review component 3250 may be aware of information in the assignment file or may be agnostic to assignments and review information generated regardless of destination(s) to which such generated information may be directed. The assignment file can include information for directing generated information to one or more cross-fleet stations such as the cross-fleet station 3272. Reports, as digital files, may be routed from the cross-fleet station 3272 to the operations management station or stations 3274. In such an example, one or more digital files may be generated by one or more of the operations management stations 3274 and transmitted to adjust one or more aspects associated with monitoring of one or more wellsites. Such information may be received by the master review component 3250 and utilized to adjust one or more aspects of the interpretation engine 3212. For example, information may be utilized to train one or more algorithms of the interpretation engine 3212.

As shown in FIG. 32, one or more digital files may be transmitted according to one or more escalation rules, which may be specified in a communication matrix file, which may be part of or associated with an assignment file. The various stations 3270, 3272, 3274 and 3276 can be operatively coupled via one or more networks such that escalation notifications can be adequately addressed, routed, etc., including to one or more of the wellsites 3205.

In the example of FIG. 32, various blocks 3291, 3292, 3293, 3294, 3295, 3296, 3297 and 3298 are shown, which correspond to algorithms, data storage, system behaviors, notifications, visualizations, quality control, collaboration and reporting components of the system 3200. The blocks are illustrated along a workflow arrow that corresponds to various actions that can be performed by the system 3200.

As an example, the system 3200 can operate for monitoring drilling activities (e.g., drilling, tripping, casing runs, riser runs, etc.) via various streaming (real-time) computations (e.g., as to stand detection, rig states, drilling activities, KPIs, statistics, etc.) and can persist data (e.g., stand KPIs, well KPIs, activity logs, etc.) as well as issue notifications (e.g., as to events, streaming interruptions, process interruptions, escalations, de-escalations, quality metrics). As an example, the system 3200 can include analyzing data as to quality. Such an approach can include excluding information, which may help to preserve integrity of the interpretation engine 3212 as to learning, training, etc., one or more algorithms. As an example, the system 3200 may generate information that can automatically and/or manually adjust one or more operations at one or more of the wellsites 3205.

The system 3200 includes various features that allow for feedback from individuals via various stations. Such feedback can be captured as knowledge, which can populate a knowledge base and/or be utilized to train one or more algorithms of the interpretation engine 3212 where evaluations may be performed based on various inputs to generate information that can be directed to one or more destinations (e.g., destination addresses per a communication matrix, etc.).

The system 3200 can transform drilling data from the plurality of wellsites 3205 into actionable knowledge, which can result in feedback, which can further enhance one or more algorithms of the interpretation engine 3212.

As mentioned, a system can include an interpretation engine such as an interpretation engine of the APACHE STORM distributed real-time computation system for processing large volumes of streaming data. Such a system can process over a million records per second per node on a cluster. Such a system can include operational dashboards such as the various specialized stations in the system 3200 of FIG. 32. As an example, a system can include a classifier engine that can include one or more features of the scikit-learn framework (e.g., k-means, etc.). As an example, such a classifier engine may be part of an inference and/or interpretation engine, which, as explained, may be part of an embedded computation system of a piece of equipment or assembly of equipment. As explained, a "smart" top drive and/or a "smart" drawworks may provide for slip status output using a dynamic classifier (e.g., a self-calibrating classifier, etc.). As an example, the system may implement one or more security measures, which may aim to preserve integrity of one or more interpretation engines. As an example, the system 3200 can include a cyber security analytics and threat detection component.

As an example, the system 3200 can help to prevent particular scenarios at the wellsites 3205 and/or help to optimize operations at the wellsites 3205. As an example, the system 3200 can become aware of its own operation, for example, as part of security that aims to protect the interpretation engine 3212 from input that may result in unacceptable output and/or unacceptable training (e.g., learning). As an example, the system 3200 may issue notifications where operations procedures are followed or not followed.

As an example, the system 3200 may analyze information associated with equipment conditions at the wellsites 3205. For example, the system 3200 can include a component that tracks equipment histories as to usage, maintenance, etc. As an example, one or more notifications may be issued where usage may deviate from an expected usage, where maintenance is indicated, etc.

As an example, the system 3200 may determine whether information is corrupt, missing, or otherwise inadequate. Such determinations may be associated with equipment condition. For example, where a sensor at a wellsite fails or is failing, data may drift, be sporadic, etc. The system 3200 may include a component that assesses data prior to transmission to the interpretation engine 3212. As an example, the interpretation engine 3212 may assess data to determine whether it is deviating from one or more expectations for such data, optionally based on other information from one or more of the wellsites 3205.

Figure 33:
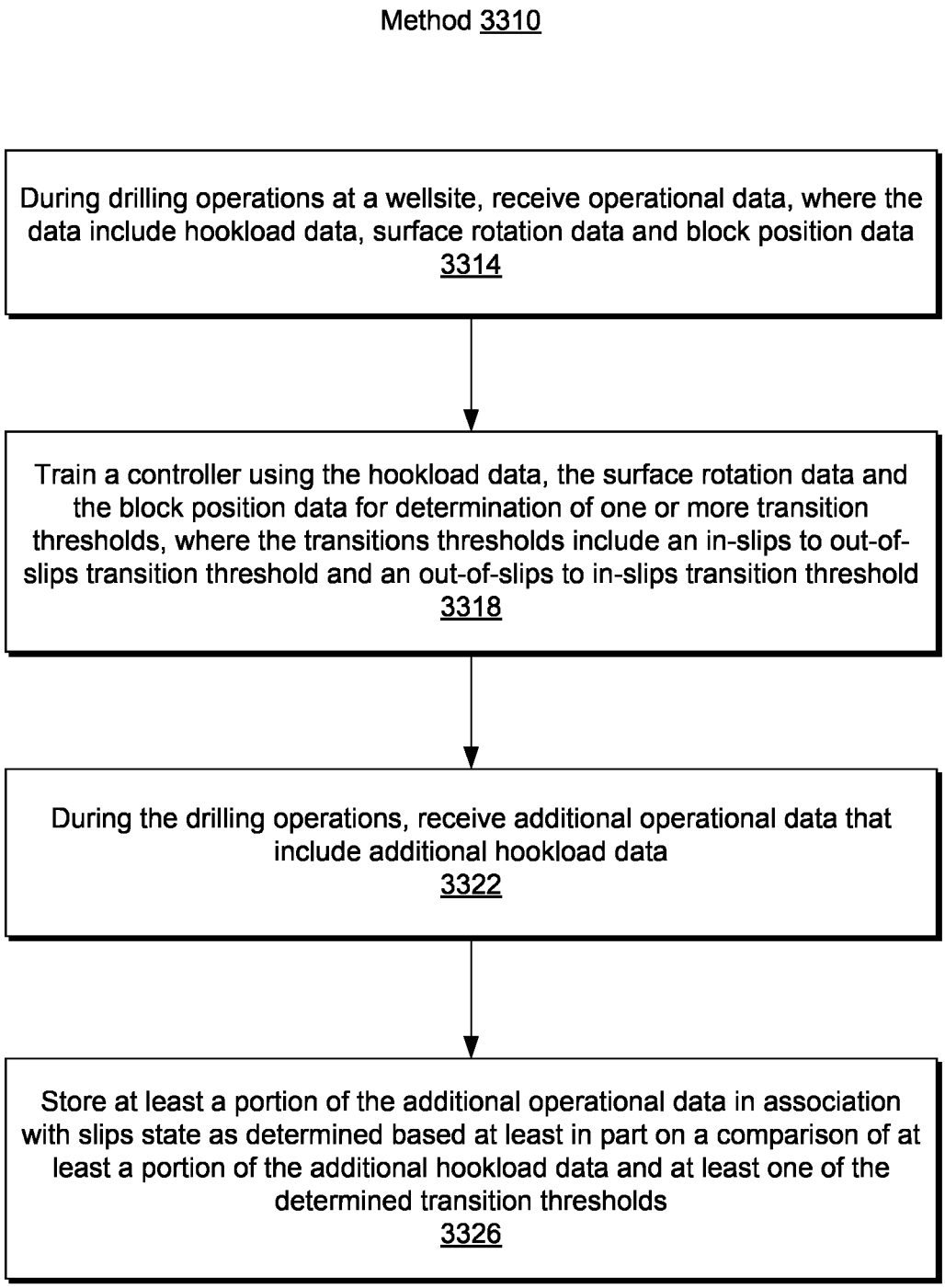
FIG. 33 illustrates an example of a method.

FIG. 33 shows an example of a method 3300 that can include, a reception block 3314 for, during drilling operations at a wellsite, receiving operational data, where the data include hookload data, surface rotation data and block position data; a training block 3318 for training a controller using the hookload data, the surface rotation data and the block position data for determination of one or more transition thresholds, where the transitions thresholds include an in-slips to out-of-slips transition threshold and an out-of-slips to in-slips transition threshold; a reception block 3322 for, during the drilling operations, receiving additional operational data that include additional hookload data; and a storage block 3326 for storing at least a portion of the additional operational data in association with slips state as determined based at least in part on a comparison of at least a portion of the additional hookload data and at least one of the determined transition thresholds.

As an example, the method 3300 may be performed using a system, which may be a computational system, a computing system, etc. As an example, a system may be an embedded system, as mentioned, such as an embedded system of a top drive assembly, a drawworks, etc. As an example, a system may include one or more features of the system 3170 of FIG. 31. As an example, one or more of the blocks 3314, 3318, 3322 and 3326 of the method 3300 may be provided as instructions that are executable by one or more processors where such instructions may be stored in one or more processor-readable storage media.

As an example, a system can include a data interface that receives data associated with a plurality of wells; an inference engine that receives and analyzes at least a portion of the data to generate results; and a communication engine that outputs information based at least in part on the results. In such an example, the data can include measured depth data for the plurality of wells where, for example, the results include wellbore depth results for each of the plurality of wells. In such an example, the communication engine may output wellbore depth information for at least a portion of the plurality of wells to a destination address specified in a file that associates wells and destination addresses.

As an example, an inference engine may characterize uncertainty of wellbore depth for each of a plurality of wells. As an example, an inference engine may generate wellbore depth results based on at least two types of measured depth data.

As an example, a system can include receiving various types of data where the data can include rig block position data and/or rig hookload data. As an example, an interpretation engine can generate results that may include non-productive time results based at least in part on rig block position data and/or rig hookload data.

As an example, a system can include a communication matrix that relates destination addresses to a plurality of wells where a communication engine outputs information to one or more destination addresses based at least in part on the communication matrix.

As an example, results generated by an interpretation engine can include events. In such an example, a communication engine can relate types of events and levels and/or types of events to destination addresses. As an example, a communication matrix can be a digital file that associates events and levels and/or events and destination addresses and/or levels and destination addresses.

As an example, a communication engine can output information for a type of event to a destination address associated with one of a plurality of levels where each of the levels is associated with a role. In such an example, the communication engine can adjust output of information from one of the levels to another one of the levels to escalate the information and/or adjusts output of information from one of the levels to another one of the levels to de-escalate the information.

As an example, an inference engine can generate results for individual wells of a plurality of wells based at least in part on corresponding individual well plans. In such an example, the well plans can be digital well plans that are received by a system that includes the inference engine.

As an example, an inference engine can receive and analyze at least a portion of data from a first plurality of wells and from a second plurality of wells to generate results for the first plurality of wells and the second plurality of wells.

As an example, a method can include receiving data associated with a plurality of wells; analyzing at least a portion of the data using an interpretation engine to generate results; and outputting information based at least in part on the results. In such an example, the interpretation engine can be or can include an inference engine.

One or more computer-readable storage media can include processor-executable instructions to instruct a computing system to: receive data associated with a plurality of wells; analyze at least a portion of the data using an interpretation engine to generate results; and output information based at least in part on the results. In such an example, the interpretation engine can be or can include an inference engine.

As an example, a system can include a processor; memory operatively coupled to the processor; a data interface that receives data from a drill rig where the data includes hookload data with respect to time; processor-executable instructions stored in the memory and executable by the processor to instruct the system to: determine a drill bit depth condition with respect to a depth criterion; for a first drill bit depth condition, determine a slip status based at least in part on the hookload data and a hookload threshold; and for a second drill bit depth condition, determine a dynamic hookload threshold and determine a slip status based at least in part on the hookload data and the dynamic hookload threshold. Such a system can include, for example, processor-executable instructions stored in the memory and executable by the processor to instruct the system to perform stand detection based at least in part on the slip status.

As an example, a system can include processor-executable instructions stored in memory and executable by a processor to instruct the system to perform pipe change detection based at least in part on the slip status.

As an example, a hookload threshold can be a standard deviation based hookload threshold. As an example, a system can determine a dynamic hookload threshold by utilizing hookload data from a current stand and utilizing hookload data from a prior stand. In such an example, a sliding window can capture a hookload high data value for the prior stand and/or a sliding window can capture a hookload low data value for the current stand.

As an example, a depth criterion can be approximately 2,000 feet. In such an example, a first drill bit depth condition can be less than (e.g., or equal to) approximately 2,000 feet and a second drill bit depth condition can be greater than (e.g., or equal to) approximately 2,000 feet. As an example, a hookload value can be a proxy for the depth criterion. For example, consider a hookload value that is approximately 10 klbf.

As an example, a data interface can receive stand pipe pressure data with respect to time. In such an example, a system can determine a slip status based at least in part on the stand pipe pressure data. In such an example, stand pipe pressure data can depend on pump status.

As an example, a data interface can receive surface torque data with respect to time. In such an example, a system can determine a slip status based at least in part on the surface torque data. In such an example, the system can confirm inslip status based at least in part on the surface torque data.

As an example, a method can include receiving data from a drill rig during drilling operations for a well where the data includes hookload data with respect to time; determining a drill bit depth condition with respect to a depth criterion; and for a first drill bit depth condition, determining a slip status based at least in part on the hookload data and a hookload threshold and, for a second drill bit depth condition, determining a dynamic hookload threshold and determining a slip status based at least in part on the hookload data and the dynamic hookload threshold. In such an example, the method can include performing pipe change detection based at least in part on the slip status and/or performing stand detection based at least in part on the slip status. As an example, a method can include determining a slip status based at least in part on stand pipe pressure and/or based at least in part on surface torque.

As an example, one or more computer-readable storage media can include processor-executable instructions to instruct a computing system to: receive data from a drill rig during drilling operations for a well where the data includes hookload data with respect to time; determine a drill bit depth condition with respect to a depth criterion; and for a first drill bit depth condition, determine a slip status based at least in part on the hookload data and a hookload threshold and, for a second drill bit depth condition, determine a dynamic hookload threshold and determining a slip status based at least in part on the hookload data and the dynamic hookload threshold.

As an example, a method can include during drilling operations at a wellsite, receiving operational data, where the data include hookload data, surface rotation data and block position data; training a controller using the hookload data, the surface rotation data and the block position data for determination of one or more transition thresholds, where the transitions thresholds include an in-slips to out-of-slips transition threshold and an out-of-slips to in-slips transition threshold; during the drilling operations, receiving additional operational data that include additional hookload data; and storing at least a portion of the additional operational data in association with slips state as determined based at least in part on a comparison of at least a portion of the additional hookload data and at least one of the determined transition thresholds. In such an example, the controller can be a drawworks controller. As an example, a method can include receiving sensor data from at least one drawworks sensor. For example, consider at least one drawworks sensor that is or includes a load sensor and/or at least one drawworks sensor that is or includes a position encoder. As an example, a drawworks can include a load sensor and a position encoder where data from the load sensor and/or the position encoder can be utilized to determine one or more thresholds.

As an example, a method can include receiving sensor data from a top drive. For example, consider receiving sensor data from at least one load sensor operatively coupled to a top drive and/or at least a portion of a position sensor operatively coupled to a top drive.

As an example, a drawworks and/or a top drive may include an embedded computing system that can determine one or more slip states, for example, directly or indirectly via determination of one or more thresholds.

As an example, a method can include training that utilizes a k-means classification machine learning model. In such an example, the k-means classification machine learning model can utilize two clusters, where one of the two clusters corresponds to a high hookload baseline and another one of the two clusters corresponds to a low hookload baseline. As an example, a centroid value of a high hookload baseline cluster can be utilized to determine the one or more transition thresholds. For example, consider an in-slips to out-of-slips transition threshold that is a first fraction of a centroid value and an out-of-slips to in-slips transition threshold that is a second, different fraction of the centroid value. In such an example, a difference between the fractions may be approximately 0.2 to 0.8 or, in percentages, 20 percent to 80 percent (e.g., consider an 85 percent of the centroid value as a high threshold and a 15 percent of the centroid value as a low threshold such that the difference is 70 percent).

As an example, a method can include dynamically adjusting and/or forgetting a baseline, a centroid, etc., responsive to one or more conditions, criteria, etc. As explained, a change in a BHA may cause dynamic adjusting and/or forgetting.

As an example, a method can include performing additional training of a controller using at least a portion of additional operational data to dynamically adjust at least one of the one or more transition thresholds.

As an example, a method can include, responsive to a trigger, re-training a controller. As an example, a trigger may be based on a timer, a number of stands, a change in a BHA, tripping out, tripping in, stuck pipe, etc. As an example, where a reset occurs (e.g., forgetting statistics, etc.), a training period may occur for a number of stands, etc., until acceptable statistics are generated for determining one or more thresholds (e.g., based on one or more baselines).

As an example, a method can include resetting a k-means classifier that can be part of a controller, which may be a drawworks controller, a top drive controller or another type of controller.

As an example, a k-means classifier may be implemented in 1D using time series data. For example, consider 1D time series data for hookload during transitions from IS to OOS and OOS to IS. In such an example, the k-means classifier can learn a high hookload baseline as one cluster and a low hookload baseline as another cluster where one or both of the baselines may be utilized to dynamically set one or more thresholds for detecting IS to OOS and/or OOS to IS transitions.

As an example, a method can include determining a drill bit depth condition with respect to a depth criterion. For example, consider, for a first drill bit depth condition, determining a slip state based at least in part on hookload data and a hookload threshold and, for a second drill bit depth condition, determining a dynamic hookload threshold and determining the slip state based at least in part on the hookload data and the dynamic hookload threshold.

As an example, a method can include utilizing a depth criterion as a trigger to reset training of a controller. For example, consider a depth criterion that is less than approximately 3000 feet in total vertical depth. In such an example, noisy data from shallow depths may be forgotten. For example, statistics for shallow depths less than approximately 3000 feet in total vertical depth may include noise due to weight of a drillstring being within a certain ratio of weight of a traveling block assembly (e.g., including a top drive, etc.). As depth increases, the ratio can change such that noise can diminish. Where noise diminishes due to physical aspects of weight (e.g., as may be seen in hookload data for IS and OOS states), statistics and hence classification may be improved. With improved classification, detection of transitions can be improved, which can benefit control, data processing, etc.

As an example, a system can include a processor; memory operatively coupled to the processor; processor-executable instructions stored in the memory and executable by the processor to instruct the system to: during drilling operations at a wellsite, receive operational data, where the data include hookload data, surface rotation data and block position data; train a controller using the hookload data, the surface rotation data and the block position data for determination of one or more transition thresholds, where the transitions thresholds include an in-slips to out-of-slips transition threshold and an out-of-slips to in-slips transition threshold; during the drilling operations, receive additional operational data that include additional hookload data; and store at least a portion of the additional operational data in association with slips state as determined based at least in part on a comparison of at least a portion of the additional hookload data and at least one of the determined transition thresholds.

As an example, one or more computer-readable storage media can include processor-executable instructions to instruct a computing system to: during drilling operations at a wellsite, receive operational data, where the data include hookload data, surface rotation data and block position data; train a controller using the hookload data, the surface rotation data and the block position data for determination of one or more transition thresholds, where the transitions thresholds include an in-slips to out-of-slips transition threshold and an out-of-slips to in-slips transition threshold; during the drilling operations, receive additional operational data that include additional hookload data; and store at least a portion of the additional operational data in association with slips state as determined based at least in part on a comparison of at least a portion of the additional hookload data and at least one of the determined transition thresholds.

As an example, a method may be implemented in part using computer-readable media (CRM), for example, as a module, a block, etc. that include information such as instructions suitable for execution by one or more processors (or processor cores) to instruct a computing device or system to perform one or more actions. As an example, a single medium may be configured with instructions to allow for, at least in part, performance of various actions of a method. As an example, a computer-readable medium (CRM) may be a computer-readable storage medium (e.g., a non-transitory medium) that is not a carrier wave.

According to an embodiment, one or more computer-readable media may include computer-executable instructions to instruct a computing system to output information for controlling a process. For example, such instructions may provide for output to sensing process, an injection process, drilling process, an extraction process, an extrusion process, a pumping process, a heating process, etc.

Figure 34:
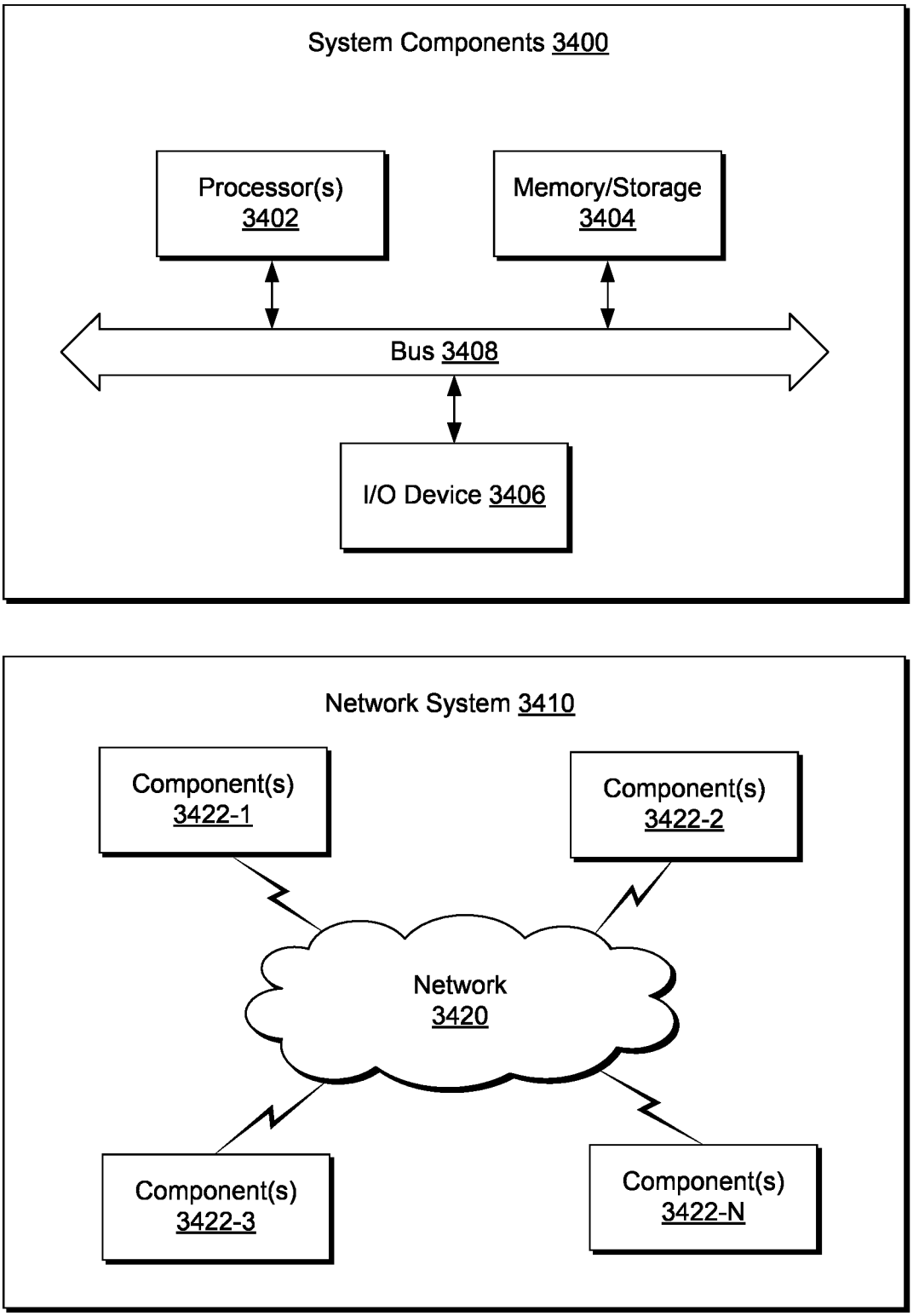
FIG. 34 illustrates example components of a system and a networked system.

FIG. 34 shows components of a computing system 3400 and a networked system 3410 with a network 3420. The system 3400 includes one or more processors 3402, memory and/or storage components 3404, one or more input and/or output devices 3406 and a bus 3408. According to an embodiment, instructions may be stored in one or more computer-readable media (e.g., memory/storage components 3404). Such instructions may be read by one or more processors (e.g., the processor(s) 3402) via a communication bus (e.g., the bus 3408), which may be wired or wireless. The one or more processors may execute such instructions to implement (wholly or in part) one or more attributes (e.g., as part of a method). A user may view output from and interact with a process via an I/O device (e.g., the device 3406). According to an embodiment, a computer-readable medium may be a storage component such as a physical memory storage device, for example, a chip, a chip on a package, a memory card, etc.

According to an embodiment, components may be distributed, such as in the network system 3410. The network system 3410 includes components 3422-1, 3422-2, 3422-3, . . . 3422-N. For example, the components 3422-1 may include the processor(s) 3402 while the component(s) 3422-3 may include memory accessible by the processor(s) 3402. Further, the component(s) 3422-2 may include an I/O device for display and optionally interaction with a method. The network may be or include the Internet, an intranet, a cellular network, a satellite network, etc.

As an example, a device may be a mobile device that includes one or more network interfaces for communication of information. For example, a mobile device may include a wireless network interface (e.g., operable via IEEE 802.11, ETSI GSM, BLUETOOTH, satellite, etc.). As an example, a mobile device may include components such as a main processor, memory, a display, display graphics circuitry (e.g., optionally including touch and gesture circuitry), a SIM slot, audio/video circuitry, motion processing circuitry (e.g., accelerometer, gyroscope), wireless LAN circuitry, smart card circuitry, transmitter circuitry, GPS circuitry, and a battery. As an example, a mobile device may be configured as a cell phone, a tablet, etc. As an example, a method may be implemented (e.g., wholly or in part) using a mobile device. As an example, a system may include one or more mobile devices.

As an example, a system may be a distributed environment, for example, a so-called "cloud" environment where various devices, components, etc. interact for purposes of data storage, communications, computing, etc. As an example, a device or a system may include one or more components for communication of information via one or more of the Internet (e.g., where communication occurs via one or more Internet protocols), a cellular network, a satellite network, etc. As an example, a method may be implemented in a distributed environment (e.g., wholly or in part as a cloud-based service).

As an example, information may be input from a display (e.g., consider a touchscreen), output to a display or both. As an example, information may be output to a projector, a laser device, a printer, etc. such that the information may be viewed. As an example, information may be output stereographically or holographically. As to a printer, consider a 2D or a 3D printer. As an example, a 3D printer may include one or more substances that can be output to construct a 3D object. For example, data may be provided to a 3D printer to construct a 3D representation of a subterranean formation. As an example, layers may be constructed in 3D (e.g., horizons, etc.), geobodies constructed in 3D, etc. As an example, holes, fractures, etc., may be constructed in 3D (e.g., as positive structures, as negative structures, etc.).

Although only a few examples have been described in detail above, those skilled in the art will readily appreciate that many modifications are possible in the examples. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed is:

1. A method comprising:

during drilling operations at a wellsite, receiving operational data, wherein the data comprise hookload data, surface rotation data and block position data;

training a controller using the hookload data, the surface rotation data and the block position data for determination of one or more transition thresholds, wherein the transitions thresholds comprise an in-slips to out-of-slips transition threshold and an out-of-slips to in-slips transition threshold, wherein the training comprises utilization of a k-means classification machine learning model and wherein the k-means classification machine learning model utilizes two clusters, wherein one of the two clusters corresponds to a high hookload baseline and another one of the two clusters corresponds to a low hookload baseline;

during the drilling operations, receiving additional operational data that comprise additional hookload data; and storing at least a portion of the additional operational data in association with slips state as determined based at least in part on a comparison of at least a portion of the additional hookload data and at least one of the determined transition thresholds.

2. The method of claim 1, wherein the controller comprises a drawworks controller.

3. The method of claim 1, wherein the receiving operational data comprises receiving sensor data from at least one drawworks sensor.

4. The method of claim 3, wherein the at least one drawworks sensor comprises a load sensor.

5. The method of claim 3, wherein the at least one drawworks sensor comprises a position encoder.

6. The method of claim 3, wherein the at least one drawworks sensor comprises a load sensor and a position encoder.

7. The method of claim 1, wherein the receiving operational data comprises receiving sensor data from a top drive.

8. The method of claim 1, wherein the receiving operational data comprises receiving sensor data from at least one load sensor operatively coupled to a top drive.

9. The method of claim 1, wherein a centroid value of the high hookload baseline cluster is utilized to determine the one or more transition thresholds.

10. The method of claim 9, wherein the in-slips to out-of-slips transition threshold is a first fraction of the centroid value and the out-of-slips to in-slips transition threshold is a second, different fraction of the centroid value.

11. The method of claim 1, comprising performing additional training of the controller using at least a portion of the additional operational data to dynamically adjust at least one of the one or more transition thresholds.

12. The method of claim 1, comprising, responsive to a trigger, re-training the controller.

13. The method of claim 1, comprising determining a drill bit depth condition with respect to a depth criterion.

14. The method of claim 13, comprising, for a first drill bit depth condition, determining the slips state based at least in part on the additional hookload data and a hookload threshold as one of the determined transition thresholds and, for a second drill bit depth condition, determining a dynamic hookload threshold and determining the slips state based at least in part on the additional hookload data and the dynamic hookload threshold as one of the determined transition thresholds.

15. The method of claim 1, comprising utilizing a depth criterion as a trigger to reset training of the controller.

16. The method of claim 15, wherein the depth criterion is less than 3000 feet in total vertical depth.

17. A system comprising:

a processor;

memory operatively coupled to the processor;

processor-executable instructions stored in the memory and executable by the processor to instruct the system to:

during drilling operations at a wellsite, receive operational data, wherein the data comprise hookload data, surface rotation data and block position data;

train a controller using the hookload data, the surface rotation data and the block position data for determination of one or more transition thresholds, wherein the transitions thresholds comprise an in-slips to out-of-slips transition threshold and an out-of-slips to in-slips transition threshold, wherein to train comprises utilization of a k-means classification machine learning model and wherein the k-means classification machine learning model utilizes two clusters, wherein one of the two clusters corresponds to a high hookload baseline and another one of the two clusters corresponds to a low hookload baseline;

during the drilling operations, receive additional operational data that comprise additional hookload data; and store at feast a portion of the additional operational data in association with slips state as determined based at least in part on a comparison of at least a portion of the additional hookload data and at least one of the determined transition thresholds.

18. One or more computer-readable storage media comprising processor-executable instructions to instruct a computing system to:

during drilling operations at a wellsite, receive operational data, wherein the data comprise hookload data, surface rotation data and block position data;

train a controller using the hookload data, the surface rotation data and the block position data for determination of one or more transition thresholds, wherein the transitions thresholds comprise an in-slips to out-of-slips transition threshold and an out-of-slips to in-slips transition threshold, wherein to train comprises utilization of a k-means classification machine learning model and wherein the k-means classification machine learning model utilizes two clusters, wherein one of the two clusters corresponds to a high hookload baseline and another one of the two clusters corresponds to a low hookload baseline;

during the drilling operations, receive additional operational data that comprise additional hookload data; and store at least a portion of the additional operational data in association with slips state as determined based at least in part on a comparison of at least a portion of the additional hookload data and at least one of the determined transition thresholds.

19. A method comprising:

during drilling operations at a wellsite, receiving operational data, wherein the data comprise hookload data, surface rotation data and block position data;

training a controller using the hookload data, the surface rotation data and the block position data for determination of one or more transition thresholds, wherein the transitions thresholds comprise an in-slips to out-of-slips transition threshold and an out-of-slips to in-slips transition threshold;

during the drilling operations, receiving additional operational data that comprise additional hookload data;

determining a drill bit depth condition with respect to a depth criterion;

for a first drill bit depth condition, determining slips state based at least in part on the additional hookload data and a hookload threshold as one of the determined transition thresholds and, for a second drill bit depth condition, determining a dynamic hookload threshold and determining slips state based at least in part on the additional hookload data and the dynamic hookload threshold as one of the determined transition thresholds; and storing at least a portion of the additional operational data in association with the slips state as determined based at least in part on a comparison of at least a portion of the additional hookload data and at least one of the determined transition thresholds.

* * * * *